US007383013B2

(12) United States Patent
Watanabe et al.

(10) Patent No.: US 7,383,013 B2
(45) Date of Patent: Jun. 3, 2008

(54) IMAGE FORMING APPARATUS USING A CONTACT OR A PROXIMITY TYPE OF CHARGING SYSTEM INCLUDING A PROTECTION SUBSTANCE ON A MOVEABLE BODY TO BE CHARGED

(75) Inventors: Kazuhiko Watanabe, Tokyo (JP); Kenji Sugiura, Kanagawa (JP); Yasushi Nakazato, Tokyo (JP); Kazuhito Watanabe, Kanagawa (JP); Masahiko Shakuto, Kanagawa (JP); Daichi Yamaguchi, Tokyo (JP); Yasuo Suzuki, Shizuoka (JP); Nozomu Tamoto, Shizuoka (JP); Hiroshi Nakai, Kanagawa (JP); Takahiko Tokumasu, Tokyo (JP); Kohichi Ohshima, Shizuoka (JP); Nekka Matsuura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/765,098

(22) Filed: Jun. 19, 2007

(65) Prior Publication Data

US 2007/0242992 A1 Oct. 18, 2007

Related U.S. Application Data

(62) Division of application No. 11/431,716, filed on May 11, 2006, now Pat. No. 7,251,438, which is a division of application No. 10/769,855, filed on Feb. 3, 2004, now Pat. No. 7,103,301.

(30) Foreign Application Priority Data

| | | |
|---|---|---|
| Feb. 18, 2003 | (JP) | 2003-039538 |
| Apr. 2, 2003 | (JP) | 2003-098814 |
| Apr. 25, 2003 | (JP) | 2003-120873 |
| Jun. 24, 2003 | (JP) | 2003-179453 |
| Sep. 18, 2003 | (JP) | 2003-326781 |
| Dec. 26, 2003 | (JP) | 2003-433261 |
| Dec. 26, 2003 | (JP) | 2003-434268 |

(51) Int. Cl.
*G03G 21/00* (2006.01)
*G03G 15/00* (2006.01)

(52) U.S. Cl. ..... 399/354; 399/159

(58) Field of Classification Search ..... 399/98, 399/99, 159, 354
See application file for complete search history.

(56) References Cited

U.S. PATENT DOCUMENTS 4,506,975 A * 3/1985 Shukuri et al. ..... 399/354

(Continued)

FOREIGN PATENT DOCUMENTS

| | | |
|---|---|---|
| JP | 62-103657 | 5/1987 |
| JP | 02-079047 | 3/1990 |

OTHER PUBLICATIONS

U.S. Appl. No. 11/952,453, filed Dec. 7, 2007, Yamashita et al.

*Primary Examiner*—Sandra L Brase
(74) *Attorney, Agent, or Firm*—Oblon, Spivak, McClelland, Maier & Neustadt, P.C.

(57) ABSTRACT

An image forming apparatus of the present invention includes a movable body to be charged and a charger including a charging member that contacts or adjoins the body to be charged and applies a voltage, including an AC component, to the charging member for thereby charging the body. A protection substance for protecting the surface of the body from deterioration ascribable to charging is caused to exist on the body. The number of particular elements, contained in the protection substance and detected by an X-ray photon spectral analyzer (XPS) in a zone where the charging member charges the body, is held in a particular ratio to the total number of all elements constituting the outermost surface of the body and also detected by the XPS.

5 Claims, 43 Drawing Sheets

U.S. PATENT DOCUMENTS 5,148,218 A 9/1992 Nakane et al.
5,385,797 A 1/1995 Nagahara et al. ..... 399/159 X
5,597,673 A 1/1997 Watanabe et al.
5,665,500 A 9/1997 Suzuki
5,677,096 A 10/1997 Suzuki
5,709,959 A 1/1998 Adachi et al.
5,715,500 A 2/1998 Nakazato et al.
5,723,243 A 3/1998 Sasaki et al.
5,740,494 A 4/1998 Shoji et al.
5,747,210 A 5/1998 Emoto et al.
5,750,299 A 5/1998 Ohshima et al.
5,765,087 A 6/1998 Yano et al.
5,789,128 A 8/1998 Adachi et al.
5,812,919 A 9/1998 Takano et al.
5,840,454 A 11/1998 Nagai et al.
5,846,680 A 12/1998 Adachi et al.
5,910,561 A 6/1999 Adachi et al.
5,924,360 A 7/1999 Adachi et al.
5,928,828 A 7/1999 Suzuki
5,937,228 A 8/1999 Shoji et al.
5,942,363 A 8/1999 Tanaka et al.
5,955,228 A 9/1999 Sakai et al.
6,009,301 A * 12/1999 Maher et al. ..... 399/354 X
6,018,014 A 1/2000 Nagai et al.
6,026,262 A 2/2000 Kinoshita et al.
6,030,736 A 2/2000 Ikegami et al.
6,034,792 A 3/2000 Nakazato et al.
6,050,183 A 4/2000 Tanaka et al.
6,052,205 A 4/2000 Matsuura
6,063,835 A 5/2000 Ohshima et al.
6,069,224 A 5/2000 Adachi et al.
6,092,461 A 7/2000 Tanaka et al.
6,136,493 A 10/2000 Fujiwara et al.
6,160,977 A 12/2000 Takeichi et al.
6,191,249 B1 2/2001 Tanaka et al.
6,236,820 B1 5/2001 Nakazato et al.
6,269,228 B1 * 7/2001 Kayahara et al. ..... 399/37
6,295,435 B1 9/2001 Shinohara et al.
6,295,437 B1 9/2001 Hodoshima et al.
6,345,170 B1 2/2002 Nakazato et al.
6,348,519 B1 2/2002 Ohshima et al.
6,363,229 B1 3/2002 Shiraishi et al.
6,366,751 B1 4/2002 Shakuto et al.
6,381,435 B2 4/2002 Shinohara et al.
6,398,345 B1 6/2002 Sakai et al.
6,400,917 B2 6/2002 Nakazato et al.
6,403,275 B1 6/2002 Kuramoto et al.
6,459,816 B2 10/2002 Matsuura et al.
6,461,780 B2 10/2002 Itami et al. ..... 430/58.15
6,466,754 B2 10/2002 Nakazato et al.
6,468,706 B2 10/2002 Matsuda et al.
6,470,169 B2 10/2002 Nakazato
6,507,674 B1 1/2003 Yagishita et al.
6,519,052 B1 2/2003 Oneda et al.
6,544,704 B1 4/2003 Matsuda et al.
6,556,707 B1 4/2003 Yagishita et al.
6,558,862 B2 5/2003 Kojima et al. ..... 399/159 X
6,560,419 B2 5/2003 Sugiura
6,562,529 B1 5/2003 Kojima et al.
6,566,026 B2 5/2003 Watanabe et al.
6,571,071 B2 5/2003 Kanoshima et al.
6,573,016 B2 6/2003 Kami et al.
6,580,887 B2 6/2003 Nakazato et al.
6,593,048 B2 7/2003 Sasaki et al.
6,603,884 B2 8/2003 Matsuura et al.
6,625,409 B2 9/2003 Shakuto et al.
6,641,964 B2 11/2003 Ikuno et al.
6,653,033 B1 11/2003 Kami et al.
6,654,579 B2 11/2003 Shakuto et al.
6,660,443 B2 12/2003 Sugiyama et al.
6,667,141 B2 12/2003 Iwamoto et al.
6,669,189 B2 12/2003 Seto et al.
6,674,982 B2 1/2004 Saitoh et al.
6,681,096 B2 1/2004 Seto et al.
6,683,990 B2 1/2004 Yagishita et al.
6,697,588 B2 2/2004 Nakazato et al.
6,699,632 B2 3/2004 Higuchi et al.
6,704,455 B1 3/2004 Yamazaki et al.
6,707,480 B2 3/2004 Ameyama et al.
6,714,685 B2 3/2004 Matsuura et al.
6,721,523 B2 4/2004 Sugiura et al.
6,725,003 B2 4/2004 Shinkai et al.
7,103,301 B2 9/2006 Watanabe et al.
2001/0031411 A1 10/2001 Kojima et al.
2003/0036010 A1 2/2003 Suzuki et al.
2003/0058706 A1 3/2003 Okamoto et al.
2003/0128243 A1 7/2003 Okamoto et al.
2003/0165765 A1 9/2003 Yamashita et al.
2004/0091276 A1 5/2004 Yoshida et al.
2005/0196193 A1 9/2005 Nozomu et al.
2005/0244176 A1 11/2005 Nakai et al.

* cited by examiner

FIG. 5

| AMOUNT OF ZINC STEARATE ($mg/mm^2$) | DETERIORATION |
|---|---|
| 0.0002 | OCCURRED |
| 0.0016 | NOT OCCURRED |

FIG. 13

| SAMPLE | ELEMENT-BY-ELEMENT NUMBER RATIOS (%) | | | |
|---|---|---|---|---|
| | C | O | Si | Zn |
| SAMPLE 1 | 83.00 | 13.90 | 2.92 | 0.21 |
| SAMPLE 2 | 87.00 | 9.25 | 0.59 | 2.40 |

FIG. 14

| | | ELEMENT-BY-ELEMENT NUMBER RATIO (%) | | | | TOTAL NUMBER |
|---|---|---|---|---|---|---|
| | | C | O | Si | Zn | |
| SAMPLE 1 | NUMBER RATIO OF ELEMENTS DETECTED IN MEASURING ZONE | 83.00 | 13.90 | 2.92 | 0.21 | 100.00 |
| | NUMBER RATIO OF ELEMENTS FROM ZINC STEARATE | 7.56 | 0.84 | — | 0.21 | 8.60 |
| | NUMBER RATIO OF ELEMENTS DERIVED FROM DRUM | 75.40 | 13.10 | 2.90 | 0.00 | 91.40 |
| SAMPLE 2 | NUMBER RATIO OF ELEMENTS DETECTED IN MEASURING ZONE | 87.80 | 9.25 | 0.59 | 2.40 | 100.00 |
| | NUMBER RATIO OF ELEMENTS FROM ZINC STEARATE | 86.40 | 9.60 | — | 2.40 | 98.40 |
| | NUMBER RATIO OF ELEMENTS DERIVED FROM DRUM | 1.40 | −0.40 | 2.90 | 0.00 | 4.00 |

FIG. 15

| X | DRUM SPEED V (mm/sec) | $V_{pp}$ (V) | f (Hz) | NUMBER RATIO OF Zn ELEMENTS (%) | DRUM CLOUDINESS (OBSERVED BY EYE) | DECREASE IN FILM THICKNESS (μm/100h) |
|---|---|---|---|---|---|---|
| 1544 | 125 | 2120 | 877.2 | 0.36 | NOT CLOUDY | 0.00 |
| 1544 | 125 | 2120 | 877.2 | 0.29 | NOT CLOUDY | 0.16 |
| 1544 | 125 | 2120 | 877.2 | 0.21 | CLOUDY | 0.52 |
| 1544 | 125 | 2120 | 877.2 | 0.00 | CLOUDY | 1.30 |
| 8027 | 185 | 3000 | 1350.0 | 0.00 | CLOUDY | 6.74 |
| 8027 | 185 | 3000 | 1350.0 | 0.24 | CLOUDY | 5.83 |
| 8027 | 185 | 3000 | 1350.0 | 0.60 | CLOUDY | 4.47 |
| 8027 | 185 | 3000 | 1350.0 | 1.19 | CLOUDY | 2.23 |
| 8027 | 185 | 3000 | 1350.0 | 1.25 | NOT CLOUDY | 2.01 |
| 8027 | 185 | 3000 | 1350.0 | 1.70 | NOT CLOUDY | 0.30 |
| 8027 | 185 | 3000 | 1350.0 | 1.87 | NOT CLOUDY | 0.00 |
| 8027 | 185 | 3000 | 1350.0 | 2.40 | NOT CLOUDY | 0.00 |

FIG. 20

| ENVIRONMENT | GAP (μm) | |
|---|---|---|
| | RUBBER ROLLER | HARD ROLLER |
| 30 [°C], 20[%] | 40 | 50 |
| 30 [°C], 80[%] | 10 OR BELOW | 50 |

FIG. 24
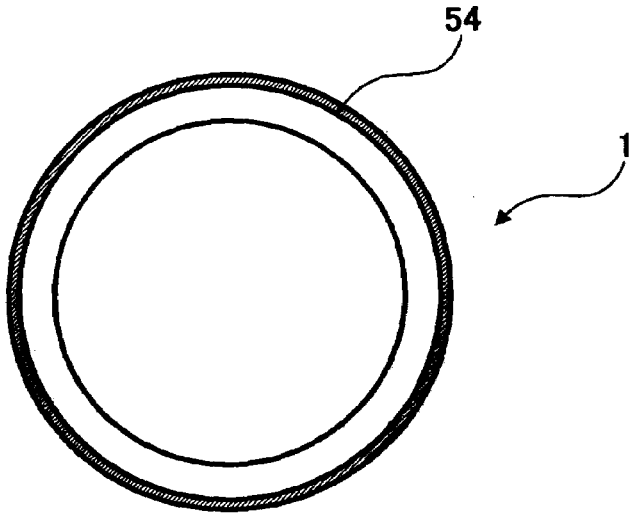
FIG. 25A
FIG. 25B
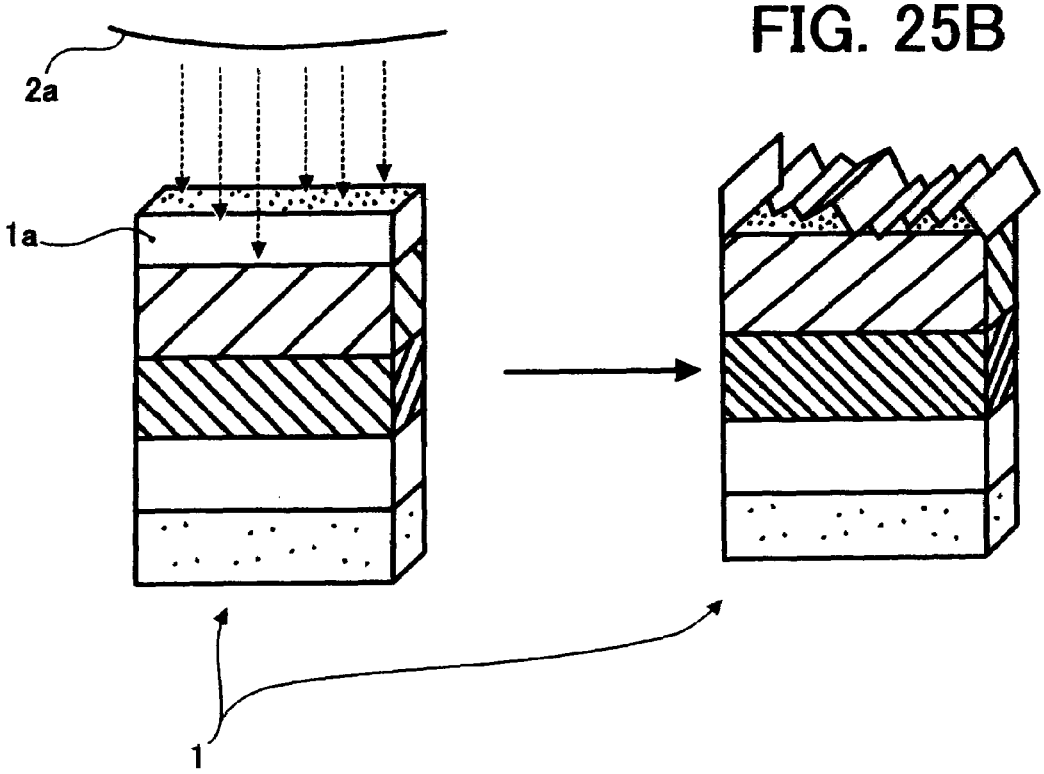

FIG. 27

| AMOUNT OF ZINC STEARATE (mg/mm$^2$) | DETERIORATION |
|---|---|
| 0.0002 | OCCURRED |
| 0.0004 | OCCURRED |
| 0.0008 | OCCURRED |
| 0.0012 | NOT OCCURRED |
| 0.0016 | NOT OCCURRED |

IMAGE FORMING APPARATUS USING A CONTACT OR A PROXIMITY TYPE OF CHARGING SYSTEM INCLUDING A PROTECTION SUBSTANCE ON A MOVEABLE BODY TO BE CHARGED

CROSS REFERENCE TO RELATED APPLICATIONS

This application is a divisional of and claims the benefit of priority from U.S. Ser. No. 11/431,716 filed May 11, 2006, now U.S. Pat. No. 7,251,438 which in turn is a divisional of and claims the benefit of priority from U.S. Ser. No. 10/769,855, filed on Feb. 3, 2004, now U.S. Pat. No. 7,103,301 and is based upon and claims the benefit of priority from the prior Japanese Patent Applications No. 2003-039538, filed on Feb. 18, 2003, No. 2003-098814, filed on Apr. 2, 2003, No. 2003-120873, filed on Apr. 25, 2003, No. 2003-179453, filed on Jun. 24, 2003, No. 2003-326781, filed on Sep. 18, 2003, No. 2003-433261, filed on Dec. 26, 2003, and No. 2003-434268, filed on Dec. 26, 2003, the entire contents of each of which are incorporated herein by reference.

DESCRIPTION OF THE BACKGROUND ART

1. Field of the Invention

The present invention relates to a copier, facsimile apparatus, printer or similar image forming apparatus and more particularly to a contact or a proximity type of charger and a cleaning device included in the image forming apparatus.

2. Description of the Background Art

Generally, an electrophotographic image forming apparatus includes various charging means, e.g., one for uniformly charging the surface of a photoconductive element or image carrier before the formation of a latent image, one for quenching the charged surface of the image carrier after image transfer, and one for charging a sheet or recording medium conveyed to an image transfer position. Such charging means have customarily been implemented by a corona discharge type of charging system. In this type of charging system, a charge wire is positioned in the vicinity of a body to be charged and applied with a high voltage, so that corona discharge occurs between the charge wire and the above body for thereby charging the body.

Corona discharge, however, produces ozone, NOx (nitrogen oxides) and other discharge products that are apt to form a nitric acid film or a nitrate film having adverse influence on an image on the surface of the image carrier. In light of this, a contact or a proximity type of charging system is extensively used today because it produces a minimum of discharge products and needs only a minimum of voltage.

In the contact or the proximity type of charging system, a roller, brush, blade or similar charging member contacts or adjoins a photoconductive element or similar body to be charged and applied with a voltage to thereby charge the surface of the above body. This type of charging system successfully reduces the size of the charger while having the advantages mentioned above.

However, a problem with the contact or the proximity type of charging system is that discharge occurs toward the body to be charged either directly or via a small gap, resulting in irregular discharge and therefore irregular charging. To solve this problem, Japanese Patent Laid-Open Publication No. 5-150564, for example, discloses a charging system configured to charge a body by applying an AC-biased DC voltage to a charging member. This system, using an AC-biased DC voltage, applies a voltage far higher than a breakdown voltage to the above body instantaneously and continuously, allowing discharge to easily occur. However, this system brings about another problem that the discharge chemically deteriorates the surface of the body charged. Such chemical deterioration, e.g., shaving of the film thickness of the photoconductive layer occurs even when mechanical rubbing is absent.

More specifically, the chemical deterioration of the surface of, e.g., the photoconductive element includes a decrease in molecular weight ascribable to the cut-off of the molecule chains of polycarbonate resin, which constitute the photoconductive layer, caused by ozone, active oxygen and charge particles hitting against the above surface, a decrease in the degree of entanglement of polymer chains, and evaporation of polycarbonate resin. Such chemical deterioration reduces the thickness of a charge transport layer (CTL) positioned on the surface of the photoconductive element little by little, causing inorganic fine grains contained in the CTL to separate and part. If the inorganic fine grains thus parted deposit on a cleaning member or similar member contacting the photoconductive element, then they constitute abrasive grains and therefore cause the surface of the element to locally wear, e.g., shaves off the surface in the form of stripes.

The deterioration of the surface of the photoconductive element ascribable to discharge is considered to be brought about by the energy of particles produced by discharge and is therefore considered to occur even when a material other than polycarbonate is used for the photoconductive element. Particularly, the AC-biased DC voltage generates discharge having greater energy than a DC voltage, aggravating the deterioration.

Further, when the shave-off of the photoconductive layer proceeds, it is more likely that the charge potential of the photoconductive element drops, the photoconductive element is deteriorated, background is contaminated due to, e.g., scratches formed on the surface of the element, image density decreases, and image quality is lowered. Protecting the surface of the photoconductive element is extremely important when consideration is given to an increasing demand for high image quality.

It is a common practice to protect the surface of the photoconductive element from deterioration by, e.g., coating the above surface with amorphous silicone carbide to thereby enhance wear resistance or by dispersing alumina or similar inorganic substance in the CTL of an organic photoconductive layer for the same purpose, as taught in, e.g., Japanese Patent Laid-Open Publication Nos. 2002-207308 and 2002-229227. Such schemes, however, are not always successful to obviate the chemical deterioration ascribable to proximity type of charging although they may improve wear resistance. This is because a decrease in the film thickness of the photoconductive element has heretofore been attributed to mechanical wear ascribable to a contact member, but not to discharge to occur in the event of charging.

On the other hand, Japanese Patent Laid-Open Publication Nos. 2002-55580, 2002-244487, 2002-244516 and 2002-156877 each propose an image forming apparatus including means for coating zinc stearate on the surface of a photoconductive element. However, the means taught in these documents are configured to reduce the coefficient of friction of the surface in order to obviate toner filming, toner melting and defective cleaning. The above documents therefore do not address to the protection of the surface of a photoconductive element from deterioration ascribable to discharge. Moreover, zinc stearate, simply coated to reduce the coefficient of friction, cannot always obviate deterioration ascribable to discharge.

More specifically, the schemes taught in Laid-Open Publication Nos. 2002-55580 and 2002-244487 mentioned above are likely to fail to protect, in the contact or the proximity type of charging system, the surface of the photoconductive element from chemical deterioration conspicuous with discharge caused by an AC voltage (AC discharge hereinafter). This is because the condition in which zinc stearate should exit for obviating the chemical deterioration and the condition in which it should exist for reducing the coefficient of friction are different from each other. Laid-Open Publication Nos. 2002-244516 and 2002-156877 do not show or describe means for coping with the chemical deterioration at all, not to speak of an adequate condition in which a protection substance should exist in a discharge zone.

In an image forming apparatus, a charge voltage or similar charging condition is sometimes varied in accordance with temperature, humidity or similar environmental condition for thereby implementing optimum image forming operation. More specifically, the rate at which the chemical deterioration of the photoconductive element proceeds is presumably dependent on the charging condition. It follows that if a condition of presence of the protection substance on a body to be charged capable of adequately obviating the chemical deterioration can be found, it is possible to further enhance the durability of the above body.

SUMMARY OF THE INVENTION

It is therefore an object of the present invention to provide a small-size image forming apparatus using a contact or a proximity type of charging system and capable of protecting the surface of a body to be charged from chemical deterioration, a charger and a cleaning device for use in the image forming apparatus, and a process cartridge.

An image forming apparatus of the present invention includes a movable body to be charged and a charger including a charging member configured to contact or adjoin the body to be charged for applying a voltage, including an AC component, to the charging member for thereby charging the body. A protection substance for protecting the surface of the body from deterioration ascribable to charging is caused to exist on the body. The ratio (%) of the number of particular elements, contained in the protection substance and detected by an X-ray photon spectral analyzer (XPS) in a zone where the charging member charges the body, to the total number of all elements constituting the outermost surface of the body and detected by the XPS is expressed as:

$$1.52\times10^{-4}\times\{Vpp-2\times Vth\}\times f/v\times N_{\alpha}$$

where Vpp denotes the peak-to-peak voltage (V) of an AC voltage, f denotes the frequency (Hz) of the AC component applied to the charging member, v denotes the moving speed (mm/sec) of the surface of the body, $N_{\alpha}$ denotes the number of, among elements constituting the protection substance, the particular elements in a single molecule, and Vth denotes a discharge start voltage produced by:

$$Vth=312+6.2\times(d/\epsilon_{opc}+Gp/\epsilon_{air})+\sqrt{(77.37.6\times d/\epsilon_{opc})}$$

where d denotes the film thickness (μm) of the body, $\epsilon_{opc}$ denotes the specific dielectric constant of the body, $\epsilon_{air}$ denotes the specific dielectric constant of a space between the body and the charging member, and Gp denotes the smallest distance (μm) between the surface of the charging member and the surface of the body.

BRIEF DESCRIPTION OF THE DRAWINGS

The above and other objects, features and advantages of the present invention will become more apparent from the following detailed description taken with the accompanying drawings in which:

FIG. 5 is a graph showing a relation between the amount of zinc stearate and the deterioration of the surface of the photoconductive element;

FIGS. 13 and 14 each show ratios of the numbers of elements determined with different samples by an X-ray photon spectral analyzer (XPS);

FIG. 15 is a table listing different surface conditions of the photoconductive element and the ratios of the numbers of Zn (zinc stearate) elements detected by the XPS;

FIG. 20 is a table comparing a rubber roller and a hard roller as to a relation between the environment and the gap;

FIG. 24 is a section showing a photoconductive element included in a third embodiment of the present invention;

FIGS. 25A and 25B show how the surface of the photoconductive element is deteriorated by proximity discharge;

FIG. 27 is a table showing a relation between the amount of zinc stearate and the deterioration of the photoconductive element;

DESCRIPTION OF THE PREFERRED EMBODIMENTS

Preferred embodiments of the image forming apparatus in accordance with the present invention will be described hereinafter.

First Embodiment

First, why the illustrative embodiment can achieve the object of the present invention stated earlier will be described on the basis of the results of various experiments.

Experiment 1

Figures 1A, 1B:
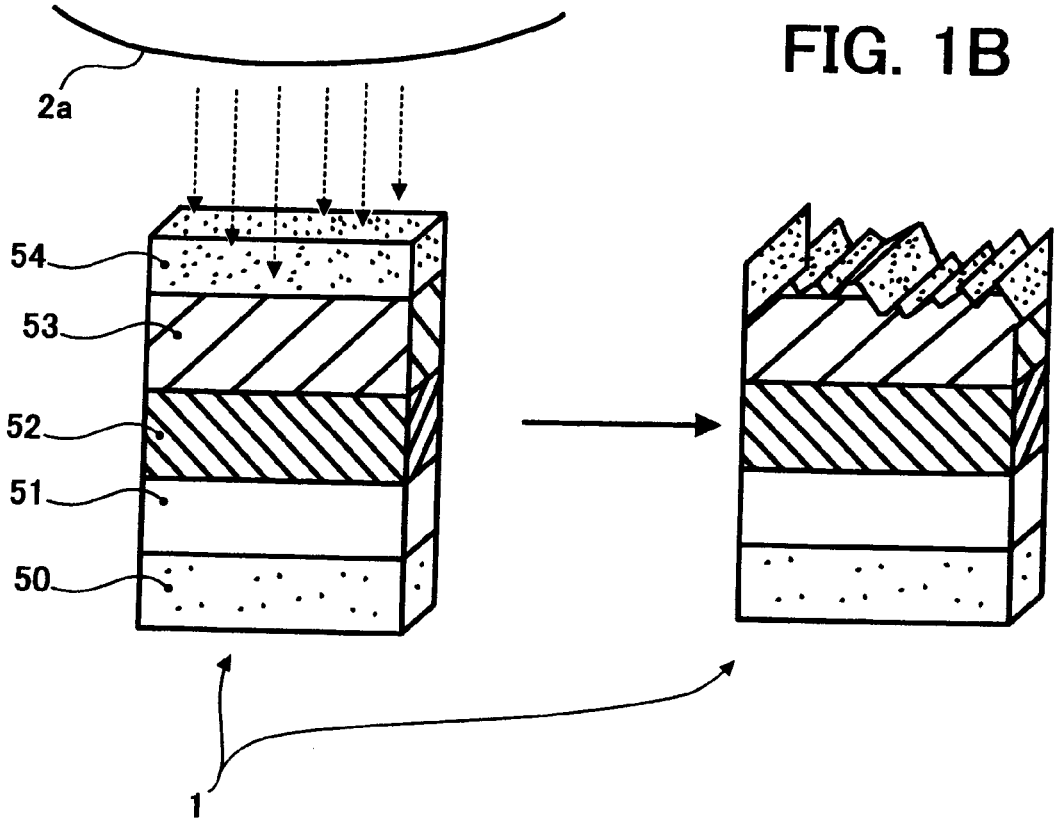
FIG. 1A is a section showing a photoconductive element used for an experiment conducted in relation to the present invention.
FIG. 1B is a section showing how the surface of the photoconductive element of FIG. 1A is deteriorated by discharge.

We conducted the following experiment in order to examine the deterioration of the surface of a photoconductive element or body to be charged that is conspicuous with a charging member contacting or adjoining the photoconductive element and applied with an AC bias. As shown in FIG. 1A, a charging member, implemented as a rotatable roller-like charging member (charge roller hereinafter), 2*a* was spaced from the surface of a photoconductive element 1 in order to exclude deterioration ascribable to mechanical wear and was applied with an AC-biased DC voltage. The charge roller 2*a* was caused to continuously charge the photoconductive element 1 for about 150 hours.

As shown in FIG. 1A, the photoconductive element 1 included a base layer 50 and an under layer or insulation layer 51 formed on the base layer 50. Further, a charge generating layer (CGL) 52, a CTL 53 and a surface protection layer (FR) 54 are sequentially stacked on the under layer 51 in this order.

Figure 2:
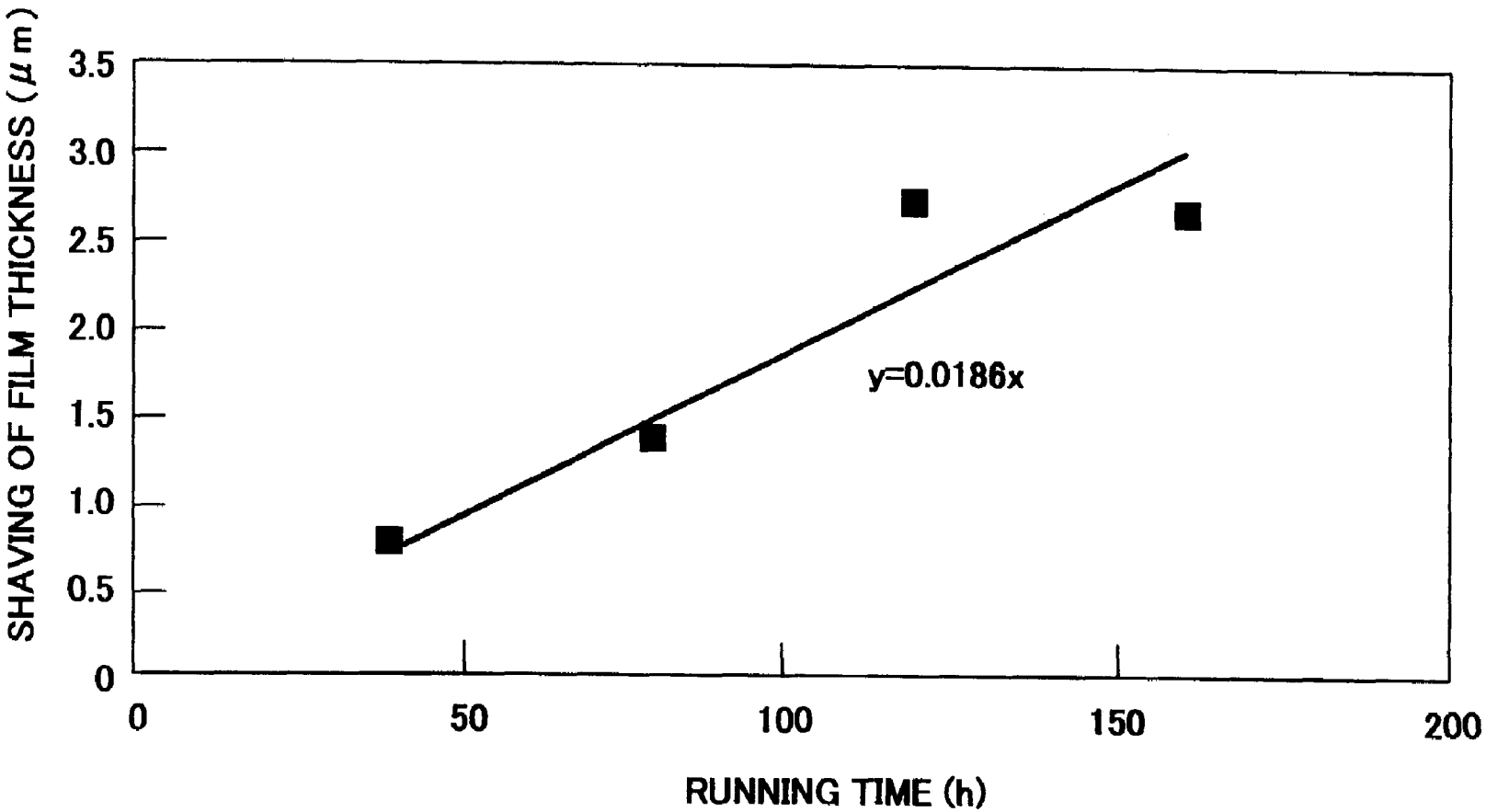
FIG. 2 is a graph showing experimental results relating to showing a relation between the duration of operation and the shaving of a film thickness.

FIG. 2 plots amounts by which the film thickness of the photoconductive element 1 was shaved with respect to charging time. As shown, the film thickness decreases with an increase in charging time. This is presumably because the surface of the photoconductive element 1 was chemically deteriorated after charging due to discharge caused by an AC voltage. FIG. 1B shows the resulting surface condition of the photoconductive element 1. While we are studying the details of the mechanism of the chemical deterioration conspicuous with this type of discharge effected by the charging member, which contacts or adjoins the photoconductive element 1, we found the following fact by analyzing the surface of the photoconductive element 1 after charging. The fact is that carboxylic acid, presumably a product derived from the decomposition of polycarbonate serving as a binder resin of the CTL 53 and protection layer 54, was detected.

Because a component included in the photoconductive element 1 is considered to have been decomposed, the mechanism of shaving of the film thickness may be accounted for, as will be described hereinafter.

When the energy of particles produced by the discharge of the contact or the proximity type of charging member, i.e., ozone, electrons, excited molecules, ions, plasma and so forth are radiated on the protection layer 54, the energy resonates the coupling energy of molecules constituting, e.g., the protection layer 54 and is absorbed thereby. As a result, there occurs chemical deterioration including a decrease in the degree of entangling of high polymer chains, which form the outermost layer, a decrease in molecular weight ascribable to the cut-off of resin molecule chains and evaporation of resin and decomposition products. Such chemical deterioration presumably causes the outermost layer to be shaved off little by little.

The shaving of the film thickness is presumably ascribable to the energy of particles produced by the discharge of the contact or the proximity type of charging member. It follows that presumably the problem stated above is not particular to polycarbonate constituting the protection layer 54 and CTL 53, but is also true when the photoconductive element 1 is formed of another material.

Experiment 2

Figure 3A:
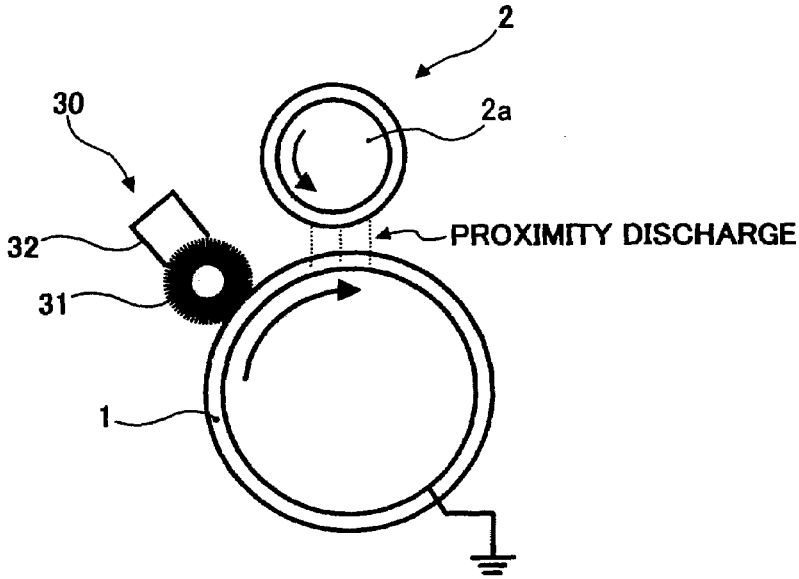
FIG. 3A shows a specific arrangement used to confirm the effect of the present invention.

Hereinafter will be described an experiment showing that the chemical deterioration of the surface, which is conspicuous with AC discharge, can be reduced if a protection substance is present on the above surface. FIG. 3A shows an arrangement used to determine that a protection substance 32 present on the photoconductive element 1 reduced the chemical deterioration.

Figure 3B:
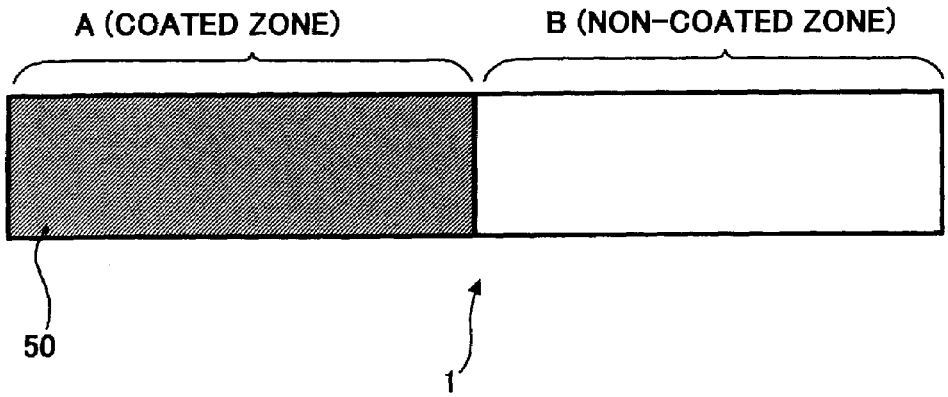
FIG. 3B shows the surface of the photoconductive element divided into a zone covered with a protection layer and a zone not covered with the protection layer.

As shown in FIG. 3B, for comparison, the protection substance 32 was coated in a zone A on the surface of the photoconductive element 1, which was the left half of the element 1 in the axial direction, but not coated in a zone B which was the right half of the element 1. More specifically, a coating device 30 was configured to coat the protection substance 32 on the zone A or left half of the surface of the photoconductive element 1 with a fur brush 31. The protection substance 32 was implemented by zinc stearate.

To exclude the deterioration of the surface ascribable to mechanical wear, all members other than the charge roller 2*a* and coating device 30 were removed beforehand. The charger 2 and coating device 30 were continuously operated together with the photoconductive element 1 in order to examine the surface deterioration of the element 1. The experiment was conducted under the following conditions:

Charging Conditions:

Vpp (AC peak-to-peak voltage)=2.21 kV f(AC frequency)=877.2 Hz

Figure 4:
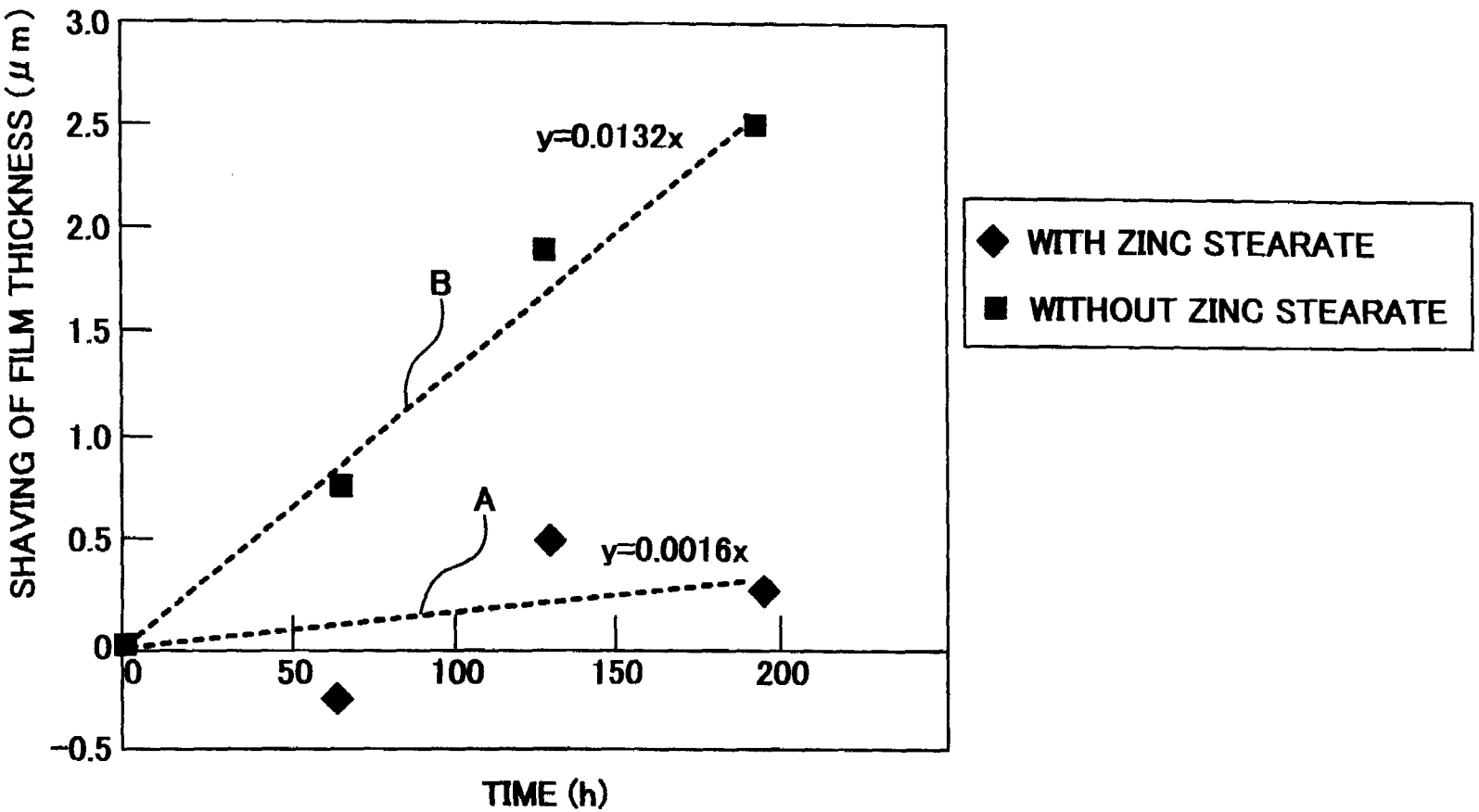
FIG. 4 is a graph showing a relation between the duration of charging and the shaving of the surface of the photoconductive element.

DC=−660 V surface speed v of element 1=125 mm/sec linear velocity of fur brush=216 mm/sec Protection Substance: zinc stearate FIG. 4 plots amounts by which the film thickness of the photoconductive element 1 was shaved with respect to time. As shown, the amount of shaving increases with an increase in charging time.

By comparing the film thickness of the photoconductive element 1 after 200 hours of continuous operation and the film thickness before the operation, we found that the film thickness decreased to 2.5 μm in the zone B, but decreased to only ⅛ of the zone B or less in the zone A.

Further, by observing the surface of the photoconductive element 1 after the 200 hours of operation by eye, it was found that the surface changed in color to white, i.e., became cloudy and changed in quality in the zone B, but remained the same as the polished surface of a fresh photoconductive element in the zone A.

The above experimental results prove that the protection substance coated on the surface of the photoconductive element 1 successfully reduce the chemical deterioration of the above surface, which is conspicuous with AC discharge.

Experiment 3

An experiment showing that conditions for reducing the chemical deterioration stated above differ from conditions for reducing the coefficient of friction of the surface of the photoconductive element 1, as proposed in Laid-Open Publication Nos. 2002-55580 and 2002-244487 mentioned earlier, will be described hereinafter. This experiment is basically identical with Experiment 2 except that the protection substance 32 is coated on the entire surface of the photoconductive element, i.e., both the zones A and B in a particular amount, which will be described hereinafter. Zinc stearate, constituting the protection substance 32, was coated on the surfaces of different samples in an amount of 0.0002 mg/mm$^2$ and an amount of 0.0016 mg/mm$^2$, respectively, so as to compare them as to the chemical deterioration.

FIG. 5 shows the results of Experiment 3. As shown, when the amount of zinc stearate was 0.0002 mg/mm$^2$, the surface of the photoconductive element 1 was shaved and deteriorated thereby. By contrast, when the amount of zinc stearate was 0.0016 mg/mm$^2$, the surface was not shaved and was free from deterioration. This indicates that the amount of 0.0002 mg/mm$^2$ is too small to reduce the chemical deterioration.

Figure 6:
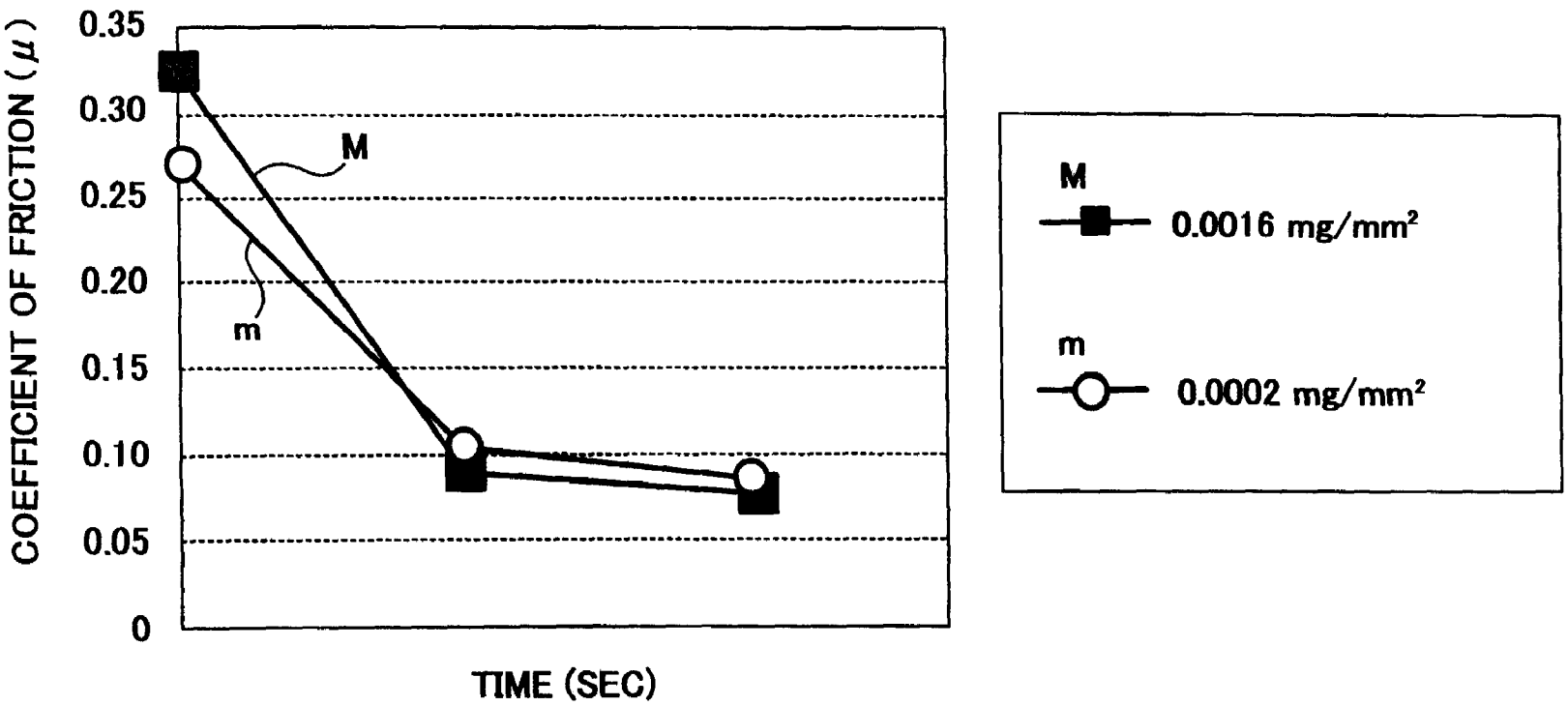
FIG. 6 is a graph plotting the coefficient of friction of the surface of the photoconductive element with respect to time and determined with two different amounts of zinc stearate.

The coefficients of friction of the surfaces of the two samples stated above were measured. FIG. 6 plots the coefficients of friction determined with the two samples with respect to a period of time elapsed after coating, as measured by an Euler's belt method. As FIG. 6 indicates, although the coefficients of friction of the two samples differ from each other just after the coating of the protection substance 32, but become close to each other as the time elapses. More specifically, the coefficients of friction were measured to be about 0.1 in a certain period of time.

As FIGS. 5 and 6 indicate, when zinc stearate is used as a lubricant for reducing the coefficient of friction of the photoconductive element, the amount of zinc stearate is sufficient if 0.0002 mg/mm$^2$, but should be larger than 0.0016 mg/mm$^2$ in order to protect the photoconductive element 1 from the chemical deterioration. It will therefore be seen that the conditions for protecting the surface from the chemical deterioration differ from the conditions for reducing the coefficient of friction and cannot be derived from conventional technologies. We found that the condition in which zinc stearate should be present for reducing the coefficient of friction and the condition in which it should be present for obviating the chemical deterioration were different from each other.

Experiment 4

Hereinafter will be described an experiment showing that the amount of shaving is proportional to the peak-to-peak voltage Vpp of the AC voltage, i.e., the amplitude of the AC component applied to the charge roller 2*a*. For the experiment, the arrangement of the photoconductive element 1, charger 2 and coating device 30 shown in FIG. 3A was used. To obviate the deterioration of the surface ascribable to mechanical wear, all members other than the charge roller 2 and coating device 30 were removed. The surface of the photoconductive element 1 was continuously charged for 100 hours by discharge using an AC voltage whose Vpp was varied. The experiment was conducted under the following conditions:

Charging Conditions:

Vpp=2.2, 2.6 and 3.0 kV f=−600 V moving speed v=113 mm/sec

Protection Substance: zinc stearate

Charging Time: 100 hours

Figure 7:
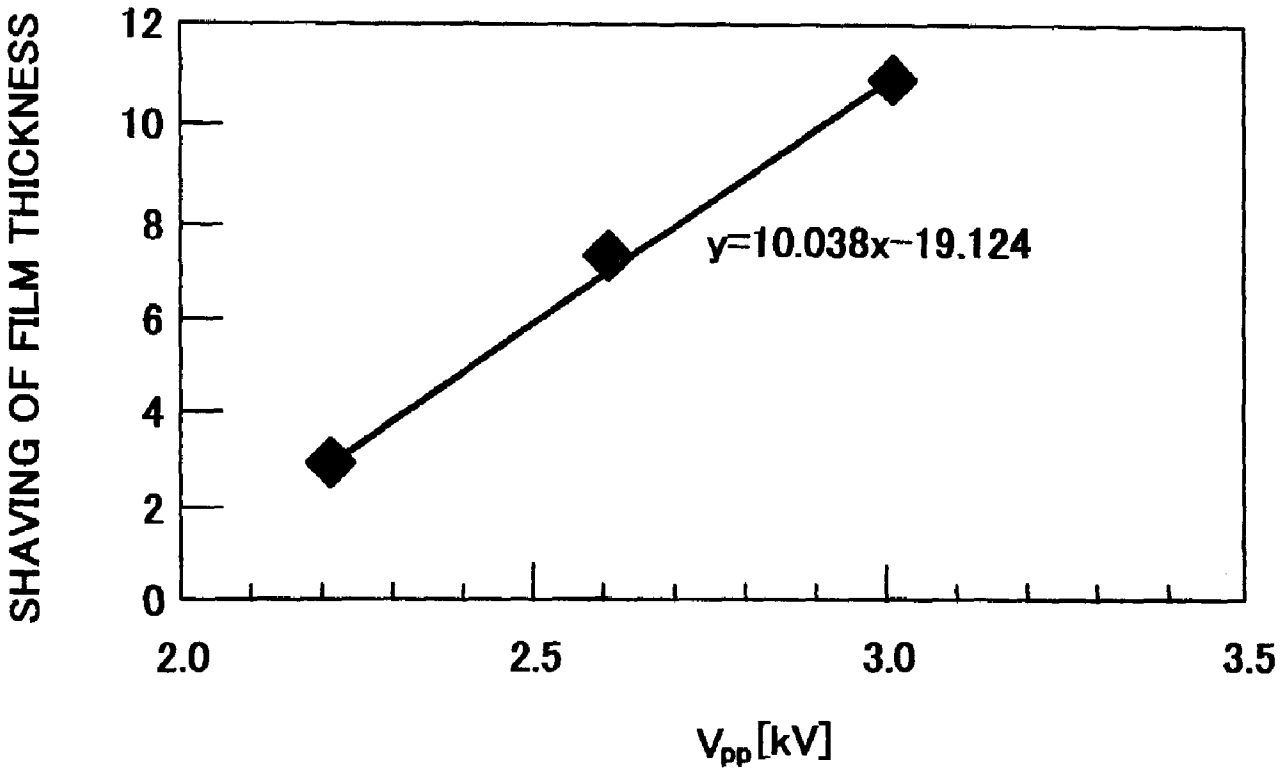
FIG. 7 is a graph plotting the shaving of the film thickness with respect to the peak-to-peak voltage Vpp of an AC voltage.

FIG. 7 plots the amounts of shaving determined after continuous 100 hours of discharge with respect to Vpp. As shown, the amount of shaving is proportional to Vpp and is zero when Vpp is about 1.9 kV. This is presumably accounted for by the following. Discharge does not occur between the surface of the charging member and that of the photoconductive element 1 unless the voltage applied to the charging member is higher than a preselected value, as known in the art. A series of studies showed that in the case of non-contact charging, discharge started when the shortest distance between the charging member and the charged member was Gp (μm) and when the voltage applied to the charging member exceeded a value represented by the following equation (1) (discharge start voltage Vth hereinafter):

$$Vth=312+6.2\times(d/\epsilon_{opc}+Gp/\epsilon_{air})+\sqrt{(7737.6\times d/\epsilon_{opc})} \quad (1)$$

where d denotes the film thickness (μm) of the photoconductive element 1, $\epsilon_{opc}$ denotes the specific dielectric constant of the element 1, and $\epsilon_{air}$ denotes a specific dielectric constant in the space between the element 1 and the charging member.

When Vpp is two times or more higher than Vth, bidirectional discharge occurs between the charge roller 1 and the photoconductive element 1. In the illustrative embodiment, the gap between the charge roller 2*a* and the photoconductive element 1 is 50 μm, the specific dielectric constant of the photoconductive element 1 is about 3, the film thickness of the photoconductive element 1 is 30 μm, and the specific dielectric constant in the space between the photoconductive element 1 and the charge roller 2*a* is about 1, as stated earlier. In these conditions, Vth is 962 V. Presumably, when the voltage applied to the charge roller 2*a* becomes higher than 962 V inclusive, discharge is considered to start between the charge roller 2*a* and the photoconductive element 1. Also, when Vpp exceeds about 1924 V, discharge is considered to start due to the AC voltage. The bidirectional discharge caused by the AC voltage is predominant as a discharge phenomenon, so that the shaving of the photoconductive element presumably starts when Vpp exceeds about 1.9 kV Experiment 5

An experiment showing that the shaving of the surface of the photoconductive element 1, conspicuous with AC discharge, is proportional to the frequency f of the AC voltage will be described hereinafter. Experiment 5 is identical with Experiment 4 as to the basic configuration and experimental conditions except for the charging conditions and moving speed. More specifically, while Experiment 4 varies Vpp while fixing the frequency f of the AC voltage, Experiment 5 varies the frequency f while fixing Vpp.

Experimental conditions are as follows.

Charging Conditions:

Vpp=2.2 kV f=500, 900, 1,400, 2,000 and 4,000 Hz

DC voltage=−600 V moving speed=104 mm/sec

Protection Substance: zinc stearate

Charging Time: 100 hours

Figure 8:
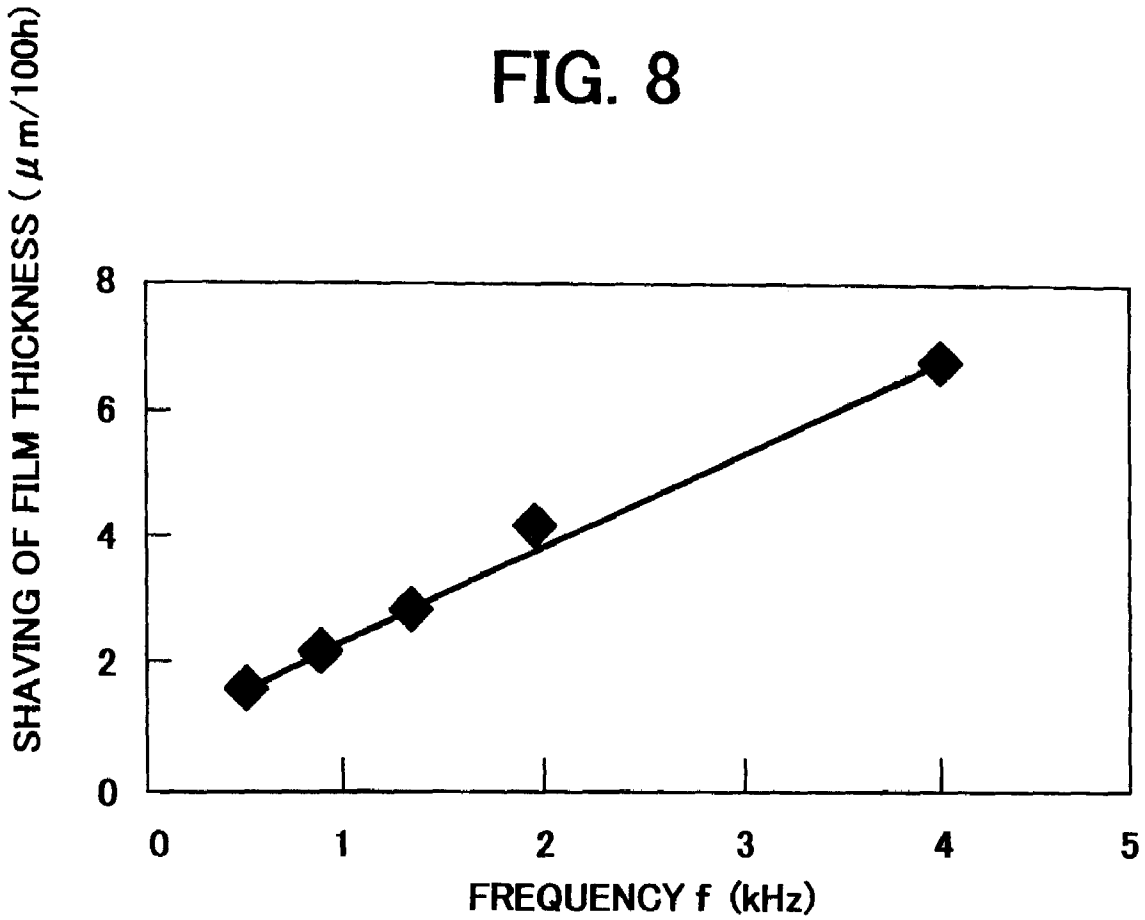
FIG. 8 is a graph plotting the shaving of the film thickness with respect to the frequency f of the AC voltage.

FIG. 8 plots the amounts of shaving of the surface after 100 hours of charging effected by the above discharge with respect to the frequency f. As shown, the amount of saving is proportional to the frequency f.

The results of Experiments 4 and 5 indicate that the film thickness of the photoconductive element 1 is dependent on the charging conditions, i.e., Vpp and f.

In light of the above, we presumed that the film thickness of the photoconductive element 1 decreases (i) in proportion to Vpp−2×Vth, (ii) in proportion to the frequency f of the AC voltage, and (iii) in inverse proportion to the moving speed v of the surface of the element 1. Why the relation (iii) was assumed is that when the moving speed of the photoconductive element 1 was low, radiation energy for a unit area increased for given charging conditions. We confirmed reasonability of such presumption with the results of Experiment 6, which will be described later, and found the following relating to the amount of the protection substance that should be coated on the photoconductive element 1 for obviating the chemical deterioration stated earlier.

When the ratio (%) of total number of particular one of elements of the protection substance, as detected by the XPS to the total number of all elements constituting the outermost surface of the photoconductive element 1, as also detected by the XPS, is selected as represented by the following expression (2), the change in the quality of the surface of the element 1 ascribable to the contact or the proximity type of charge roller 2*a* can be obviated:

$$1.52\times10^{-4}\times\{Vpp-2\times Vth\}\times f/v\times N_{\alpha} \quad (2)$$

where $N_{\alpha}$ denotes the number of the particular elements in a single molecule.

Further, if the ratio stated above is larger than a value represented by the following expression (3) inclusive, there can be obviated the shaving of the film thickness:

$$2.22\times10^{-4}\times\{Vpp-2\times Vth\}\times f/v\times N_{\alpha} \quad (3)$$

An image forming apparatus to which the illustrative embodiment is applied will be described with reference to FIG. 9. As shown, the image forming apparatus includes the photoconductive element or image carrier 1, implemented as a drum, a charger 2, an exposing device 3 for writing a latent image on the drum 1, a developing device 4, and a cleaning device 7 for cleaning the surface of the drum 1.

When the drum 1 is rotated by a drive source, not shown, the proximity type charger 2 uniformly charges the surface of the drum 1 with the charge roller 2*a*. Subsequently, the exposing device 3 forms a latent image in the charged area or image forming area of the drum 1 in accordance with image data fed from the outside. The developing device 4 develops the latent image with a developer or toner to thereby produce a corresponding toner image.

While the formation of the toner image on the drum 1 is under way, a sheet or recording medium 1 is fed from a sheet feeding section, not shown, toward the drum 1. The sheet is conveyed toward an image transferring device 5, which faces the drum 1, at such timing that the leading edge of the sheet meets the leading edge of the toner image. As a result, the toner image is transferred from the drum 1 to the sheet at an image transfer nip T1. The sheet is then mechanically separated from the drum 1 and then conveyed to a fixing device 6 along a path 10. The fixing device 6 fixes the toner image on the sheet.

The toner left on the surface of the drum 1 moved away from the image transfer nip T1 is removed and collected by a cleaning blade 8 included in the cleaning device 7. Thereafter, charges left on the surface of the drum 1 are removed by a quenching device 9.

Means for obviating deterioration ascribable to discharge and unique to the illustrative embodiment will be described hereinafter. As shown in FIG. 9, the coating device 30 plays the role of feeding means for feeding the protection substance 32 to the surface of the drum 1. The coating device 30 faces the drum 1 at a position downstream of the cleaning device 7 in the direction of rotation of the drum 1, but upstream of the charger 2 in the above direction. The coating device 30 includes the fur brush or coating member 31, the protection substance 32, and a spring 33 constantly biasing the protection substance 32 toward the fur brush 31. The protection substance 32 is a solid molding implemented as a bar.

When the fur brush 31, contacting the drum 1, is rotated about its axis, it scoops up shaves off the protection substance 32 and then conveys the protection substance 32 to the position where the fur brush 31 contacts the drum 1 to thereby coat it on the drum 1. The protection substance 32, constantly biased by the spring 33, can be uniformly fed to the fur brush 31 in a small amount even when shaved off by the fur brush 31.

The deterioration obviating means stated above may be replaced with any other suitable means so long as it can deposit the protection substance 32 on the drum 1 in an adequate condition. For example, the protection substance 32 may be contained in or coated on the toner so as to be transferred to the drum 1. In such a case, however, the amount of the protection substance 32 present on the drum 1 is apt to be irregular in dependence on image density or image pattern and should therefore be coated more than necessary. The illustrative embodiment, coating the protection substance 32 on the drum 1, allows the protection substance 32 to be coated on the drum 1 in a constant amount in a stable distribution.

The charger 2 of the illustrative embodiment will be described more specifically hereinafter. The charger 2 charges the drum 1 with the charge roller 2*a* adjoining, but not contacting, the drum 1 and applied with an AC voltage. While the charge roller 2*a* may be held in contact with the drum 1, it is preferable, in such an arrangement, to use a rubber member or similar elastic member that improves contact between the drum 1 and the charge roller 2*a* and does not exert mechanical stress on the drum 1. However, the elastic member is apt to increase the nip width for charging and thereby cause the protection substance 32 to easily deposit on the charge roller 2*a*. Therefore, non-contact charging is advantageous over contact charging in the aspect of durability of the charge roller 1.

Figure 10:
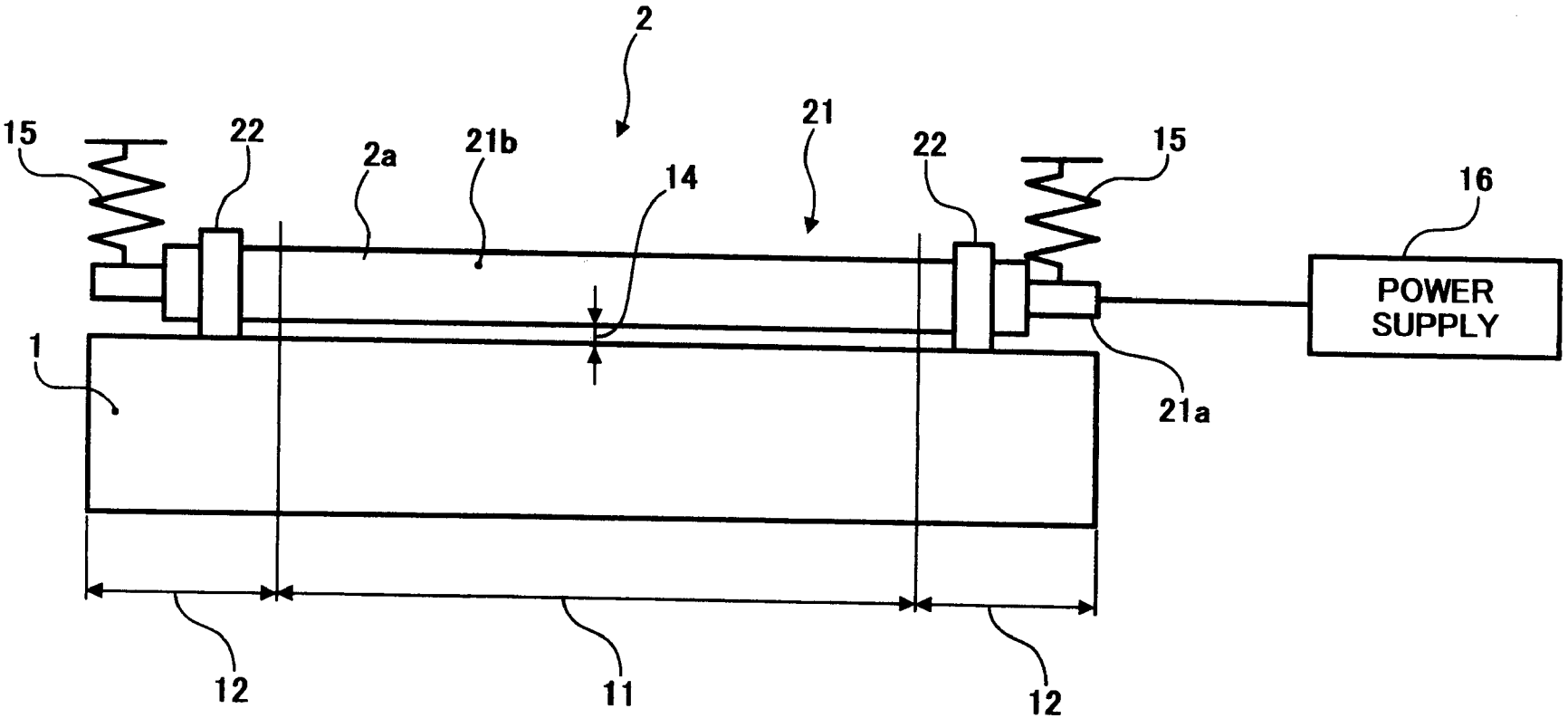
FIG. 10 shows a charger included in the first embodiment.

FIG. 10 shows the configuration of the charger 2 and drum 1. As shown, the charger 2 includes spacers 22, springs 15 and a power supply 16 in addition to the charge roller or charging member 2*a*. The charge roller 2*a* is made up of a shaft portion 21*a* and a roller portion of charging portion 21*b* rotatable in accordance with the rotation of the shaft portion 21*a*. The roller portion 21*b* faces and charges the surface of the drum 1. The spacers or space forming members 22 form a small gap 14 between the roller portion 21*b* of the charge roller 2*a* and the drum 1, so that part of the roller portion 21*b* facing the image forming range 11 of the drum 1 is spaced from the drum 1.

More specifically, the roller portion 21*b* has a lengthwise dimension greater than the image forming range 11 of the drum 1. The spacers 22 contact the non-image forming ranges 12 of the drum 1 to thereby form the small gap 14. The charge roller 2*a* is rotated by the drum 1 via the spacers 22. The small gap 14 is selected such that the shortest distance between the roller portion 21*b* and the drum 1 is between 1 μm and 100 μm, preferably between 30 μm and 65 μm. The shortest distance is selected to be 50 μm in the illustrative embodiment.

The springs 15 constantly bias the charge roller 2*a* toward the drum 1 to thereby maintain the small gap 14 accurate at all times.

The charge roller 2*a*, connected to the power supply 16, uniformly charges the surface of the drum 1 by AC-based discharge in the small gap 14. In the illustrative embodiment, an alternating voltage with AC superposed on DC is applied to the charging portion 21*b* of the charge roller 2*a* in order to insure uniform charging free from the influence of, e.g., irregularity in charge potential ascribable to the variation of the gap 14.

The charge roller 2*a* is made up of a cylindrical metallic core or conductive support and a resistance control layer formed on the core. In the illustrative embodiment, the charge roller 2*a* is provided with a diameter of 10 mm.

While the surface of the charge roller 2*a* may be formed of rubber or similar conventional material, it should preferably be formed of resin because rubber absorbs moisture and deforms and therefore makes it difficult to maintain the small gap 14 constant. Only the intermediate portion of the charge roller 2*a* is likely to accidentally contact the drum 1, depending on image forming conditions. It is difficult to cope with disturbance to the surface layer of the drum 1 ascribable to such local, accidental contact of the charge roller 2*a* with the drum 1. Therefore, when the non-contact type of charging system is used for charging the drum 1, it is preferable to use a hard material capable of maintaining the gap 14 uniform.

For the hard surface of the charge roller 2*a*, the resistance control layer may be formed of polyethylene, polypropylene, polystyrene, a copolymer thereof or similar thermoplastic resin composition containing a polymeric ion-conductive agent and may have its surface hardened by a hardener. To harden the surface of the resistance control layer, the resistance control layer may be immersed in, e.g., a processing solution containing an isocyanate-containing compound. Alternatively, a hardened layer may be formed on the resistance control layer.

Figure 11:
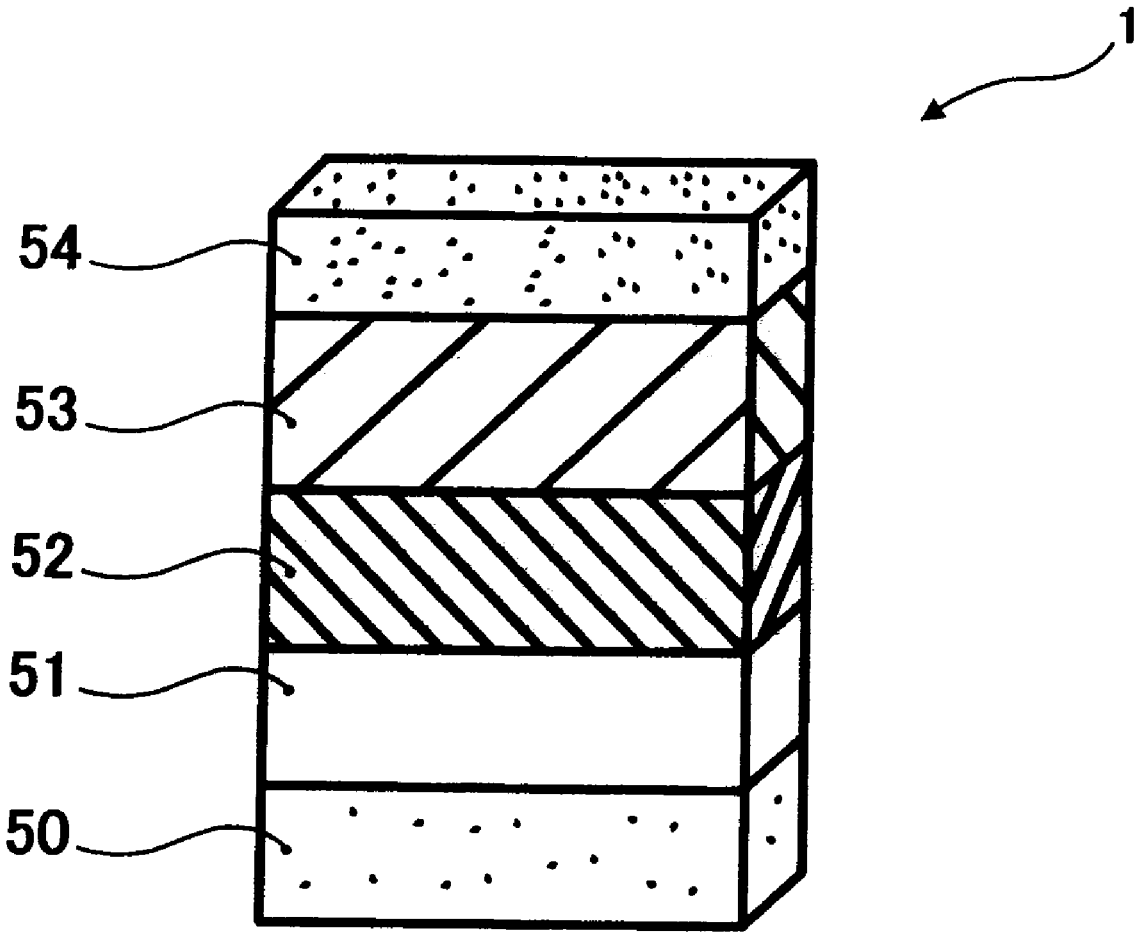
FIG. 11 is a section showing a photoconductive element also included in the first embodiment.

In the illustrative embodiment, the drum 1 is formed of an organic photoconductor chargeable to negative polarity and made up of a conductive support having a diameter of 30 mm and a photoconductor layer formed thereon as well as other layers. More specifically, as shown in FIG. 11, an under layer or insulation layer 51 is formed on a conductive support or base layer 50. A CGL 52 and a CTL 53, constituting a photoconductive layer, are stacked on the under layer 51. Further, an FR layer 54 is formed on the charge transport layer 53.

The conductive support 50 may be formed of any suitable conductive material having volume resistivity of $10^{10}$ Ω·cm or below. For example, those which are obtained by coating metal such as aluminum, nickel, chromium, nichrome, copper, gold, silver or platinum and a metallic oxide such as tin oxide or indium oxide, on film-like or cylindrical plastic or paper by evaporation or sputtering, or a plate of aluminum, an aluminum alloy, nickel or stainless steel, and pipes formed by extrusion or drawing of those materials, followed by cutting, superfinishing and polishing, can be used. The endless nickel belt and endless stainless steel belt disclosed in Japanese Patent Laid-Open Publication No. 52-36016 can also be used as the conductive support body.

Further, those which are obtained by coating conductive powder dispersed in a proper binding resin on the support body may also be used as the conductive support body. The conductive powder includes carbon black, acetylene black, metallic powder of aluminum, nickel, iron, nichrome, copper, zinc or silver, or powder of metallic oxides of conductive tin oxide or ITO. The binding resin used at the same time, includes thermoplastic, thermosetting, or photo-setting resin, such as, polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinylbutyral, polyvinylformal, polyvinyl toluene, poly-N-vinylcarbazole, acryl resin, silicone resin, epoxy resin, melamine resin, urethane resin, phenol resin, or alkyd resin. Such conductive layers can be provided by dispersing these conductive powders and binding resins in a proper solvent, for example, tetrahydrofuran, dichloromethane, methyl ethyl ketone or toluene, and coating them.

Moreover, those which are obtained by forming a conductive layer on a proper cylindrical base by a heat shrinking tube formed by including the conductive powder into materials such as, polyvinyl chloride, polypropylene, polyester, polystyrene, polyvinylidene chloride, polyethylene, chlorinated rubber, or Teflon (trade name), can be satisfactorily used as the conductive support of the present invention.

Next, the photoconductive layer will be explained. Either one of a single layer and a laminated layer is applicable. First, the laminated layer constitution comprising a charge generation layer and a charge transport layer is explained for the explanation convenience.

The charge generation layer 52 has a charge generation substance as a principal component. Known charge generation substances can be used for the charge generation layer. Representative substances are: monoazo pigment, diazo pigment, triazo pigment, perylene-based pigment, perinone-based pigment, quinacridone-based pigment, quinone-based condensed polycyclic compound, squaric acid-based dye, phthalocyanine-based pigment, naphthalocyanine-based pigment, and azulenium salt-based dye, which are usefully used. These charge generation substances can be used in a single form, or in a mixed form of two or more kinds.

The charge generation layer is formed by dispersing the charge generation substance, together with a binding resin when necessary, into a proper solvent, using a ball mill, an atriter, a sand mill or supersonic wave, and coating it on the conductive support body or undercoat layer, followed by drying.

The above-mentioned charge generation substances can be dispersed in the binding resin of the charge generation layer, when necessary. Following substances can be used for the binding resins: polyamide, polyurethane, epoxy resin, polyketone, polycarbonate, silicone resin, acryl resi, polyvinylbutyral, polyvinylformal, polyvinyl ketone, polystyrene, polysulfon, poly-N-vinyl carbazole, polyacrylamide, polyvinyl benzal, polyester, phenoxy resin, vinyl chloride-vinyl acetate copolymer, polyvinyl acetate, polyphenylene oxide, polyamide, polyvinyl pyridine, cellulose-based resin, casein, polyvinyl alcohol, and polyvinyl pyrrolidone. The proper amount of the binding resin is 0-500 pts.wt., preferably 10-300 pts.wt. for 100 pts.wt. of the charge generation substance. The binding resin may be added before or after dispersion.

The solvent used here includes: isopropanol, acetone, methyl ethyl ketone, cyclohexanone, tetrahydrofuran, dioxane, ethyl cellusolve, ethyl acetate, methyl acetate, dichloromethane, dichloroethane, monochlorobenzene, cyclohexane, toluene, xylene, and ligroin. In particular, ketone-based solvent, ester-based solvent and ether-based solvent are satisfactorily used. These can be used in a single form, or in a mixed form of two or more kinds.

The charge generation layer contains the charge generating substance, solvent and binding resin as the principal components. Any additive such as a sensitizer, disperser, surfactant, or silicone oil may be contained in the charge generation layer.

Dipping coating, spray coating, bead coating, nozzle coating, spinner coating, and ring coating can be used for coating the coating liquid. The proper film thickness of the charge generation layer is 0.01-5 μm, preferably 0.1-2 μm.

The charge transport layer 53 is formed by dissolving or dispersing the charge transport substance and binding resin into a proper solvent, coating it on the charge generation layer and drying it. A single or two or more kinds of plasticizer, leveling agent, or antioxidant can be added, when necessary.

For the charge transport substance, the hole transport substance and electron transport substance can be used.

The electron transport substance includes electron receiving substances, such as: chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxantone, 2,4,8-trinitro-thioxantone, 2,6,8-trinitro-4H-indeno[1,2-b]thiophene-4-one, 1,3,7-trinitrodibenzothiophene-5,5-dioxide, or benzoquinone derivatives.

The hole transport substance includes: poly-N-vinylcarbazole and its derivatives, poly-γ-carbazolyl ethyl glutamate and its derivatives, pyrene-formaldehyde condensate and its derivatives, polyvinyl pyrene, polyvinylphenanthrene, polysilane, oxazole derivatives, oxadiazole derivatives, imidazole derivatives, monoarylamine derivatives, diarylamine derivatives, triarylamine derivatives, stilbene derivatives, ophenylstilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives, and other known materials. These charge transport substances are used in a single form or in a mixed form of two or more kinds.

The binding resin includes thermoplastic or thermosetting resins, such as, polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinylbutyral, polyvinylformal, polyvinyl toluene, poly-N-vinyl carbazole, acryl resin, silicone resin, epoxy resin, melamine resin, urethane resin, phenol resin, and alkyd resin.

The amount of the charge transport substance is suitably 20-300 pts.wt., preferably 40-150 pts.wt. to 100 pts.wt. of the binding resin.

The film thickness of the charge transport layer is preferably 25 μm or below considering the solubility and responsiveness. The lower limit depends on the system to be used, particularly on the charged potential, and is preferably 5 μm or above.

Tetrahydrofuran, dioxane, toluene, dichloromethane, monochloro-benzene, dichloroethane, cyclohexanone, methyl ethyl ketone, or acetone are used for the solvent used here. These can be used in a single form or in a mixed form of two or more kinds.

Next, the photoconductive layer in the case of a single layer constitution is explained. The photoconductive layer is formed by dissolving or dispersing the above-mentioned charge generation substance, charge transport substance or binding resin in a proper solvent, coating it on the conductive support 50 or on the under layer 51, followed by drying. The photoconductive layer may be composed of the charge generation substance and the binding resin without including the charge transport substance. A plasticizer, a leveling agent or an antioxidant can be added, when necessary.

The binding resins listed in the charge transport layer may be mixed for use as the binding resin, besides the binding resin listed in the charge generation layer. Of course, the high polymer charge transport substance listed before can be satisfactorily used. The amount of the charge generation substance is preferably 5 to 40 pts.wt. for 100 pts.wt. of the binding resin, the amount of the charge transport substance is preferably 0 to 190 pts.wt., more preferably 50 to 150 pts.wt.

The photoconductive layer can be formed by coating the coating solution prepared by dispersing the charge generation substance and the binding resin, together with the charge transport substance, into a solvent such as tetrahydrofuran, doioxane, dichloroethane, or cyclohexane by means of a disperser, using a coating method such as, dipping coating, spray coating, bead coating, or ring coating. The thickness of the photoconductive layer should preferably be 5 to 25 μm.

In the photoconductive layer of the illustrative embodiment, the under layer 51 may be provided between the conductive support and the photoconductive layer. The under layer generally has resins as the principal component. Considering that the resins are coated with the photoconductive layer using a solvent, the resins desirably have high solvent resistance against general organic solvents. These resins include: a water soluble resin such as, polyvinyl alcohol, casein, or sodium polyacrylate; an alcohol soluble resin such as, copolymer nylon or methoxymethylated nylon; hardening resins having three dimensional network structure such as, polyurethane, melamine resin, phenol resin, alkyd-melamine resin, or epoxy resin. Fine powder pigment of metallic oxide, such as, titanium oxide, silica, alumina, zirconium oxide, tin oxide, or indium oxide, may be added to the under layer to prevent moiré and to lower the residual potential. These under layers may be formed by using a proper solvent and coating method, as in the case of the photoconductive layer mentioned above. For the under layer of the illustrative embodiment, a silane coupling agent, a titanium coupling agent or a chromium coupling agent may also be used. Besides, the under layers formed by providing $Al_2O_3$ by anodic oxidation or by providing an organic substance like polyparaxylene (parylene) or an inorganic substance such as $SiO_2$, $SnO_2$, $TiO_2$, ITO, $CeO_2$, by vacuum thin film forming method, may be satisfactorily used. Other known substances may also be used. The thickness of the undercoat layer is suitably between 0 μm and 5 μm.

A protection layer 54 may be provided on the outermost layer of the photoconductive layer to obviate mechanical abrasion. For example, a photoconductor coated with amorphous silicon for enhancing abrasion resistance and an organic photoreceptor formed by providing an outermost layer with alumina or tin oxide disposed on the surface of the charge transport layer may be used.

As stated above, the configuration of the drum 1 applicable to the illustrative embodiment is open to choice. For example, the drum 1 may be provided with a single layer, i.e., a photoconductive layer formed on a conductive support and mainly consisting of a charge generating substance and a charge transporting substance. Also, a charge generating layer and a charge transporting substance, respectively mainly consisting of a charge generating substance and a charge transporting substance, may be stacked on a conductive support. A protection layer may additionally be formed on the photoconductive layer mainly consisting of the charge generating substance and charge transporting substance or the stack of the charge generating layer and charge transporting layer mainly consisting of the charge generating substance and charge transporting substance, respectively.

While it is difficult to measure the amount of the protection substance 32 present on the drum 1 in an extremely small amount, we measured an element unique to the protection substance 32 and found the following relating to the protection substance required to be present on the drum 1. The measurement was executed with an XPS Quantum 2000 (trade name) available from PHI by use of an AlKα X-ray source and a spectral range of 100 μm in terms of diameter.

Figure 12A:
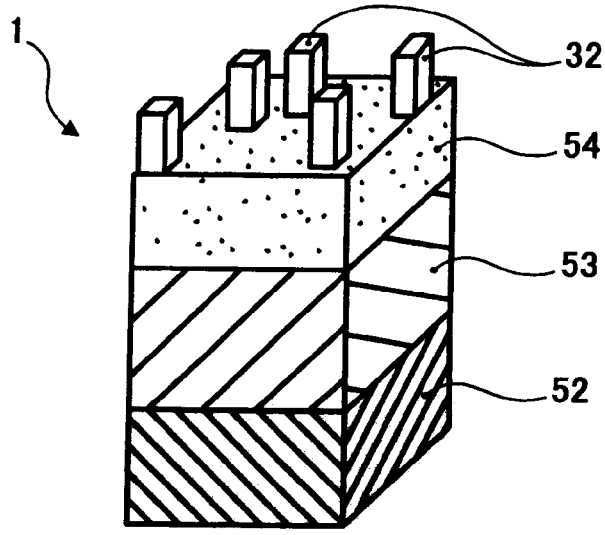
FIG. 12A shows a protection substance coated on part of the photoconductive element.
Figure 12B:
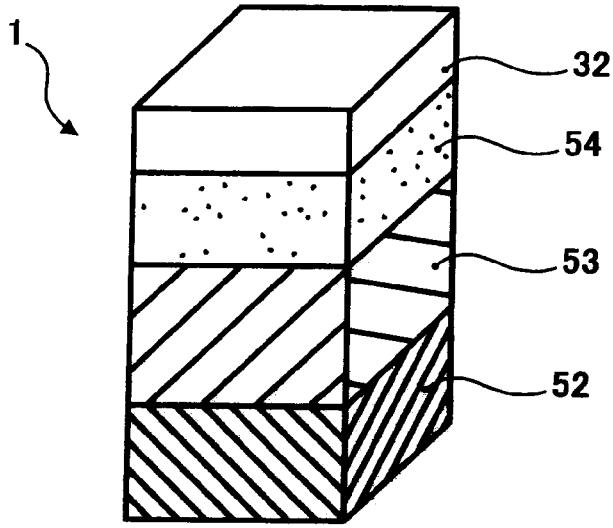
FIG. 12B shows the protection substance uniformly coated on the photoconductive element to thickness of 20 Å to 50 Å or above from the outermost layer.
Figure 12C:
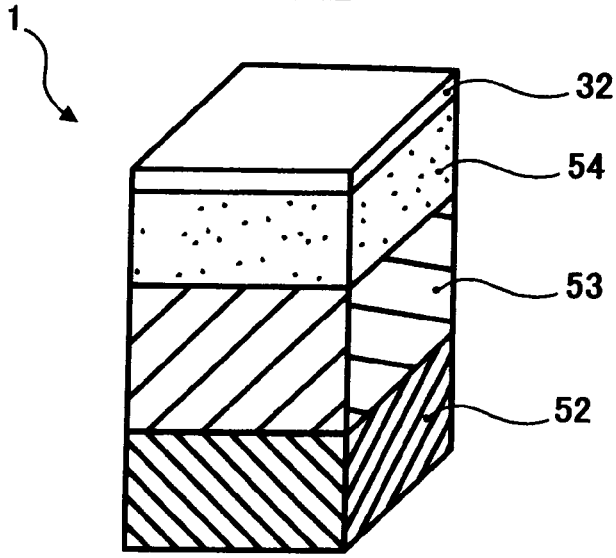
FIG. 12C shows the protection substance uniformly coated on the photoconductive element to thickness of 20 Å to 50 Å or below from the outermost layer.

As shown in FIG. 12A, when the protection substance 32 covers only part of the surface of the drum 1, elements constituting the protection substance 32, protection layer 54 and charge transport layer 53 are detected. In this case, the higher the ratio of the element derived from the protection substance 32 in the measurement range, the higher the ratio in which the protection substance 32 covers the drum 1. On the other hand, as shown in FIG. 12B, when the protection substance 32 uniformly covers the surface of the drum 1 and has thickness greater than the measurement range in the direction of depth, all elements measured by the XPS are derived from the protection substance 32. Further, as shown in FIG. 12C, when the protection substance 32 uniformly covers the surface of the drum 1, but has thickness smaller than the measurement range in the direction of depth, elements measured by the XPS are derived from the protection substance 32 and the layers constituting the drum 1.

Two specific samples, prepared by coating zinc stearate or protection substance on the drum 1, were measured by the XPS, as will be described hereinafter. Measurement was effected in a circular range having a diameter of 100 μm and extending from the outermost surface of the drum 1 to the depth of 20 Å to 50 Å. Here, the surface range of the drum 1 to be measured by the XPS is constituted at least only by carbon (C), oxygen (O), silicone (Si), zinc (Zn) and hydrogen (H). Also, Zn is absent in the substances other than zinc stearate. H cannot be measured by the XPS.

FIG. 13 compares the two samples with respect to the ratio (%) of the total number of the individual elements detected by the XPS to the total number of all elements, which constitute the drum surface and are also detected by the XPS. Because Zn is present only in zinc stearate, as stated above, it is possible to produce the ratio of the number of elements of zinc stearate detected by the XPS and the ratio of the number of the individual elements constituting zinc stearate and also detected by the XPS from the ratio of the number of elements of zinc stearate. As for zinc stearate represented by $[CH_3(CH_2)_{16}COO]_2Zn$, a single Zn element contains thirty-six C elements, four 0 elements and seventy H elements although H elements cannot be detected by the XPS. It is therefore possible to produce the ratio of the number of elements of zinc stearate detected by the XPS to the total number of all elements constituting the drum surface and also detected by the XPS by multiplying the ratio of the number of Zn elements by 41, which is the total number of C, O and Zn elements. Also, it is possible to produce the ratio of the number of the individual elements, constituting zinc stearate and detected by the XPS to the total number of all elements present on the drum surface and also detected by the XPS by multiplying the number of the individual elements present in a single molecule.

FIG. 14 lists, based on the results of FIG. 13, the ratio of the number of elements derived from zinc stearate and the ratios of the numbers of elements derived from the protection layer 54 and charge transport layer. As shown, in the measurement range, the ratio of the number of elements present in zinc stearate and detected by the XPS is 8.6% in a sample 1 or 98.4% in a sample 2. This means that as for the sample 2, the surface of the drum 1 is substantially entirely covered with zinc stearate. It is to be noted that even when zinc stearate is replaced with any other protection substance, the amount of the protection substance can be determined if an element absent in the drum 1 is contained in the protection substance.

Experiment 6

Hereinafter will be described an experiment showing that the shaving of the film thickness of the drum 1, conspicuous with AC discharge, is (i) proportional to Vpp−2×Vth, (ii) proportional to the frequency f of the AC voltage, and (iii) proportional to the moving speed v of the drum surface.

While Experiment 6 was substantially identical with Experiment 4 as to the basic configuration and experimental conditions, the deterioration of the drum surface was examined by varying Vpp, f, v and the amount of the protection substance 32 fed to the drum surface. More specifically, by continuously applying the voltage to the charge roller 2*a* for 100 hours, a relation between the amount of the protection substance 32 fed and the cloudiness and decrease in film thickness of the drum surface was determined. Also, to determine the amount of the protection substance 32 actually fed in each condition, a sample fed only with the protection substance 32 without the voltage being applied to the charge roller 2*a* was prepared; the ratio of the number of Zn elements on the surface of the sample was measured by the XPS. The ratio of the number of Zn elements measured was determined when zinc stearate was continuously coated for 5 hours without the voltage being applied to the charge roller 2*a*. Experiment 6 was conducted under the following conditions:

Charging Conditions:

Vpp=2,120 V and 3,000 V f=877.2 Hz and 1,350 Hz

DC=−600 V moving speed v=125 mm/sec and 185 mm/sec

Protection Substance: zinc stearate

In the illustrative embodiment, the protection layer 54 for obviating mechanical wear just underlies the protection layer 32 while the charge transport layer 53 underlies the protection layer 54. Because zinc stearate is absent in the protection layer 54 and charge transport layer 53, the ratio of the number of Zn elements measured is entirely derived from zinc stearate or protection substance.

FIG. 15 shows the cloudiness and decrease in film thickness of the drum surface and the ratio of the number of Zn elements detected by the XPS, as determined by varying the moving speed v, Vpp and frequency f. X included in FIG. 15 is expressed as:

$$X=\{Vpp-2\times Vth\}\times f/v \tag{4}$$

Figure 16:
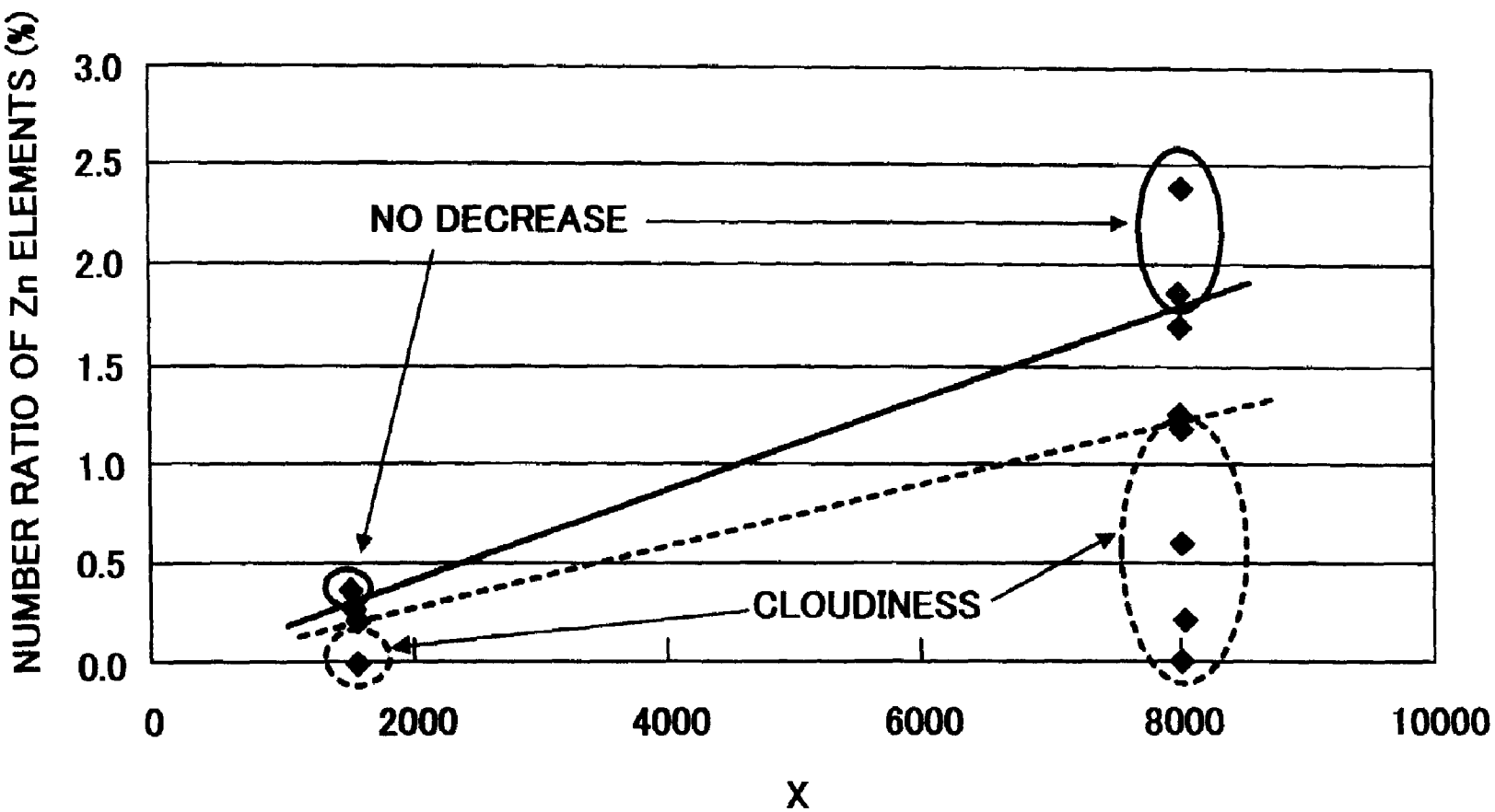
FIG. 16 is a graph plotting the ratio of the number of Zn elements determined with respect to X in Experiment 6 of the illustrative embodiment.

FIG. 16 plots, based on the experimental results of FIG. 15, the ratio (%) of the number of Zn elements detected by the XPS to the total number of all elements constituting the drum surface and also detected by the XPS with respect to X. As shown, to obviate the deterioration (cloudiness) of the drum surface ascribable to discharge, the ratio of the number of Zn elements should be greater than, inclusive:

$$1.52\times10^{-4}\times\{Vpp-2\times \mathrm{Vth}\}\times \mathrm{f/v} \tag{5}$$

Further, to obviate the shaving of the film thickness ascribable to discharge, the ratio of the number of Zn elements should be greater than, inclusive:

$$2.22\times10^{-4}\times\{Vpp-2\times \mathrm{Vth}\}\times \mathrm{f/v} \tag{6}$$

The contents of Zn elements thus determined are used to calculate the amount of zinc stearate necessary for protecting the drum surface from deterioration, as determined by the XPS, as will be described hereinafter. The cloudiness of the drum surface can be obviated if the ratio of the number of elements of zinc stearate, as determined by the XPS, to the total number of all elements constituting the drum surface, as also determined by the XPS, is greater than, inclusive:

$$6.23\times10^{-3}\times\{Vpp-2\times Vth\}\times f/v \tag{7}$$

Further, the film thickness is shaved little if the ratio of the number of elements of zinc stearate detected by the XPS to the total number of all elements constituting the drum surface and also detected by the XPS is greater than, inclusive:

$$9.10\times10^{-3}\times\{Vpp-2\times Vth\}\times f/v \tag{8}$$

Why the chemical deterioration of the drum surface conspicuous with AC discharge varies in accordance with the amount of zinc stearate coated on the drum surface is presumably as follows. When the energy of particles produced by the discharge of the contact or the proximity type charging member, i.e., ozone, electrons, excited molecules, ions, plasma and so forth are radiated on the drum surface, the energy resonates the coupling energy of molecules constituting the drum surface and is absorbed thereby. As a result, there occur chemical deterioration including a decrease in the degree of entangling of high polymer chains and a decrease in molecular weight ascribable to the cut-off of resin molecule chains in the charge transport layer.

On the other hand, when the protection substance is present on the drum surface, the energy of the particles is directly radiated on the protection substance, i.e., the drum itself is free from the direct radiation. The protection layer 32 is therefore considered to absorb the energy of the particles to thereby reduce the chemical deterioration of the drum surface. By the experiment of FIGS. 3A and 3B, too, it was found that the drum surface in the zone B where the protection substance 32 was absent was detected by the analysis of the residuals of molecules constituting the drum surface, but no residuals were detected and the drum surface beneath the protection substance 32 was not deteriorated in the zone A.

The above studies show that various substances are usable as the protection substance 32. Zinc stearate used in the illustrative embodiment is an example of the protection substance 32 and may be replaced with any one of various kinds of fatty acid salts, waxes, silicon oils and so forth. Among fatty acid salts, fatty acid metal salts promote easy measurement for setting the conditions, including the amount of coating, because metal elements easily constitute unique elements to be measured by the XPS. Fatty acid metal salts are therefore desirable in feeding the protection substance to the drum surface in an optimum amount in accordance with the charging conditions.

As for the fatty acid, undecylic acid, lauric acid, tridecylic acid, myristic acid, palmitic acid, pentadecylic acid, stearic acid, heptadecylic acid, arachic acid, montanic acid, oleic acid, arachidonic acid, caprylic acid, and capric acid, and caproic acid are listed. Their metallic salts include those with zinc, iron, copper, magnesium, aluminum, and calcium.

The protection substance 32 should preferably be implemented by zinc stearate or similar prolamellar crystal powder. A prolamellar crystal has a layer structure in which amphipatic molecules self-organized and is therefore easy to cleave and slide at the interface when subjected to a shearing force. This is effective to reduce the coefficient of friction. A prolameller crystal, uniformly covering the drum surface when subjected to a shearing force, is desirable as the protection substance as well because it allows a small amount of protection substance to effectively cover the drum surface.

To protect the drum surface from discharge by making most of the above nature of a prolameller crystal, it is desirable to provide a difference between the rotation speed of the coating device 30 and that of the drum 1 such that a shearing force acts on the protection substance 32.

Further, to protect the drum surface from discharge, which is the object of the illustrative embodiment, the coating device 30 should preferably be positioned between the cleaning device 8 and the charger 2. This prevents the cleaning device 8 from removing the protection substance 32 before the substance 32 arrives at the discharge region.

When the protection substance 32 comprises zinc stearate, it exhibits viscosity when deteriorated by discharge. It is generally considered that even when any other protection substance is used, it should preferably be quickly removed from the drum 1 when so deteriorated. In this respect, it is preferable to use a removing member for removing the deteriorated protection substance 32 from the drum surface. Further, the deteriorated protection substance 32 is likely to enter the developing device 4 in the developing zone, causing the amount of charge deposited on toner to vary. It is therefore desirable to use magnet brush type of development using a two-component developer.

Hereinafter will be described more specific means included in the illustrative embodiment for obviating the chemical deterioration of the surface of the drum 1.

Figure 17:
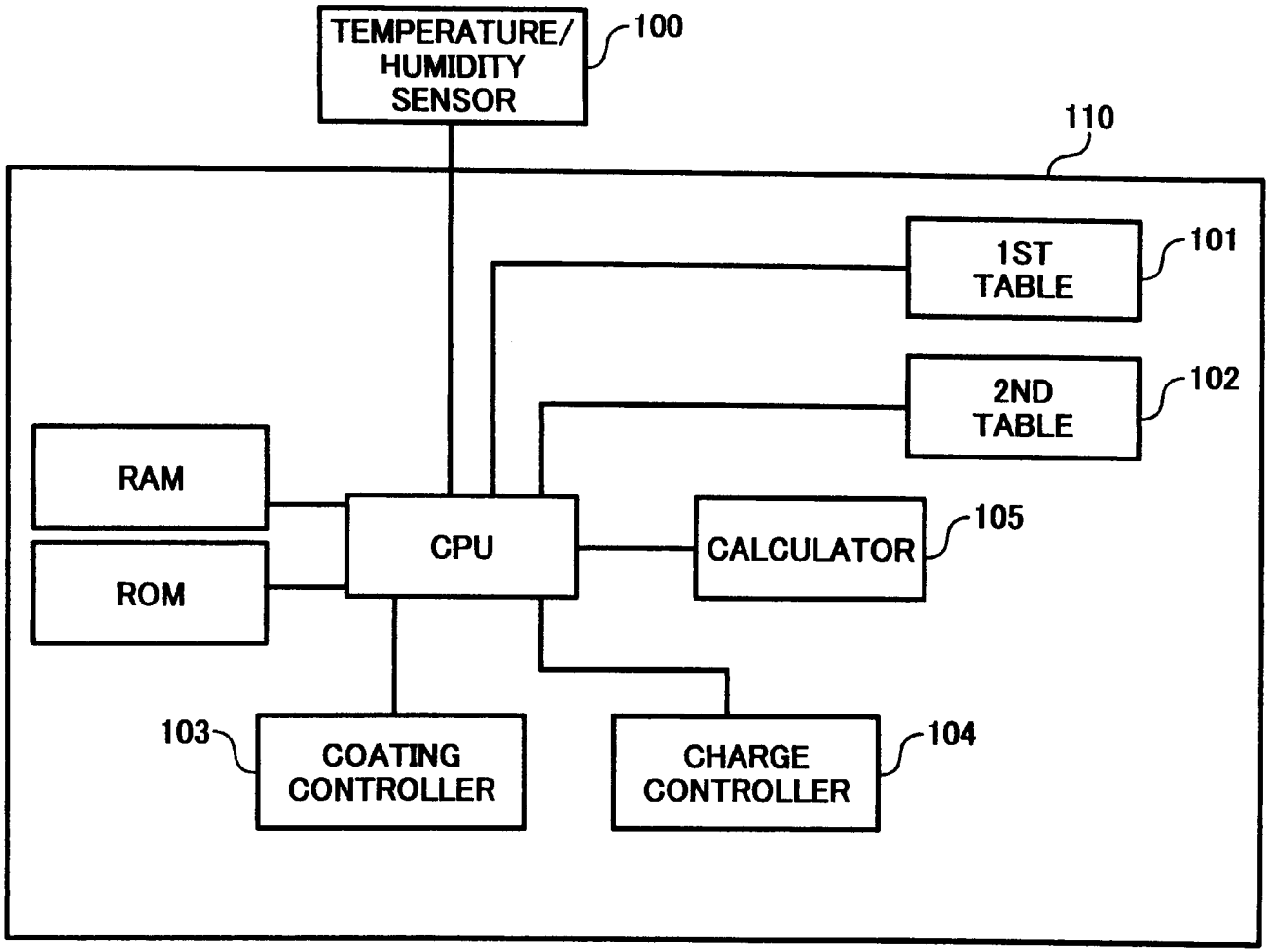
FIG. 17 is a schematic block diagram showing a system included in the illustrative embodiment for optimally coating the protection substance.

FIG. 17 shows electric circuitry configured to obviate the chemical deterioration of the drum surface. As shown, the circuitry includes a controller or main controller 110 includes a CPU (Central Processing Unit), a RAM (Random Access Memory) and a ROM (Read Only Memory) and performs control for obviating the chemical deterioration. The ROM stores a program to be described later while the CPU executes the program while suitably using the RAM.

The controller 110 further includes a first table 101, a second table 102, a coating controller 103, a charge controller 104, and a calculator 105. The first table 101 lists the rotation speeds of the fur brush 31 and the amounts of protection substance 32 to be fed to the drum surface in one-to-one correspondence. The second table 102 shows correspondence between the environment around the charge roller 2*a* detected by a temperature/humidity sensor 100 and the charging conditions. The coating controller 103 controls the rotation speed of the fur brush 31 while the charge controller 104 controls the charging conditions. The calculator 105 calculates a necessary amount of protection substance in accordance with the charging conditions. The temperature/humidity sensor 100, charger 2 and coating device 30 are electrically connected to the controller 110.

The first and second tables 101 and 102 may be stored in the ROM, if desired. Also, the calculator 105 may implemented by a calculation program stored in the ROM and the CPU that executes the calculation program.

More specifically, to coat an amount of protection substance, i.e., zinc stearate necessary for protecting the drum surface from the chemical deterioration, the first table 101 stores correspondence between the ratios of Zn elements resulting from the XPS measurement and the rotation speeds of the fur brush 31. On the other hand, to insure discharge based on AC voltage even when the discharge start voltage varies due to a change in the environment around the charge roller 2*a*, the second table 102 stores correspondence between temperature/humidity values and Vpp values necessary for discharge. The calculator 105 is configured to calculate a necessary ratio (%) of the number of zinc elements by using the expressions (6) and (7) for thereby determining a necessary amount of protection substance in accordance with the charging conditions.

Figure 18:
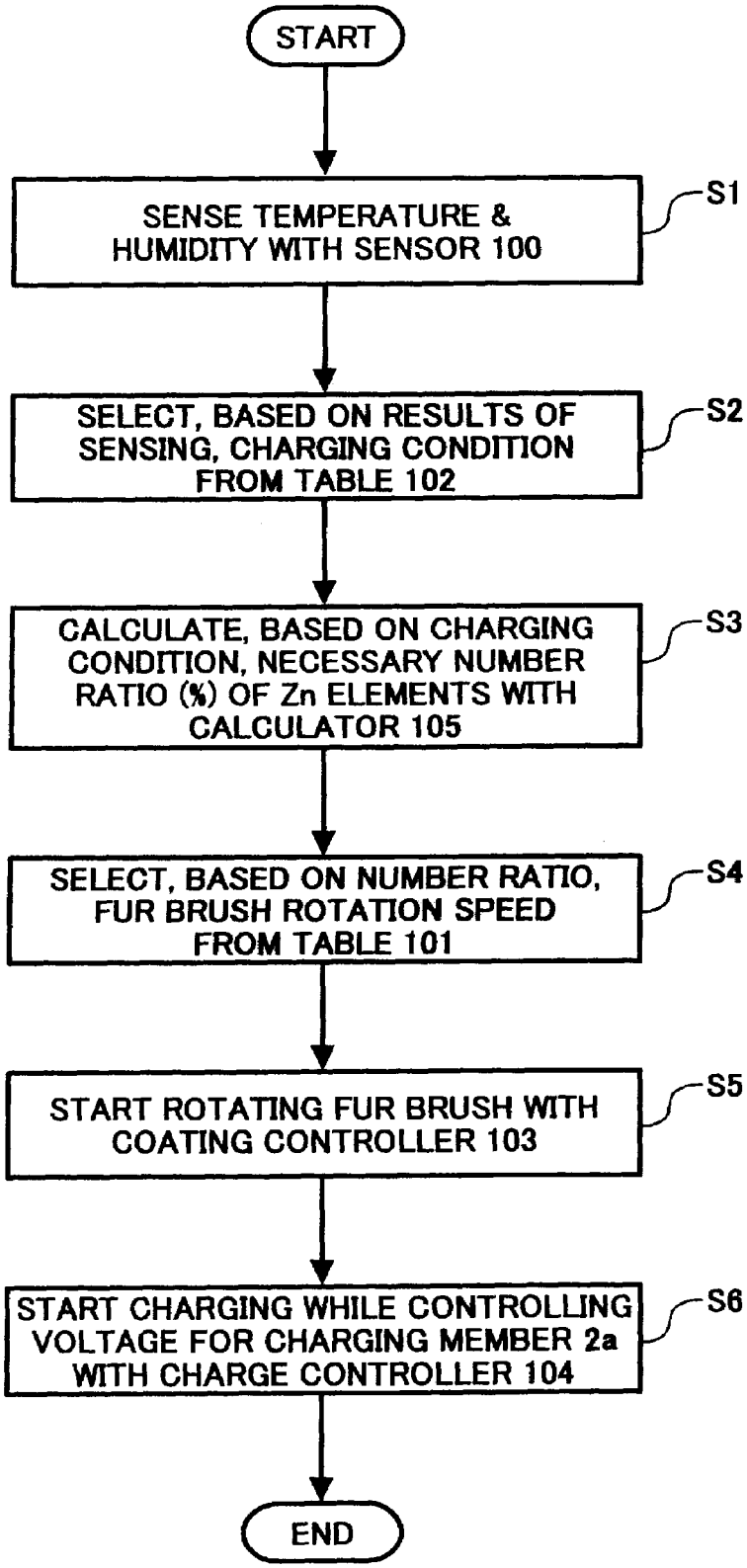
FIG. 18 is a flowchart demonstrating a charge start procedure executed by the illustrative embodiment.

FIG. 18 is a flowchart demonstrating a procedure for determining a brush rotation speed and charging conditions. As shown, before starting charging in response to an image formation start command, the controller 110 determines temperature and humidity around the charger 2 in accordance with the output of the temperature/humidity sensor 100 (step S1). The controller 110 then selects a charging condition Vpp stored in the second table 102 in accordance with the temperature and humidity determined and sets it as a charging condition (step S2). Subsequently, the calculator 105 calculates, based on the charging condition, a ratio of the number of Zn elements of zinc stearate coated on the drum surface against deterioration (step S3). Subsequently, a rotation speed of the fur brush matching with the above ratio is selected from the first table 101 and set as a rotation speed in order to coat a desired number of protection substance on the drum surface (step S4). The coating controller 103 drives the fur brush in such a manner as to establish the rotation speed set in the step S4 (step S5). Finally, the charge controller 104 causes charging to start while controlling the voltage to be applied to the charge roller 2*a* (step S6).

The control means stated above can obviate the deterioration of the drum surface by feeding an optimum amount of protection substance 32 even when the charging condition is varied in accordance with the environment.

It is to be noted that when a necessary ratio of elements of zinc stearate is calculated in accordance with the expression (5), it is necessary to calculate Vth by taking account of the fact that the film thickness of the drum 1 has decreased. For this purpose, the controller 110 further includes memory means for storing a cumulative discharge time and a third table for producing the film thickness of the drum 1 from the cumulative discharge time.

Figure 9:
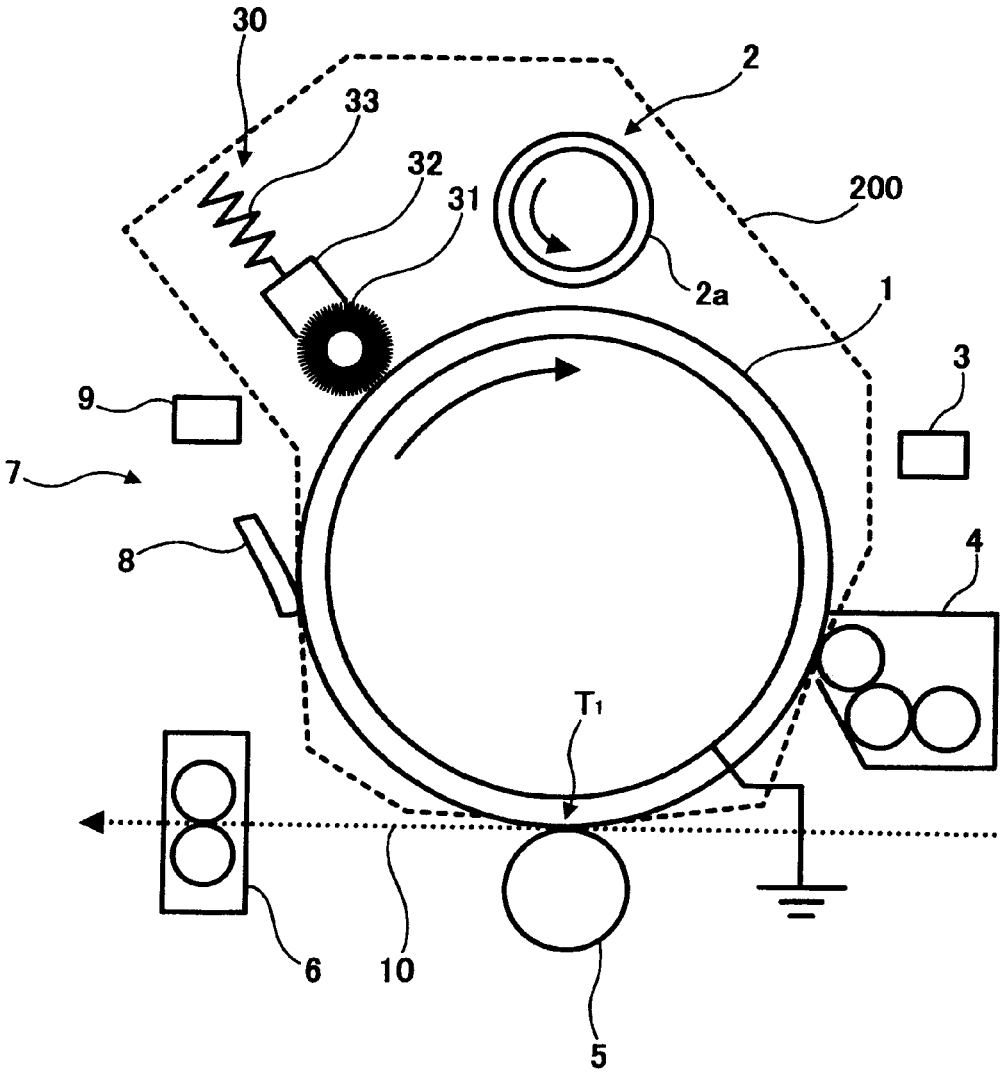
FIG. 9 shows part of a first embodiment of the image forming apparatus in accordance with the present invention.

In the illustrative embodiment, the drum 1, charger 2 and coating device 30 are constructed into a single process cartridge 200 removable from the apparatus body, as indicated by a dotted line in FIG. 9. The process cartridge 200 bodily replaceable allows the amount of protection substance 32 contained in the coating device 30 and the initial film thickness of the drum 1 to be easily set in relation to each other.

Second Embodiment

A second embodiment of the present invention to be described hereinafter differs from the first embodiment as to the configuration of the cleaning device. As for the basic configuration and operation, the second embodiment is identical with the first embodiment.

While the first embodiment includes an exclusive cleaning device 7, the second embodiment omits the cleaning device 7 and causes the developing device 4 to collect the residual toner. Because the developing device 4 plays the role of cleaning means at the same time, the illustrative embodiment contributes a great deal to the size reduction of the apparatus. In the illustrative embodiment, the charge roller 2*a* is formed of rubber and held in contact with the drum 1 (contact type of charging system; Gp=0 μm).

The residual toner is conveyed to the developing device 4 facing the drum 1 and collected thereby. In this configuration, the residual toner exists in the zone where the coating device 30 coats the protection substance 32 on the drum 1.

The protection substance 32 cannot therefore be coated on the portions of the drum surface where the residual toner exists. Consequently, portions where the residual toner is present and portions where the protection substance 32 is present exits on the drum surface together.

However, to protect the drum surface from the chemical deterioration conspicuous with AC discharge, some substance should only be present on the drum surface. That is, even the toner suffices for the above purpose if present on the drum surface in place of the protection substance 32. More specifically, the cloudiness of the drum surface can be obviated if the ratio of the number of Zn elements is selected to be 10% or above without regard to the influence of the residual toner while the shaving of the film thickness can be obviated if the ratio (%) of the number of Zn elements is equal to or greater than the value represented by the expression (6).

Now, in an image forming apparatus using the residual toner collection system stated above, the residual toner contacts the coating device 30 and charge roller 2*a* while being conveyed to the developing zone and sometimes deposit thereon. As a result, portions where neither the toner nor the protection substance 32 exists appear on the drum surface and bring about the chemical deterioration of the drum, i.e., protection layer 54, CTL 53 and so forth ascribable to discharge. To solve this problem, the illustrative embodiment applies a negative voltage, e.g., −1,000 V to the coating device 30. Such a negative voltage strongly charges the toner on the drum 1 to negative polarity to thereby increase the adhering force (mirror-image force) of the toner to the drum 1. This reduces the movement of the toner toward the coating device 30 and charge roller 2*a* and easily protects the drum surface from discharge.

The illustrative embodiment obviates the need for the conventional cleaning device of the type cleaning the drum surface with a cleaning blade contacting the drum surface. This reduces load to act on the drum surface and therefore drive load to act on a driveline assigned to the drum 1.

If desired, an arrangement may be made such that a brush member or similar temporary holding means is positioned upstream of the coating device 30 in the direction of rotation of the drum 1 in order to collect toner grains opposite in polarity to toner grains charged to the same polarity as the charge bias from the drum surface. By so collecting and temporarily holding the toner grains of opposite polarity, it is possible to prevent such toner grains from depositing on the charging member. The brush member returns the above toner grains to the drum surface at preselected timing, e.g., between consecutive image forming cycles. The toner grains thus returned to the drum surface are then collected by the developing device 4 or transferred to a subject of image transfer or a conveying member for conveying it. While the toner grains of opposite polarity are being conveyed through the charging zone, the charge bias is interrupted or the charge roller 2*a* is released from the drum 1 in order to prevent the toner grains from depositing on, e.g., the charge roller 2*a*. Because the force with which the brush member 31 rubs the drum surface can be made weaker than the force of a cleaning blade, the life of the drum 1 can be extended despite the use of the brush member 31.

It should be noted that the illustrative embodiment is applicable not only to the image forming apparatus shown in FIG. 9, but also to image forming apparatuses in general that charge the surface of a charged body with a contact or a proximity type of charging member by AC discharge.

Third Embodiment

The description made with reference to FIGS. 3A, 3B, 4, 5, 6, 9 and 10 similarly apply to a third embodiment to be described hereinafter. Let the following description concentrate on characteristic features of the third embodiment.

The illustrative embodiment also uses the non-contact type of charging system shown in FIGS. 9 and 10 in which the charge roller 2*a* is spaced from at least the image forming range 11 of the drum surface by the preselected gap 14. In the illustrative embodiment, too, an alternating voltage, consisting of a DC voltage and an AC voltage superposed thereon, is applied to the charge roller 2*a* although only a DC voltage may be applied to the charge roller 2*a*. However, when only a DC voltage is applied, it is likely that the uniform charging of the drum surface is obstructed by irregular charge potential ascribable to the variation of the gap 14 as well as by unstable discharge. In this respect, the above alternating voltage enhances uniform charging and therefore image quality.

Charging conditions particular to the illustrative embodiment include a surface potential of about −700 V to deposit on the drum surface after charging, a frequency of about 900 Hz assigned to the AC-biased DC voltage, a voltage of about 2.2 kVpp, and an offset voltage of about −660 V.

As for the fatty acid, undecylic acid, lauric acid, tridecylic acid, myristic acid, palmitic acid, pentadecylic acid, stearic acid, heptadecylic acid, arachic acid, montanic acid, oleic acid, arachidonic acid, caprylic acid, and capric acid, and caproic acid are listed. Their metallic salts include those with zinc, iron, copper, magnesium, aluminum, and calcium.

The coating layer may be replaced with the coating of amorphous silicone or the dispersion of alumina or similar inorganic substance in a photoconductive layer, enhancing not only wear resistance but also cost reduction.

In the illustrative embodiment, the roller member of the charge roller 2*a* may be formed of rubber. Rubber, however, makes it difficult maintain the gap 14 between the charge roller 2*a* and the drum 1 constant and noticeably varies in electric resistance in accordance with the environment because it easily absorbs water, resulting in defective charging. Further, the charge roller 2*a* formed of rubber is likely to bend and contact the drum 1, making the protection layer of the drum 1 non-uniform due to the transfer of the protection substance 32. Therefore, the charge roller 2*a* should preferably be formed of hard resin in order to insure high stability and high durability. It is to be noted that the surface of the charge roller 2*a* is sufficiently hard if its hardness is 85° or above in JIS (Japanese Industrial Standards) A scale.

By using resin hard enough to prevent the charge roller 2*a* from bending, it is possible to accurately maintain the gap between the charge roller 2*a* and the drum 1 uniform. The illustrative embodiment also provides the charge roller 2*a* with such hardness and can therefore not only implement uniform charging, but also frees the charge roller 2*a* from the deposition of impurities to thereby extend the life of the charge roller 2*a*.

Experiments conducted to compare a hard resin roller and a soft rubber roller as to the stability of the gap, which is susceptible to the environment, will be described hereinafter.

Experiment 1

In offices in general, the upper limit of environment that aggravates moisture absorption most is considered to be about 30° C. and 80% RH when the working environment is taken into account. Likewise, the lower limit of humidity in offices is considered to be 20% RH for about 30° C. The illustrative embodiment provides a charger maintaining high quality over a long period of time in the above environments.

Figure 19:
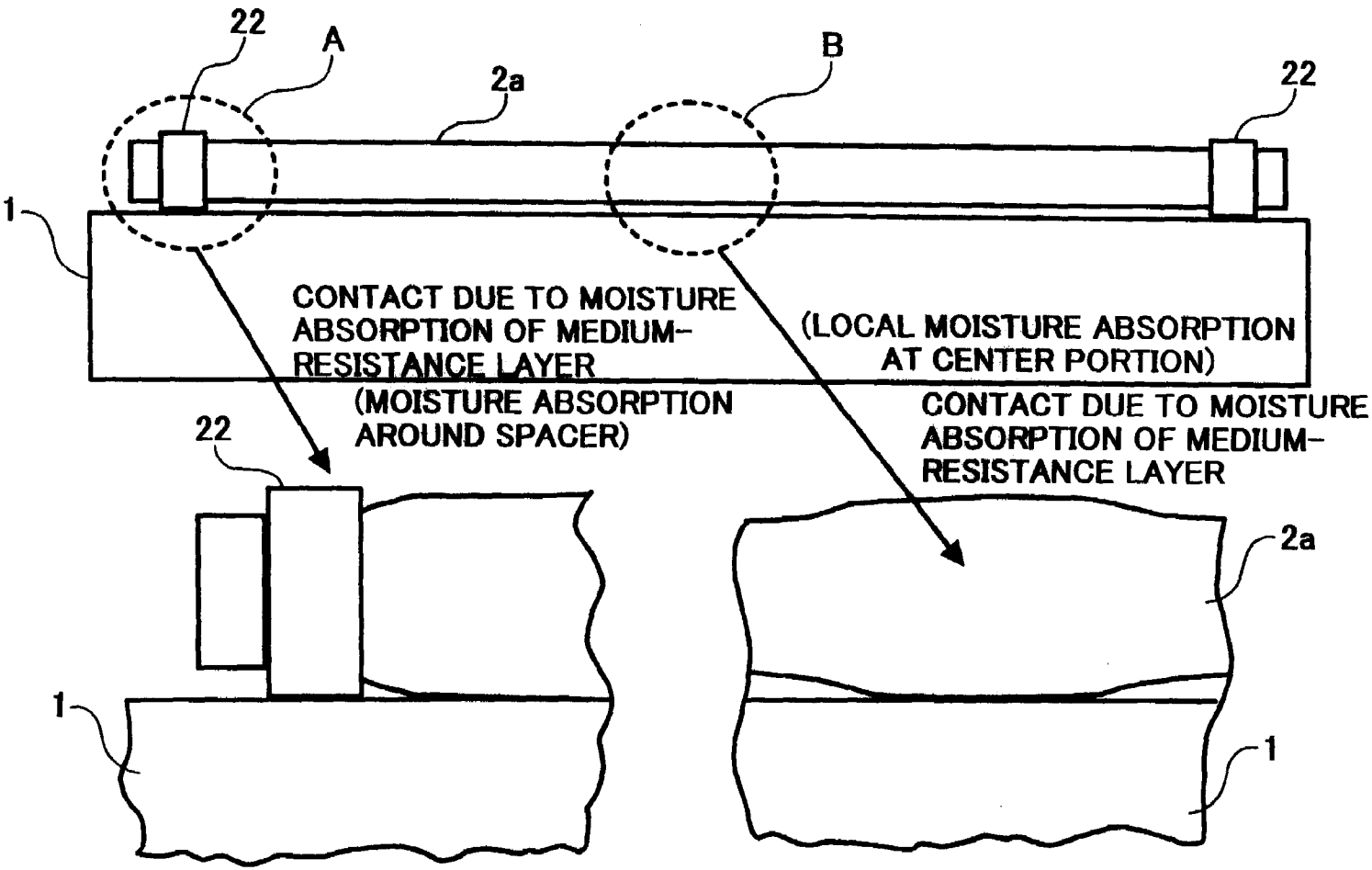
FIG. 19 shows a specific condition in which a charge roller expands by absorbing moisture.

As shown in FIG. 19, assume that the gap 14 is formed between the charge roller 2*a* and the drum 1 in a 30° C., 20% RH environment in which moisture absorption has little influence. Then, when the conventional charge roller 2*a* formed of rubber is used, the spacer cannot stretch due to the expansion of a medium resistance layer ascribable to moisture absorption with the result that the charge roller 2*a* and drum 1 are apt to contact each other, as indicated by a circle A in FIG. 19. Further, if moisture absorption concentrates in the intermediate portion due to the air stream design of the apparatus, then the charge roller 2*a* and drum 1 are apt to contact at the intermediate portion, as indicated by a circle B in FIG. 19. While the contact at the position A may be reduced if the spacer is provided with stretchability, the contact at the position B cannot be reduced by such a scheme.

FIG. 20 shows a relation between the environment and the gap 14 determined with a rubber roller and a hard roller. As shown, the gap 14 does not vary with the variation of environment when the charge roller 2*a* is formed of a hard material, but becomes extremely small in a high humidity environment when the charge roller 2*a* is formed of rubber. A decrease in gap 14 may indicate contact and therefore the smearing of the charge roller 2*a* ascribable to toner. It follows that the charge roller 2*a* should preferably be formed of a material hard enough to maintain the gap 14 constant from the uniform charging standpoint as well.

Experiment 2

An experiment showing that the charge roller 2*a* reduces defective images more effectively when formed of hard resin, which maintains the gap 14 constant, than when formed of rubber will be described hereinafter. The frequency of an image defect called an image flow was determined by varying the gap 14 between the charge roller 2*a* and the drum 1*a*. The proximity type charge roller of the illustrative embodiment was used as a charger while a copier imagio 4570 (trade name) available from Ricoh Co., Ltd. was used as an image forming apparatus. The experiment was conducted under the following conditions:

charge roller: roller with a conductive resin layer gap: formed by PET (polyethylene terephthalate) tapes wrapped around opposite ends of charge roller 2 (30 μm, 50 μm and 80 μm thick)

environment: 30° C., 90% RH mechanical condition: drum cleaning member absent

For comparison, the same experiment was conducted except that the charge roller 2*a* was held in contact with the drum 1.

The gap 14 was intentionally varied in order to see how the frequency of an image flow was dependent on the gap 14. For this purpose, the PET tapes each having particular thickness were used. The amount of a hazard substance was measured by continuously operating the copier with the three kinds of gaps. To estimate hazard, 5,000 copies (A4 landscape) were continuously output and checked for an image flow.

Figure 21:
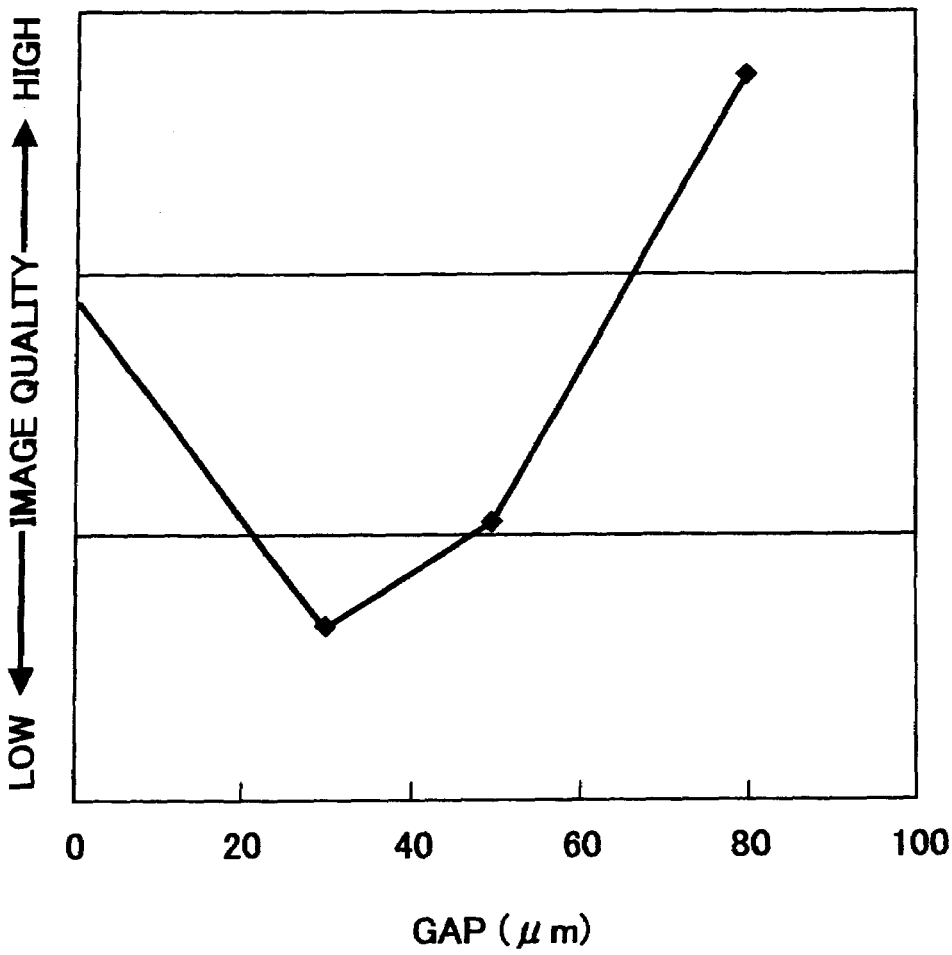
FIG. 21 is a graph showing a relation between the gap and the flow of an image.

The result of the above experiment is shown in FIG. 21 in which the ordinate and abscissa indicate the frequency of an image flow and gap 14, respectively. As shown, an image flow easily occurs when the gap 14 is large, but occurs little when the gap 14 has a certain small value. It follows that an image flow is noticeably dependent on the size of the gap 14 and decreases most when provided with a certain value.

Why the plot of FIG. 21 is convex downward will be described hereinafter. FIG. 21 indicates that the frequency of an image flow is lowest when the gap 14 has a certain value, as stated above. When the gap 14 increases over a certain value, the frequency of an image flow increases in proportion to the gap 14. This is presumably because a voltage necessary for discharge increases with an increase in the size of the gap 14 and because an ionization space derived from discharge broadens.

First, a relation between the gap 14 and the discharge voltage can be accounted for by the Paschen's law. Particularly, when the gap 14 lies in a certain range, the charge start voltage Vth (V) and gap d (μm) are expressed as:

$$Vth=6.2\times d+312$$

$$40\leqq d\leqq 120(\mu m) \tag{9}$$

As the above relation (9) indicates, the voltage necessary for discharge increases with an increase in the size of the gap 14. Discharge occurring at a high voltage means that energy at the time of discharge is great and ionizes many molecules, producing more hazard substance causative of an image flow.

As for the discharge space, the distance between the charge roller 2*a* and the drum 1 increases with an increase in the size of the gap 14, so that a space ionized up to the time when discharge, started at the charge roller 2*a*, reaches the drum 1. Consequently, the number of molecules ionized and therefore the amount of the hazard substance increases. That is, the hazard is expected to be minimum when the charge roller 2*a* contacts the drum 1. In practice, however, the frequency of an image flow was lower when a small gap was formed between the charge roller 2*a* and the drum 1. This is presumably accounted for by an air stream around the charge roller 2*a*, as will be described hereinafter.

Figure 22:
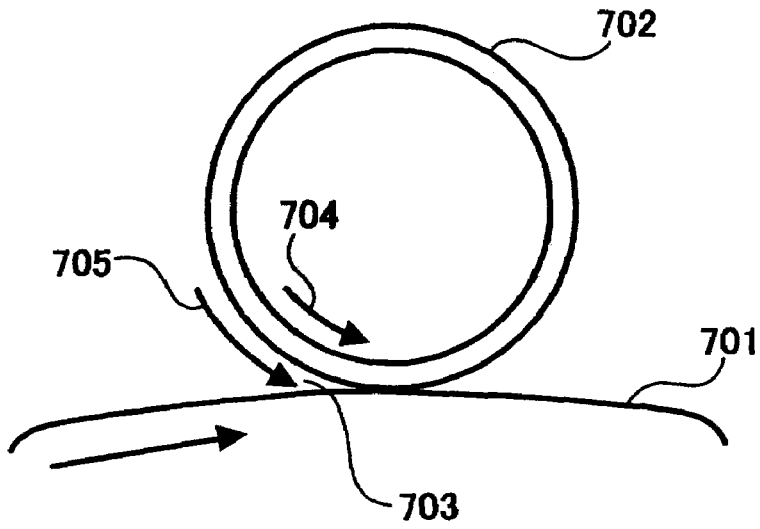
FIG. 22 shows a condition in which the charge roller contacts the photoconductive element.

FIG. 22 shows a specific condition in which a charge roller 702 contacts or nearly contacts a drum 701. As shown, an air stream 705 is produced in a wedge-shaped space 703 between the drum 701 and the charge roller 702 due to the rotation of the charge roller 702, which is indicated by an arrow 704, and flows toward the contact position between the drum 701 and the charge roller 702. However, the air stream 705 stops at the contact position where the charge roller 702 contacts the drum 701. The hazardous substance is presumably entrained by the air stream 705 and therefore also intercepted by the charge roller 702, accumulating at the contact position of the charge roller 702. Consequently, the concentration of the hazardous substance in the space 703 and therefore the amount of hazardous substance to deposit on the drum 701 increases.

Figure 23:
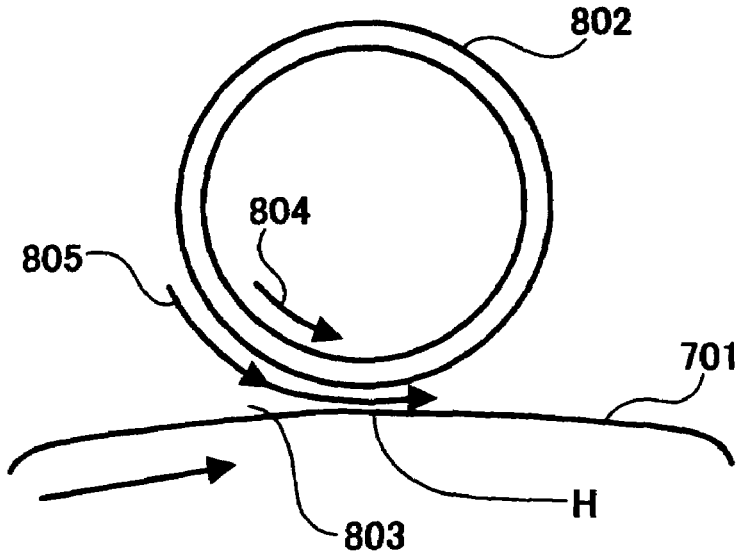
FIG. 23 shows a condition in which the charge roller is spaced from the photoconductive element by a small gap.

By contrast, as shown in FIG. 23, when the gap H is increased over a certain degree, an air stream 805 produced by the rotation, labeled 804, of a charge roller 802 passes through the gap H while entraining the hazard substance. This prevents the hazard substance from staying in a wedge-shaped space 803 to thereby reduce the amount of hazard substance to deposit on the drum 701. When the gap H is further increased, more air flows through the gap H and further reduces the deposition of the hazard material on the drum 701.

However, the discharge voltage increases with an increase in the size of the gap H and increases the amount of hazard substance to such a degree that the effect of the air stream cannot catch up. As a result, the amount of hazard substance increases when the gap H is increased over a certain limit.

Thus, the frequency of an image flow is minimum when the gap is provided with a certain value, as shown in FIG. 21. By maintaining such a gap, it is possible to reduce an image flow.

The gap 14 between the charge roller 2*a* and the drum 1 will be described in relation to the rotation of the charge roller 2*a* effected in various conditions. If the finishing accuracy, e.g., straightness of the charge roller 2*a* is low, then the gap 14 varies in accordance with the angular position of the charge roller 2*a*. Further, if the rigidity of the charge roller 2*a* is low, then the charge roller 2*a* bends due to its own weight and fails the maintain the gap 14 constant. The inaccurate charge roller 2*a* will be described on the basis of the relation between the gap 14 and the amount of hazard substance stated above.

Even if the gap 14 initially set is adequate and if the charge roller 2*a* and drum 1 are accurately positioned, the gap 14 increases or decreases during operation if the charge roller 2*a* lacks straightness. Because the amount of hazard substance noticeably varies when the gap 14 varies, the charge roller 2*a* lacking straightness aggravates an image flow. Therefore, with the charge roller 2*a* formed of hard resin, it is possible not only to maintain the gap 14 and therefore charging uniform more accurately, but also to extend the life of the charge roller 2*a* because impurities do not deposit on the charge roller 2*a*.

We found that the deterioration of the drum 1 ascribable to proximity discharge occurred because the surface of the drum 1 was directly exposed to proximity discharge and occurred even when no members contacted the drum 1. More specifically, the surface deterioration of the drum 1 ascribable to proximity discharge is derived from a mechanism different from mechanical rubbing. Experiments showed that when a lubricant, customarily coated on the drum surface for obviating surface deterioration ascribable to mechanical rubbing, could not obviate the deterioration ascribable to proximity discharge alone, as will be described hereinafter.

FIG. 24 shows the drum 1 of the illustrative embodiment in a sectional view. As shown, the drum 1 is provided with a protection layer 54, which obviates deterioration ascribable to discharge, on the surface thereof. To form the protection layer 54, the illustrative embodiment also uses the coating device 30 described with reference to FIG. 9 previously. The configuration of the coating device 30 will not be described specifically in order to avoid redundancy.

The coating device 30 directly coats the protection substance 32 on the surface of the drum 1 and can therefore stably form the protection layer 50 on the drum 1 without regard to image density or image pattern.

Although the coating substance 32 may be directly fed to the drum surface without the intermediary of the fur brush 31 or similar coating member, the coating substance 32 is apt to fail to evenly spread on the drum 1. By contrast, in the illustrative embodiment, the fur brush 31 spreads the protection substance 32 over the entire surface of the drum 1 and therefore obviates irregular coating.

Zinc stearate, conventionally used as a lubricant, can exhibit its effect even when coated in the form of islands to a certain degree. However, to protect the surface of the drum 1 from energy radiation caused by proximity discharge, which is the object of the illustrative embodiment, the protection substance 32 should ideally fully cover the entire surface of the drum 1. It is therefore necessary not only to feed the protection substance 32, but also to uniformly spread it on the entire surface of the drum 1. This can be done with the fur brush or coating member 31 of the illustrative embodiment.

Again, zinc stearate used as the protection substance 32 may be replaced with any other substance, e.g., wax or silicone oil.

Zinc stearate has customarily been coated on the surface of the drum 1 as a lubricant for reducing the coefficient of friction of the above surface. The lubricant therefore reduces adhesion between the toner and the drum 1 to thereby promote easy cleaning of the drum surface and obviate the adhesion of the toner.

It is a common practice with the drum 1 to enhance durability by increasing strength against mechanical wear or by reducing, if strength does not increase, the coefficient of friction for thereby decelerating wear. However, the fact that zinc stearate successfully obviates the deterioration of the drum surface ascribable to discharge has not been reported in the past. More specifically, the conventional zinc stearate coating has not addressed to the protection of the drum surface from energy radiation derived from discharge. We found that zinc stearate could obviate a decrease in film thickness ascribable to discharge when coated on the drum surface, as stated earlier.

The illustrative embodiment also selects the particular range of the amount of zinc stearate described with reference to FIGS. 5 and 6 previously. FIGS. 25A and 25B are similar to FIGS. 1A and 1B, respectively, and show why such a particular range can project the drum surface from deterioration ascribable to proximity discharge. The experiment described with reference to FIGS. 3A, 3B and 4 and relating to the zones A and B may again be referenced.

Figures 26A, 26B:
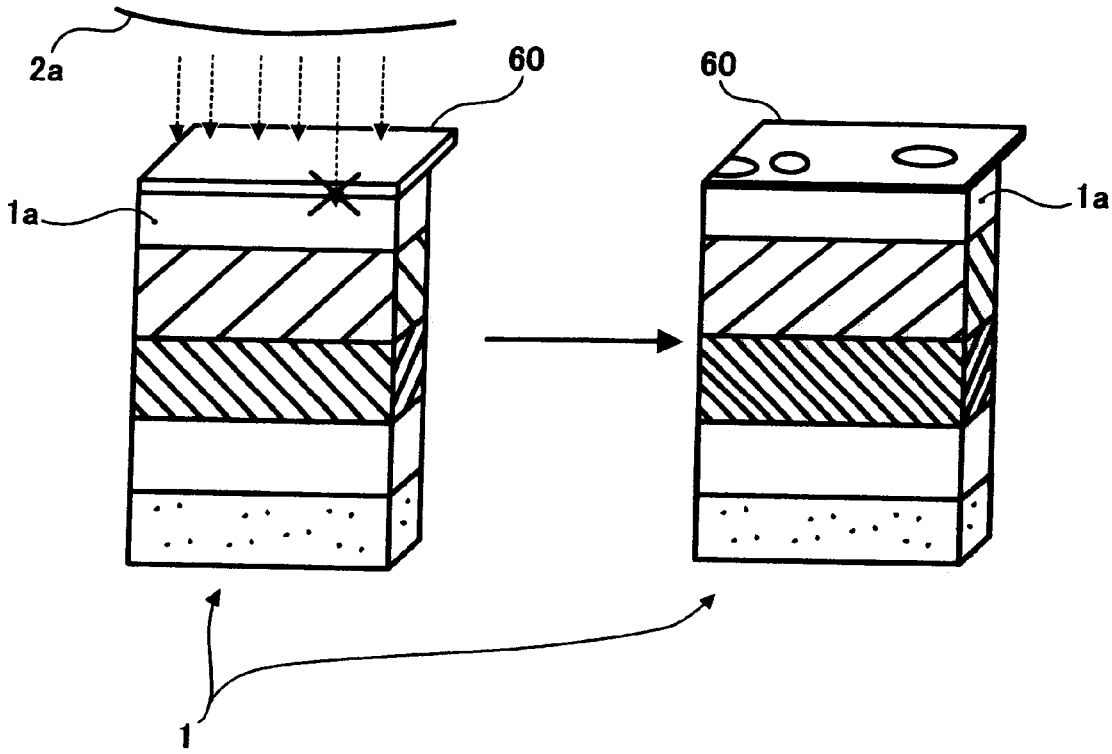
FIGS. 26A and 26B show a condition in which particles produced by proximity charging impinge on a protection layer formed on the photoconductive element.

FIGS. 26A and 26B show the protection layer 60 formed on the surface of the drum 1 and subject to the radiation of particles produced by proximity discharge. As shown, FIGS. 26A and 26B differ from FIGS. 25A and 25B in that not the charge transport layer 1*a* but the protection layer 50, implemented by zinc stearate, absorbs the energy of discharge and is decomposed. The energy of discharge thus absorbed by the protection layer 50 does not reach the charge transport layer 1*a*, so that the chemical deterioration of the drum surface 1 is obviated. At this instant, the protection layer 50 should presumably be provided with certain thickness capable of absorbing the above energy.

Experiment 3

Experiment 3 was conducted to determine, based on the result described above, the amount of zinc stearate necessary for protecting the drum surface from the chemical deterioration ascribable to proximity discharge. In Experiment 3, the amount of coating was more delicately varied by use of the arrangement of FIG. 3A to thereby detect deterioration. FIG. 27 shows the result of Experiment 3.

As shown in FIG. 27, the deterioration of the drum surface 1 occurs if the amount of zinc stearate is less than 0.0012 $mg/mm^2$, but does not occur if it is 0.0012 $mg/mm^2$ or above. It has been customary to obviate a decrease in the film thickness of the drum 1 ascribable to mechanical wear by reducing the coefficient of friction of the drum 1, thereby enhancing the durability of the drum 1. However, the result of Experiment 3 indicates that by simply obviating mechanical wear, it is not always possible to obviate a decrease in the film thickness of the drum 1. Also, the above experimental result indicates that when zinc stearate is coated on the drum 1 as the protection layer 50, as distinguished from a lubricant, it is necessary to coat zinc stearate by more than a preselected amount. It may be said that, in an image forming apparatus using the same conditions as Experiment 3, about 0.0012 mg/mm$^2$ of zinc stearate suffices to protect the drum surface from the deterioration ascribable to proximity discharge.

As stated above, when the protection layer 32 is implemented as, but not limited to, zinc stearate, the amount of zinc stearate necessary for forming the protection layer 50 may be larger than when used as a lubricant. In an image forming apparatus using the same conditions as Experiment 3, the amount of zinc stearate capable of obviating the mechanical deterioration as the protection substance 32 is considered to be about 0.0012 mg/mm$^2$ or above. Of course, the above amount is not applicable when the kind of the drum 1, voltage applied to the charger 2 and so forth are different from those of Experiment 3. The crux is that an amount capable of protecting the drum surface from the chemical deterioration ascribable to proximity discharge be determined in accordance with the conditions of an apparatus to be actually used.

The protection substance 32 coated on the drum 1 is scraped off the drum 1 little by little due to volatilization ascribable to discharge and contact with a developing sleeve and an image transfer roller. Therefore, so long as the protection substance 32 is coated in an adequate amount, it can protect the drum surface from the deterioration without effecting image quality.

However, when the protection substance 32 is coated in an excessive amount, there easily occur an image flow, defective development ascribable to a decrease in the friction of coefficient and various image defects including blurring in a hot, humid environment. This is brought about when the amounts of scrape-off effected by the developing sleeve, image transfer roller and so forth and the amount of volatilization ascribable to discharge are short, compared to the amount of feed. In such a case, the protection substance 32 remains on the drum 1 over a long period of time and is repeated subject to the discharge of the charger 2 during image formation. Furthermore, the protection substance 32 newly fed from the coating device deposits on the protection substance 32 existing on the drum 1, so that the accumulation of the protection substance 32 is accelerated. Moreover, the protection substance 32, repeatedly conveyed below the charge roller 2*a* is not only deteriorated itself, but also provided with viscosity due to the deposition of ozone and NOx, aggravating the deposition of paper dust, additives of toner and brush fibers.

Under the above circumstances, the gap between the charge roller 2*a*, adjoining the drum 1, and the drum 1 varies and brings about abnormal discharge, thereby preventing the charge roller 2*a* from uniformly charging the drum 1. This is particularly true when the brush roller continuously feeds the protection substance 32, implemented as a bar, to the drum 1 because the amount of feed is apt to be excessive.

Figure 28:
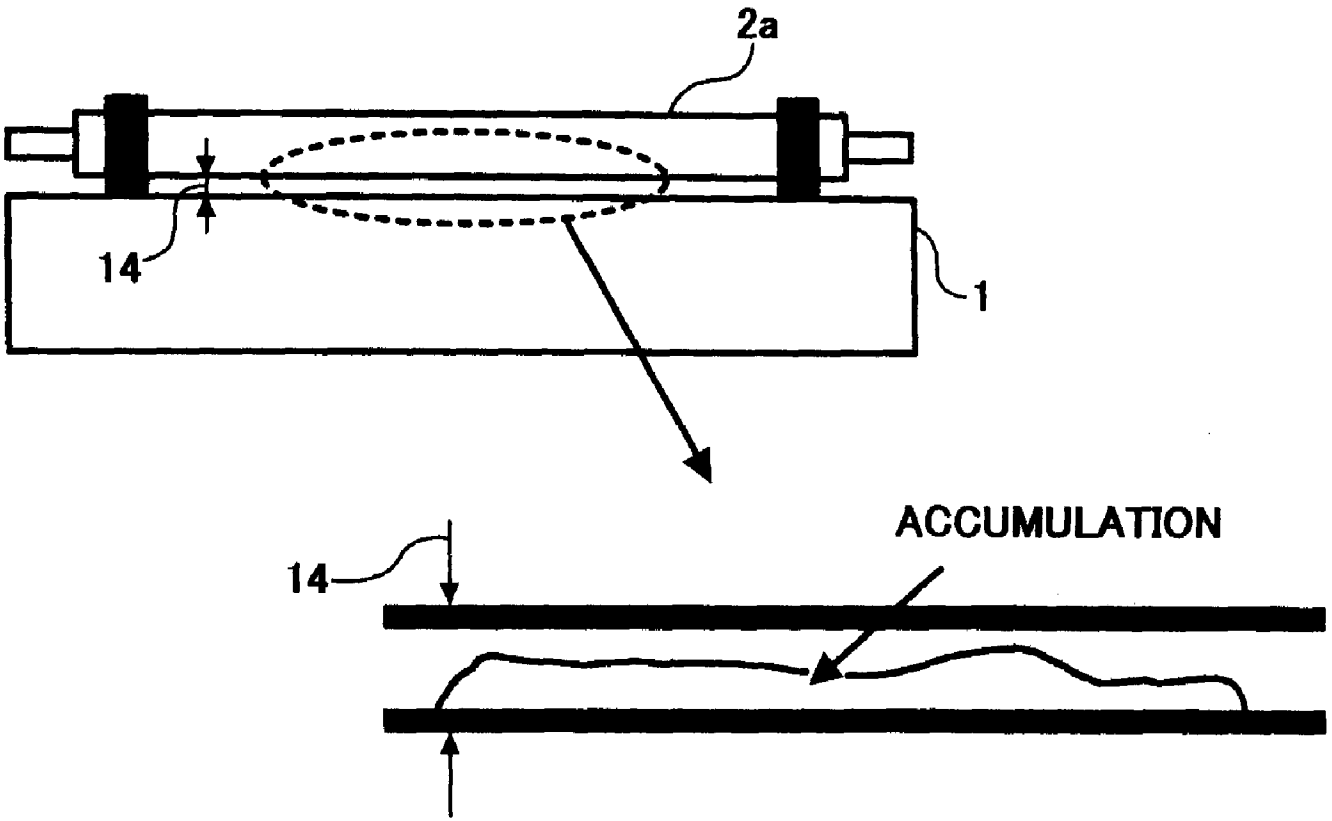
FIG. 28 shows a specific condition in which the protection substance accumulates in the gap.

As shown in FIG. 28, when the amount of protection substance 32 fed to the drum surface is excessive, the protection substance 32 newly fed to the drum surface and deteriorated protection substance accumulate on the drum 1, causing the size of the gap 14 to vary. This brings about abnormal discharge and thereby obstructs the uniform charging of the drum surface. To protect the drum 1 from the deterioration ascribable to discharge while obviating the excessive feed of the protection substance 32, the protection substance 32 should preferably be intermittently coated on the drum 1, as will be described hereinafter.

For the intermittent feed of the protection substance 32, only the drum 1 and coating device 30 are operated when image formation is not under way. More specifically, as shown in FIG. 9, the fur brush or similar coating means 31, contacting the protection substance 32, remains in a halt during image formation and therefore does not feed the protection substance 32. When image formation is not under way, only the drum 1 and fur brush 31 are rotated, so that the fur brush 31 scrapes off the protection substance 32 and coats it on the drum 1. The fur brush 31 may be replaced with an elastic roller, if desired. In this manner, when the charger 2 is operated to charge the drum 1 during image formation, the protection substance 32 coated on the drum 1 beforehand protects the drum 1 from the influence of proximity discharge, i.e., protects the photoconductive layer of the drum 1 from deterioration ascribable to discharge.

The protection substance 32 should only be fed for a preselected period of time every time a preselected number of copies are output, e.g., for 30 seconds every time 200 copies are output. Such intermittent coating obviates the variation of the gap 14 ascribable to excessive feed for thereby insuring uniform charging.

The protection substance 32 comes to exhibit viscosity when deteriorated by proximity discharge. It is therefore preferable to quickly remove the protection substance 32 from the drum 1 when so deteriorated. To make most of the effect available with the protection layer 50 and obviate other adverse influences, it is preferable to use a removing member for removing the deteriorated protection substance 32 from the drum surface. In the illustrative embodiment, too, the removing member is implemented as the cleaning device 7 configured to remove residual toner from the surface of the drum 1 moved away from the image transfer nip and capable of removing the deteriorated protection substance 32 at the same time. In addition, an exclusive cleaning device for the protection substance 32 may be located upstream of the image transfer nip.

Modifications of the illustrative embodiment will be described hereinafter.

Modification 1

Modification 1 executes the intermittent feed of the protection substance 32 during image formation. As for the rest of the configuration, Modification 1 is identical with the illustrative embodiment. In Modification 1, the coating means, contacting the drum 1, is intermittently operated. More specifically, as shown in FIG. 9, the protection substance implemented as a bar is held in contact with the fur brush or similar coating member 31 and fed to the drum 1 via the coating means. In this case, while the drum 1 is in rotation during image formation, the fur brush 31 is also rotated or held in a halt. The fur brush 31 in rotation scrapes off the protection substance and feeds it to the drum 1. The fur brush 31 may be rotated during image formation when a preselected number of copies are output or may be repeatedly rotated and stopped at preselected intervals during image formation. With this scheme, it is possible to coat a necessary amount of protection substance on the drum 1 to thereby protect the drum surface from the deterioration ascribable to proximity discharge. In addition, abnormal discharge ascribable to the variation of the gap 14 is obviated, so that the charge roller 2*a* can uniformly charge the drum 1.

Modification 2

Figure 29:
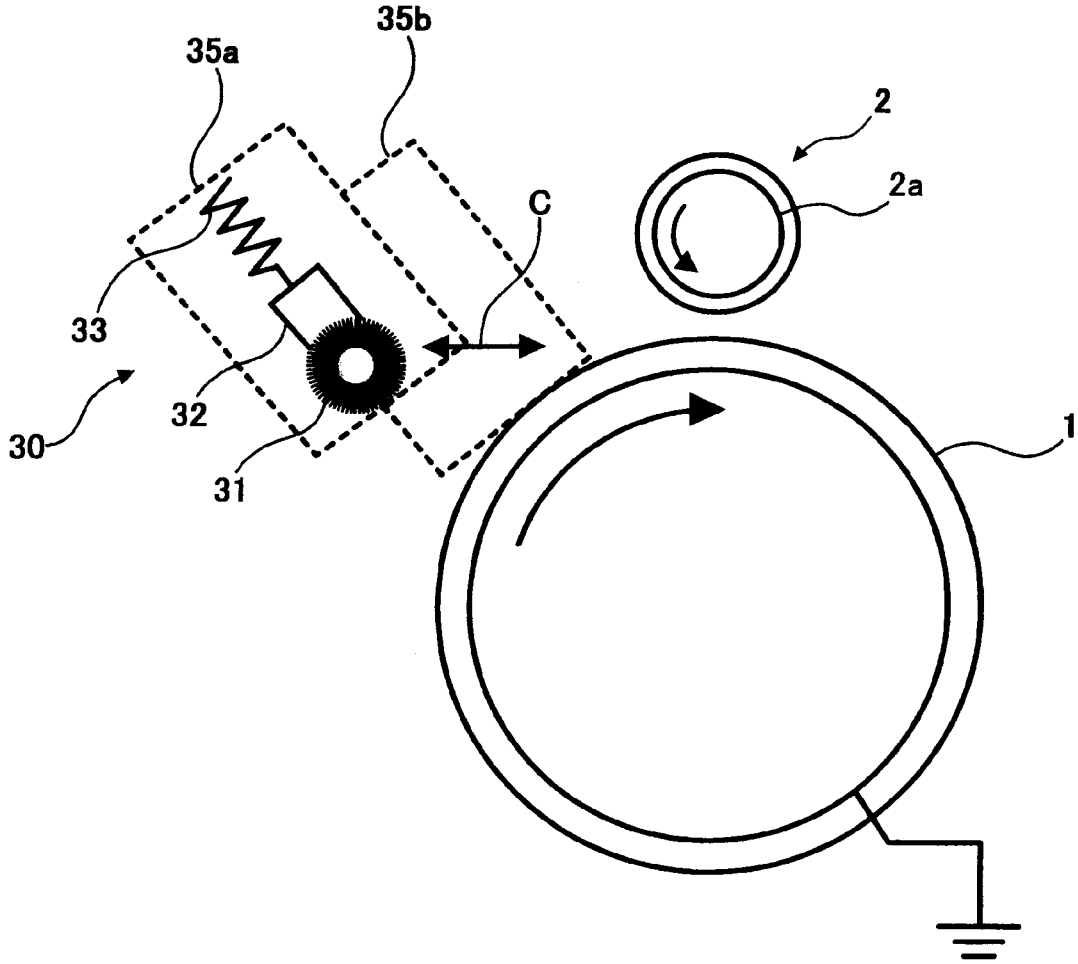
FIG. 29 shows Modification 2 of the third embodiment.

As shown in FIG. 29, Modification 2 is identical to Modification 1 except that the fur brush 31 is mounted on a moving device or moving means, not shown, for selectively moving the fur brush 31 into or out of contact with the drum 1. More specifically, the moving device selectively moves the fur brush 31 to a coating position 35*b* where it can coat the protective substance 32 or a retracted position 35*a* spaced from the drum 1, as indicated by a double-headed arrow C in FIG. 29. This is also successful to intermittently coat the protection substance 32 on the drum 1 for thereby protecting the surface of the drum 1 from deterioration ascribable to proximity discharge. Further, the charge roller 2*a* can uniformly charge the drum 1 because the gap 14 remains constant.

The fur brush 31 may be replaced with an elastic roller, if desired. Also, use may be made of a fur brush or an elastic roller containing the protection substance.

Modification 3

Figure 30:
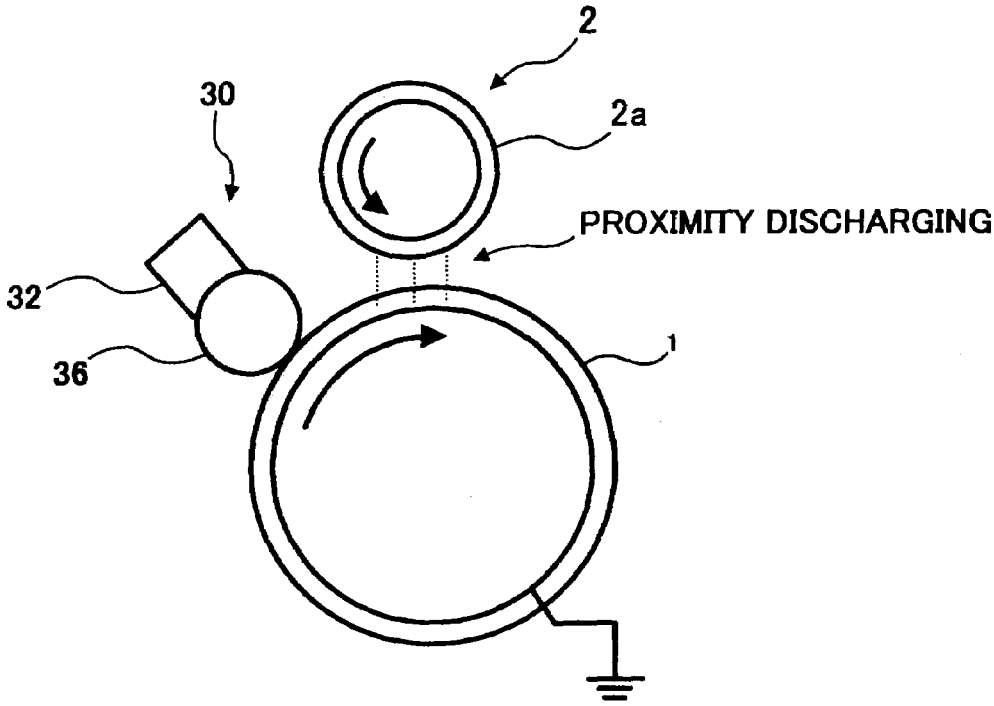
FIG. 30 shows Modification 3 of the third embodiment.

As shown in FIG. 30, an elastic coating roller 36 is substituted for the fur brush 31 as a coating member. The coating roller 36 is held in contact with the solid protection substance 32, also implemented as a bar, and drum 1. When the apparatus is driven, the coating roller 36 is also rotated and conveys the protection substance 32 to the position where the roller 36 contacts the drum 1. At this position, the protection substance 32 is nipped between the coating roller 36 and the drum 1 and deposited on the drum 1 thereby.

The coating roller 36 contacts the drum 1 over a broader range than the fur brush 31. This, coupled with the fact that the coating roller 36 is held in contact with the drum 1, desirably spreads the protection substance 32 and therefore obviates the need for an exclusive spreading member.

Modification 4

Figure 31:
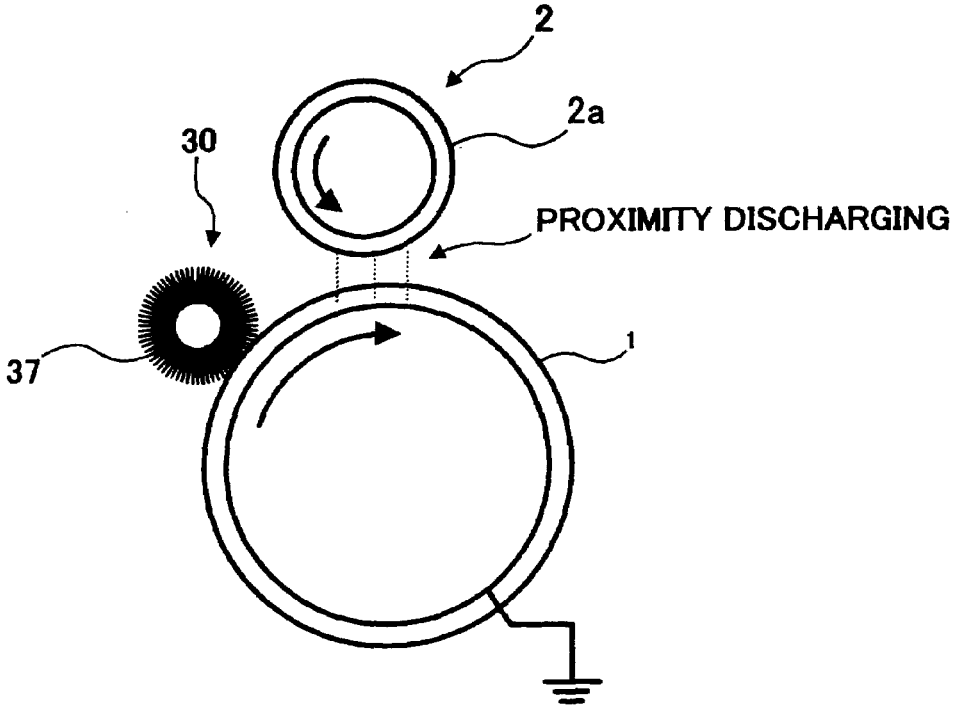
FIG. 31 shows Modification 4 of the third embodiment.

As shown in FIG. 31, Modification 4 uses a brush 37 different from the fur brush 31 in that the protection substance 32 is contained in the brush 37 beforehand. Therefore, the solid protection substance 32 shown in FIG. 9 and a space for accommodating it is not necessary, promoting space saving.

Figure 32A:
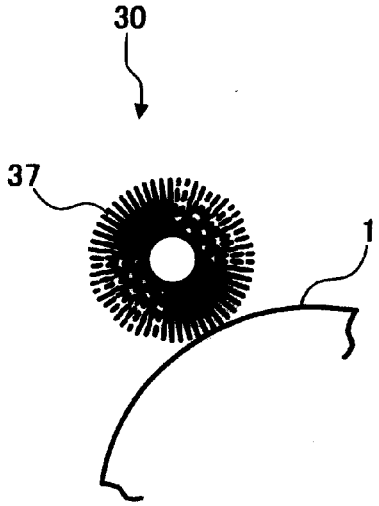
FIGS. 32A and 32B respectively show a brush roller and an elastic roller each containing the protection substance.

To implement intermittent coating, the amount of protection substance contained in the brush 37 is varied in a desired manner at any desired position. More specifically, as shown in FIG. 32A, brush fibers, containing the protection substance, are implanted in part of a brush roller, which is included in the brush 37. When the brush 37 with this configuration is rotated, the brush fibers with the protection substance intermittently contact the drum 1 and therefore intermittently coat the substance on the drum 1, thereby obviating the deterioration of the drum surface ascribable to proximity discharge. In addition, the charge roller 2*a* can uniformly charge the drum 1 because the gap 14 remains constant.

Modification 5

Figure 33:
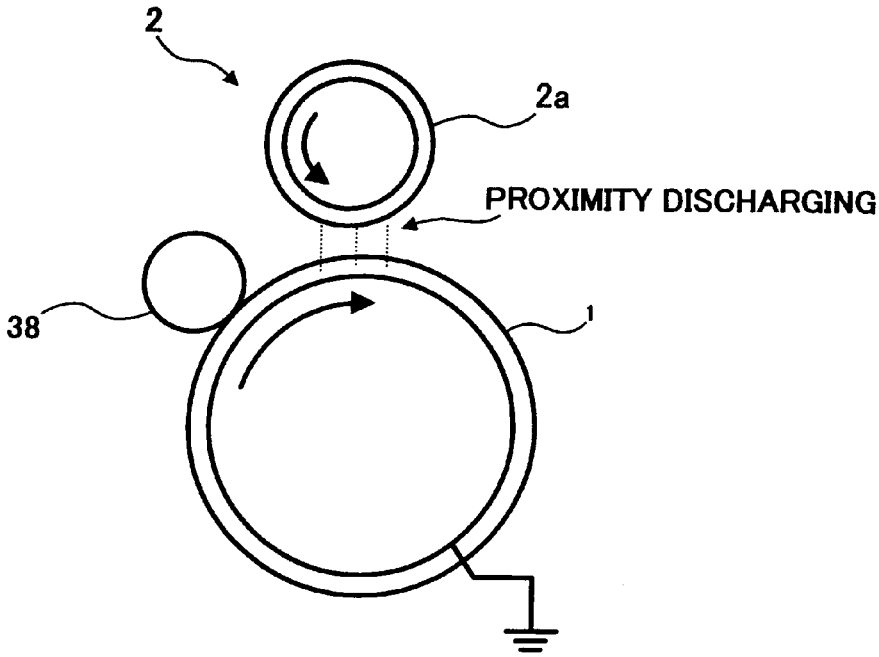
FIG. 33 shows Modification 5 of the third embodiment.

As shown in FIG. 33, Modification 5 uses a coating roller 38 containing the protection substance 32 beforehand. Therefore, the solid protection substance 32 shown in FIG. 9 and a space for accommodating it are not necessary, promoting space saving.

Figure 32B:
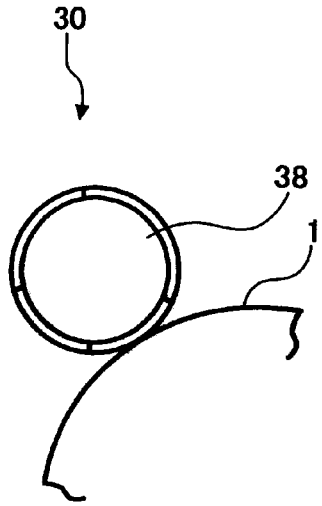

As shown in FIG. 32*b*, to implement intermittent coating, the roller 38 and drum 1 are held in contact with each other. The amount of protection substance contained in the roller 38 is varied in a desired manner at any desired position. This also successfully obviates the deterioration of the drum surface ascribable to proximity discharge. In addition, the charge roller 2*a* can uniformly charge the drum 1 because the gap 14 remains constant.

Modification 6

Figure 34A:
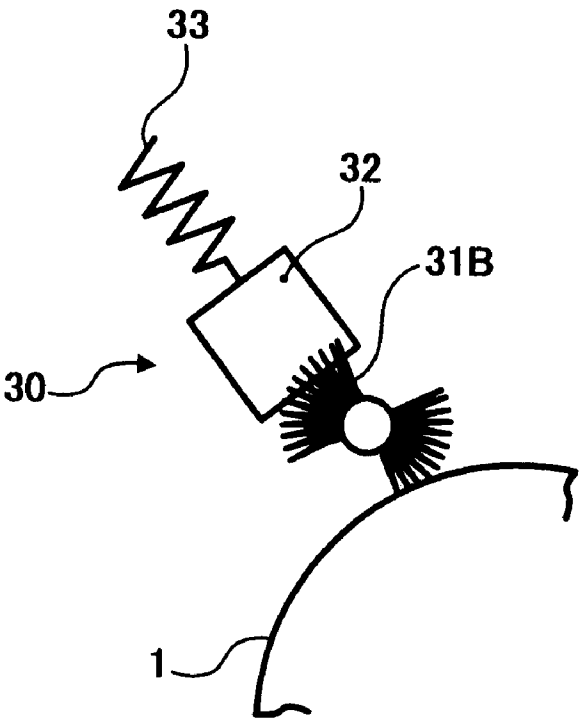
FIGS. 34A through 34C each show a specific configuration of the brush roller.
Figure 34B:
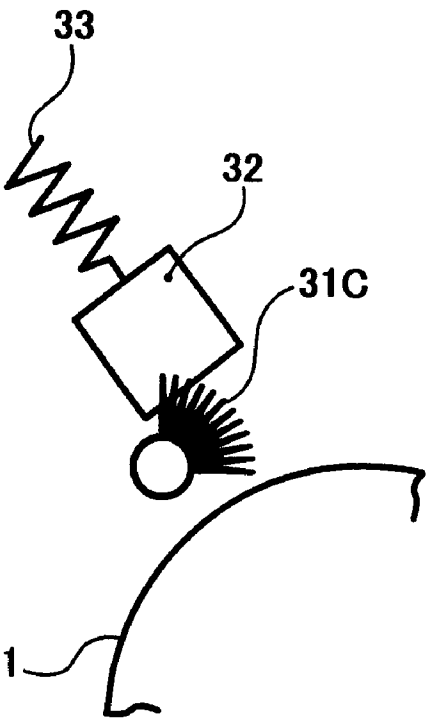
Figure 34C:
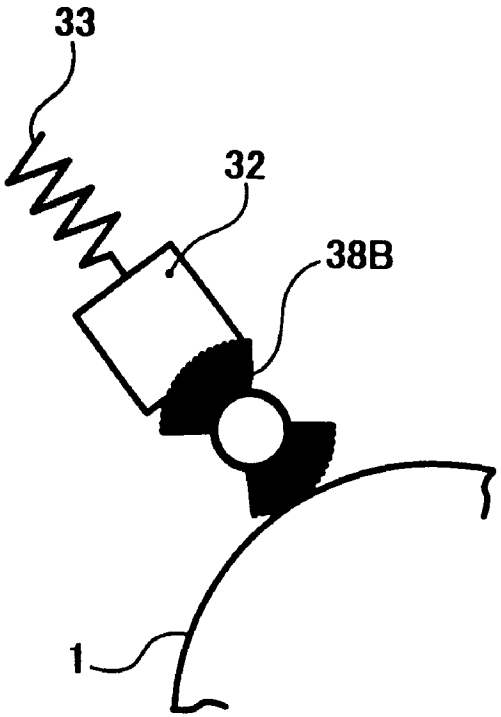

As shown in FIGS. 34A through 34C, coating means is caused to intermittently contact the bar-like protection substance 32 for thereby effecting intermittent feed of the protection substance 32.

More specifically, use is made of a rotatable brush in which the density of brush fibers differs from one portion to another portion. FIG. 34A shows a fur brush 31B in which one half of brush fibers are cut off as a specific form of such a rotatable brush. FIG. 34B shows a fur brush 31C in which three-fourths of brush fibers are cut off. In any case, the rotatable brush with the density of brush fibers locally varied intermittently contacts the protection substance 32 to thereby intermittently coat the substance 32 on the drum 1. FIG. 34C shows a partly removed elastic roller 38B that may be substituted for the brush.

Modification 7

This modification differs from the illustrative embodiment as to the cleaning system. While spherical toner grains are spreading today for enhancing image quality, a blade type of cleaning system cannot satisfactorily deal with spherical toner grains. Another problem is that such a type of cleaning system is not desirable from the durability standpoint because the cleaning blade and drum constantly contact each other.

Figure 35:
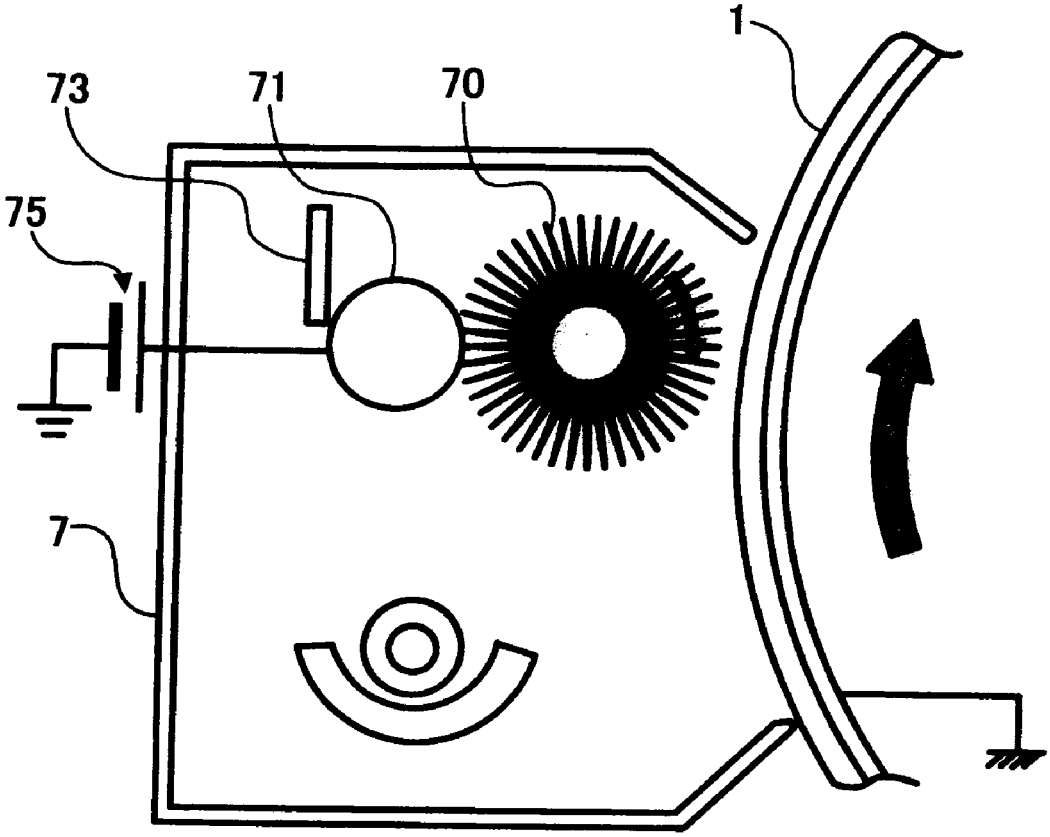
FIG. 35 shows cleaning means included in the third embodiment.

FIG. 35 shows a cleaning device 7 replacing the blade type of cleaning system and including a fur brush 70 provided with conductive fibers. A collection roller 71 is held in contact with the fur brush 70. A scraper member 73 is held in contact with the collection roller 71. When a voltage is applied from a power supply 75 to one or both of the fur brush 70 and collection roller 71, toner is collected from the drum 1 under the action of an electric field. This type of cleaning system can sufficiently collect spherical toner grains and therefore prevent undesirable toner grains from reaching the charge roller and making charging defective. In addition, the fur brush 70, which softly contacts the drum 1, reduces stress to act on the drum 1 for thereby enhancing the durability of the drum 1.

Fourth Embodiment

Figure 36:
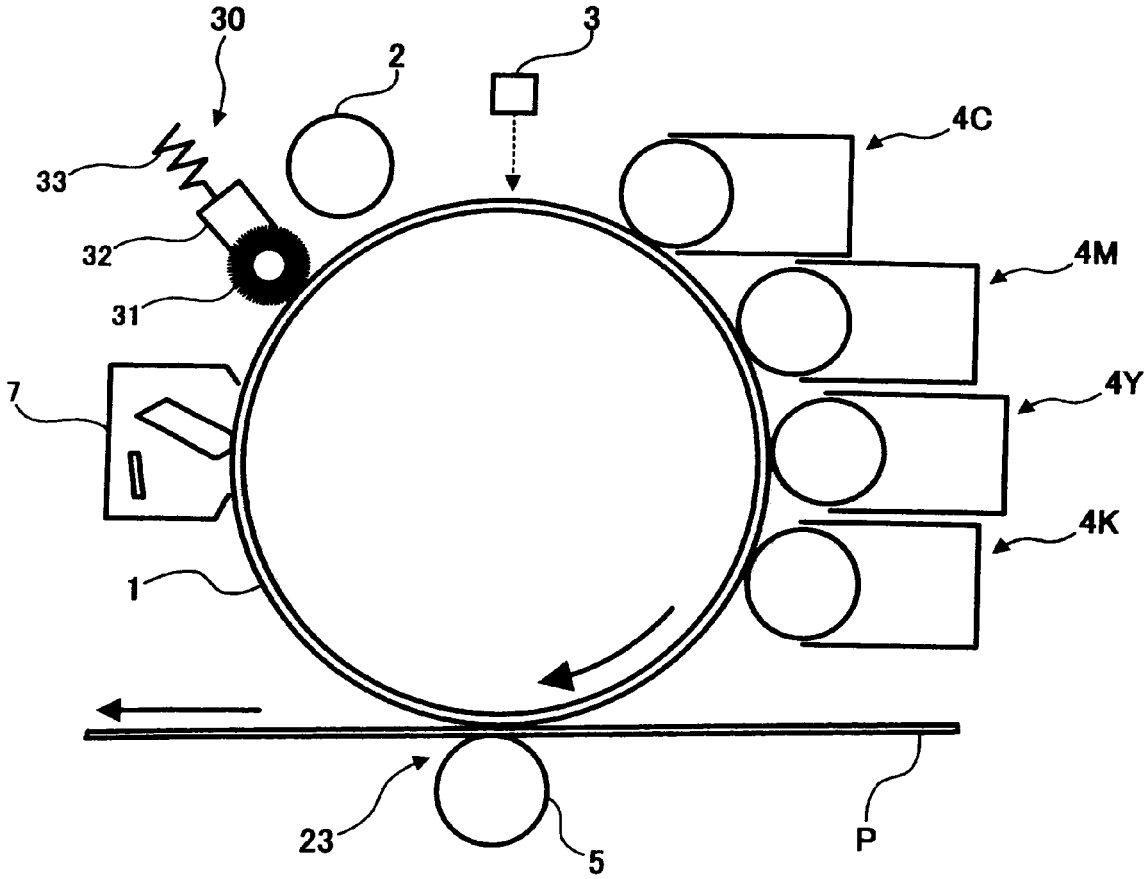
FIG. 36 shows an image forming apparatus representative of a fourth embodiment of the present invention.

FIG. 36 shows a fourth embodiment of the present invention and implemented as a full-color image forming apparatus. Because the fourth embodiment is similar to the third embodiment, the following description will concentrate on arrangements unique to the fourth embodiment.

As shown in FIG. 36, the illustrative embodiment includes four developing devices 4C (cyan), 4M (magenta), 4Y (yellow) and 4K (black) for respectively depositing a C, an M, a Y and a K toner on a single drum 1. The developing devices 4C through 4K are selectively operated to form a full-color toner image on the drum 1. The full-color toner image is transferred from the drum 1 to a sheet or recording medium P by an image transferring device 5 facing the drum 1.

The image forming apparatus of FIG. 36 also includes the coating device 30 like the third embodiment and therefore achieves the same advantages as the third embodiment. Any one of Modifications 1 through 7 of the second embodiment may be applied to the fourth embodiment.

Fifth Embodiment

Figure 37:
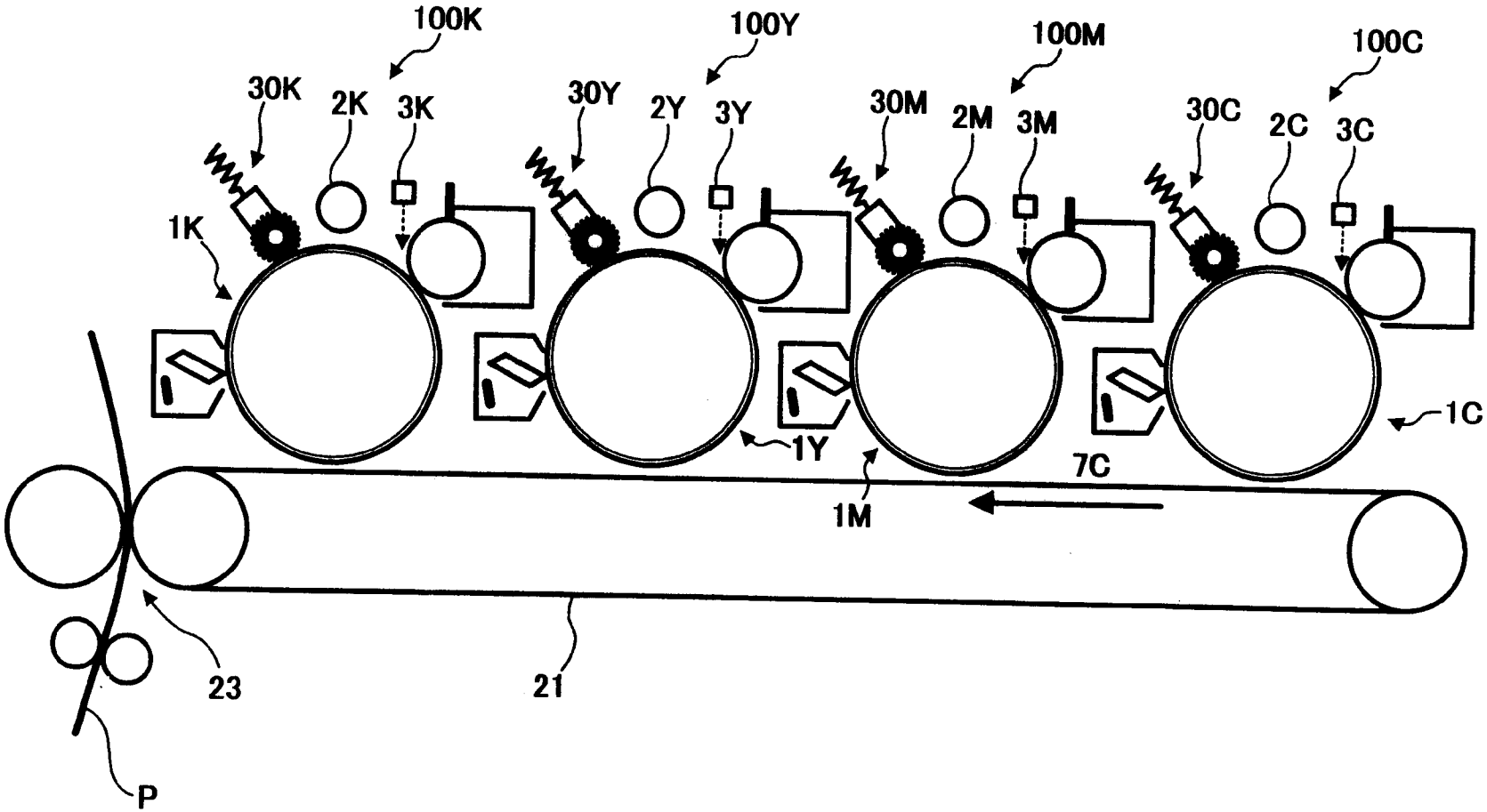
FIG. 37 shows an image forming apparatus representative of a fifth embodiment of the present invention.

FIG. 37 shows a fifth embodiment of the present invention implemented as a tandem full-color image forming apparatus. Because the fifth embodiment is also similar to the third embodiment, the following description will concentrate on arrangements unique to the fifth embodiment.

As shown in FIG. 37, the image forming apparatus includes four image forming stations 100C, 100M, 100Y and 100K each being identical with the image forming apparatus of FIG. 9 except that the fixing device 6 is absent. The image forming stations 100C, 100M, 100Y and 100K are arranged along an intermediate image transfer belt or body (simply belt hereinafter) 21 and include photoconductive elements 1C, 1M, 1Y and 1K, respectively. A C, an M, a Y and a K toner image are sequentially formed on the belt 21 one above the other by the image forming stations 100C through 100K, completing a full-color image (primary image transfer). The full-color toner image is then transferred from the belt 21 to the sheet P at an image transfer position 23 (secondary image transfer).

The configuration of either one of the third and fourth embodiments is applicable to the illustrative embodiment also. Particularly, when a plurality of drums 1C through 1K are arranged in parallel as in the illustrative embodiment, the frequency of replacement required of the drums 1C through 1K increases with the number of drums. In this respect, by enhancing the durability of the individual drums 1C through 1K, it is possible to extend the interval of replacement for thereby reducing the frequency of replacement.

Further, in the illustrative embodiment, the toner images formed by the drums 1C through 1K are temporarily carried on the belt 21. Therefore, zinc stearate, serving as the protection substance 32 is partly transferred from the drums 1C through 1K to the belt 21. This part of zinc stearate deposited on the belt 21 plays the role of a parting agent in the event of the secondary transfer, thereby improving image transfer ratio to the sheet P.

Sixth Embodiment

Figure 38:
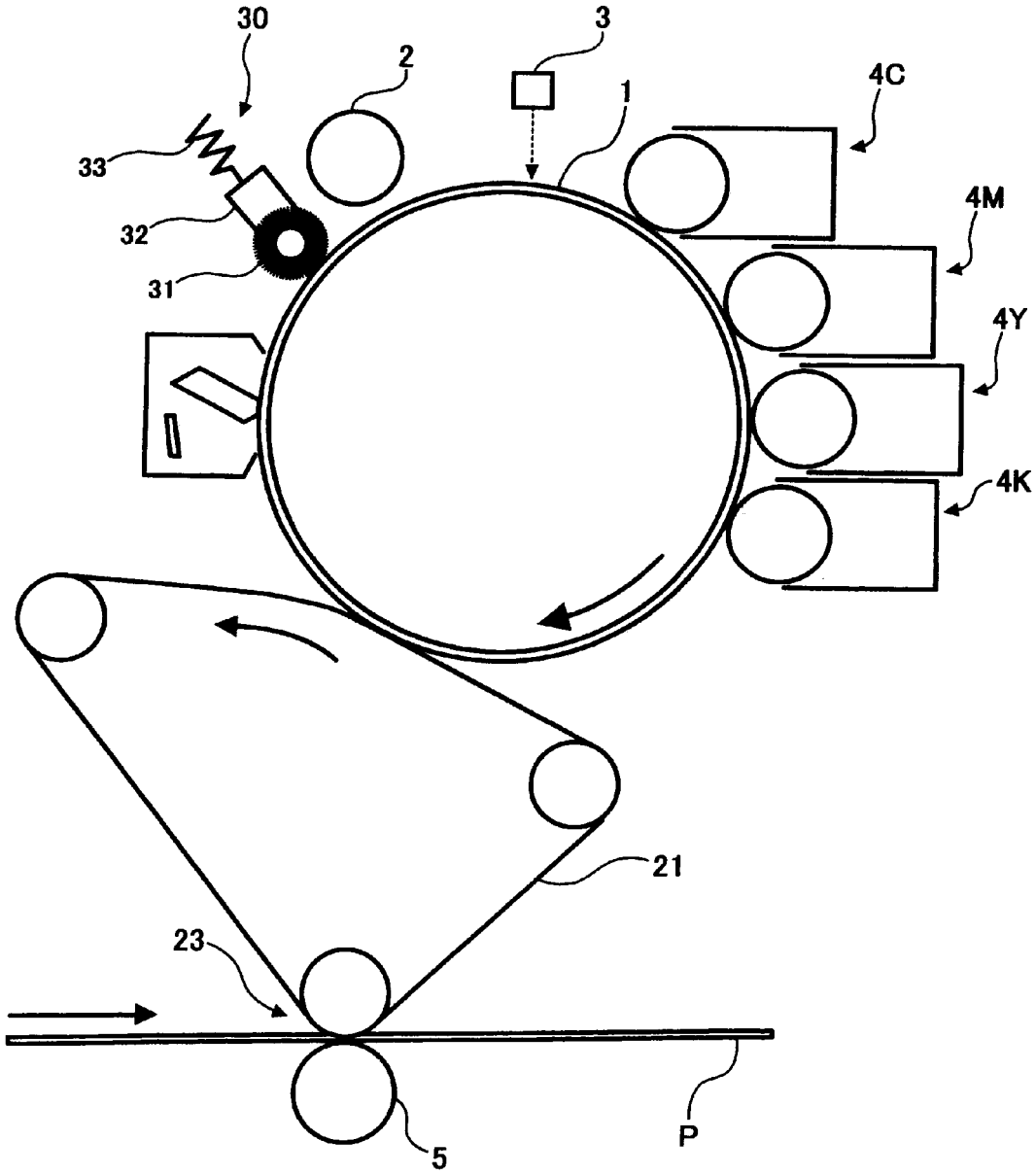
FIG. 38 shows an image forming apparatus representative of a sixth embodiment of the present invention.

FIG. 38 shows a sixth embodiment of the present invention implemented as a full-color image forming apparatus. Because the sixth embodiment is similar to the third embodiment, the following description will concentrate on arrangements unique to the sixth embodiment.

As shown in FIG. 38, the image forming apparatus is identical with the image forming apparatus of the fourth embodiment except that the belt 21 intervenes between the drum 1 and the image transfer position 23. Four developing devices 4C, 4M, 4Y and 4K for respectively depositing a C, an M, a Y and a K toner on a single drum 1. More specifically, the developing devices 4C through 4K sequentially form a C, an M, a Y and a K toner image on the drum 1 one after another. Subsequently, the C, M, Y and K toner images are sequentially transferred from the drum 1 to the belt 21 one above the other, forming a full-color image (primary image transfer). The full-color toner image is then transferred from the belt 21 to the sheet P (secondary image transfer).

Any one of the configurations of the third to fifth embodiments is also applicable to the illustrative embodiment. Further, in the illustrative embodiment, the toner images formed by the drums 1C through 1K are temporarily carried on the belt 21 as in the fifth embodiment. Therefore, zinc stearate, serving as the protection substance 32 is partly transferred from the drums 1C through 1K to the belt 21. This part of zinc stearate deposited on the belt 21 plays the role of a parting agent in the event of the secondary transfer, thereby improving image transfer ratio to the sheet P, as stated earlier.

Seventh Embodiment

Figure 39:
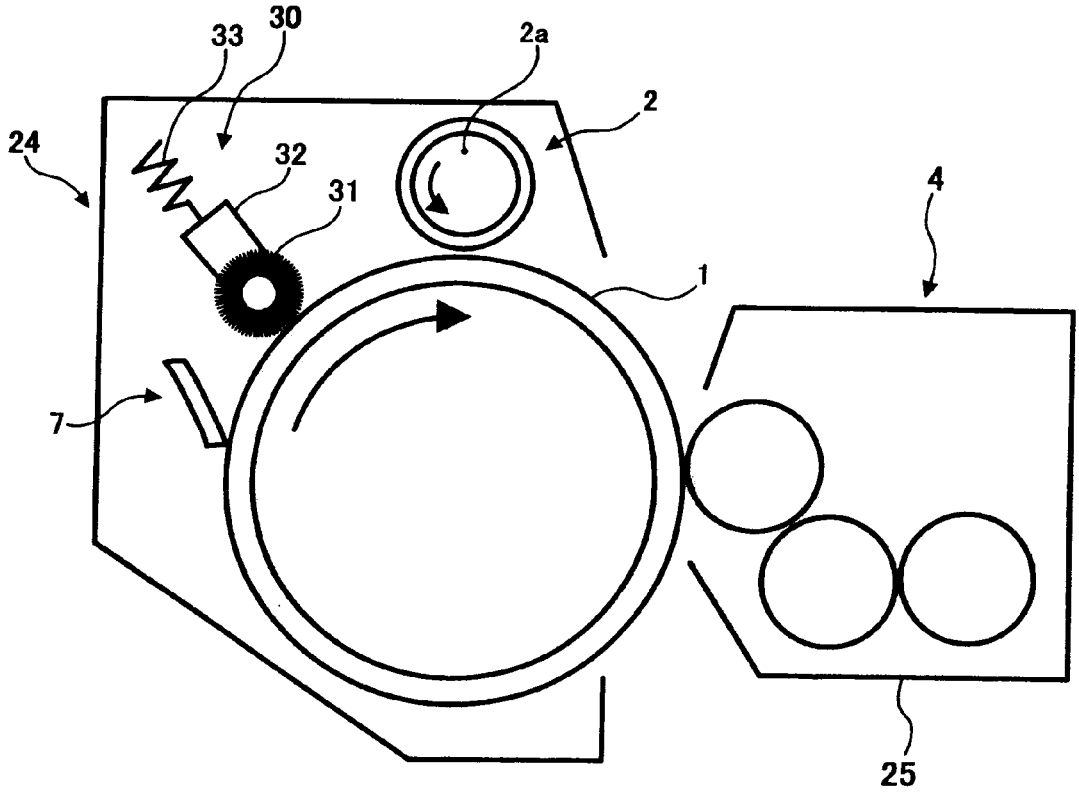
FIG. 39 shows an image forming apparatus representative of a seventh embodiment of the present invention.

FIG. 39 shows a seventh embodiment of the image forming apparatus in accordance with the present invention. As shown, the image forming apparatus includes two process cartridges 24 and 25 each being removably mounted to the apparatus body not shown. The process cartridge 24 includes the drum 1 and charge roller 2*a* while the process cartridge 25 includes the developing device 4. The process cartridge 24, for example, can be bodily removed from the apparatus body and bodily replaced when the drum 1 must be replaced.

In each of the third to seventh embodiments shown and described, the charger uses a proximity discharge type of charging system while various unique arrangements are used to obviate the deterioration of the drum ascribable to proximity discharge.

If a corona discharge type of charging system is applied to the charger, there can be reduced the chemical deterioration of the drum ascribable to particles generated by discharge and hitting against the drum more than the proximity type of charging system. However, corona discharge is not desirable because it generates ozone, NOx and other toxic products. More specifically, if ozone accumulates in the apparatus with high concentration, it oxidizes the surface of the drum to thereby lower the sensitivity of the drum and the charging ability of the charger, adversely effecting image formation. Further, ozone is apt to accelerate the deterioration of the other members as well and reduce their lives.

NOx react with moisture present in, e.g., air to thereby produce nitric acid or react with surrounding metal to thereby produce metal nitrate while producing other various nitric compounds as well. The resistance of nitric compounds, which are highly moisture-absorptive, is high in a low humidity environment, but decreases in a high humidity environment due to moisture absorption. If such nitric compounds deposit on the surface of the drum in the form of a thin film, they absorb moisture and lower the resistance of the drum surface. Consequently, when the above film extends over both the image portion and non-image portion of the drum surface, charge generated by exposure flows beyond the exposure range to thereby render an image defective.

Eighth Embodiment

The description made with reference to FIGS. 3A, 3B, 4, 9, 10, 19 through 21, 29 through 31, 33 and 35 through 39 apply to an eight embodiment to be described hereinafter as well. Let the following description concentrate on arrangements unique to the eighth embodiment.

Figure 40:
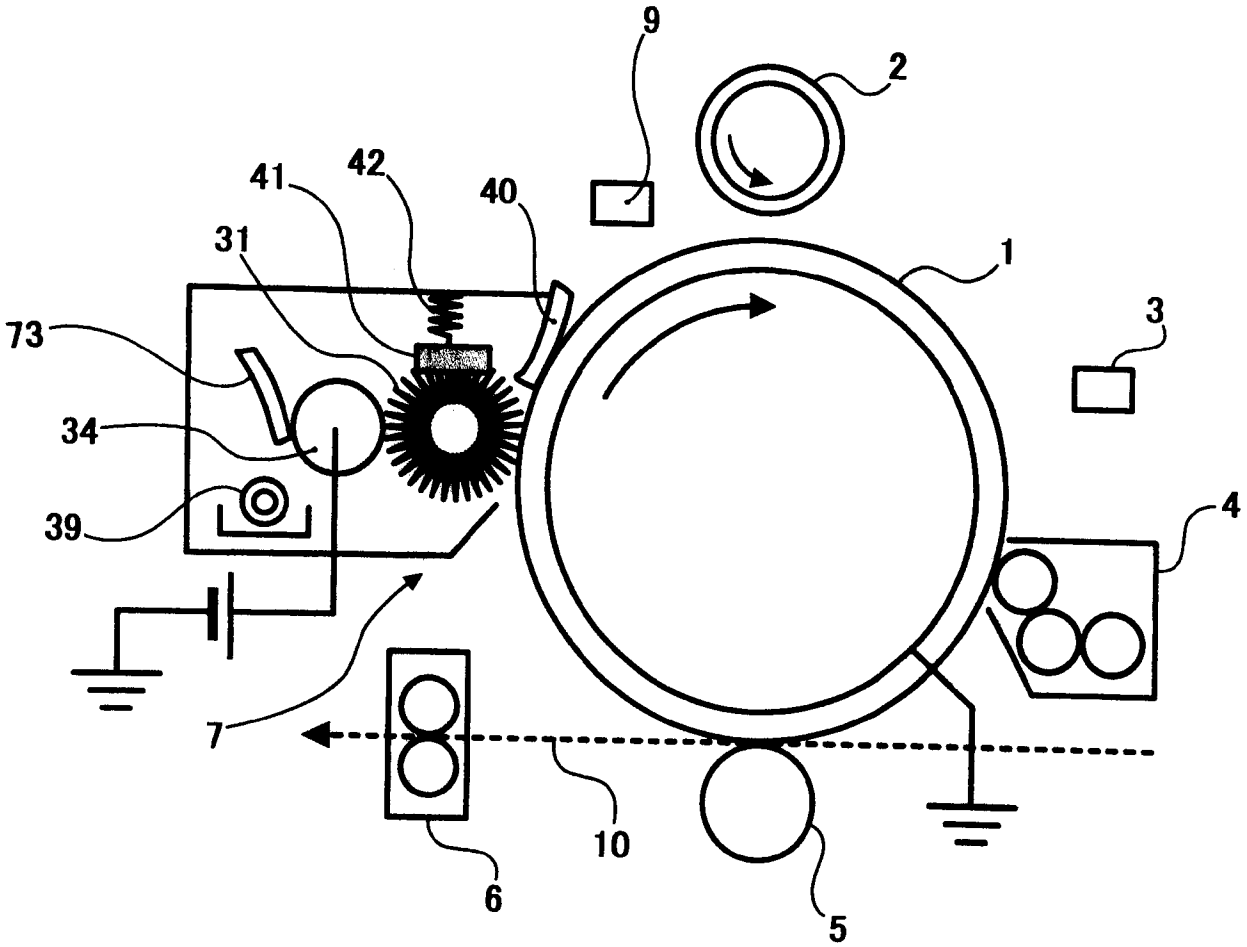
FIG. 40 shows an image forming apparatus representative of an eighth embodiment of the present invention.

As shown in FIG. 40, the eighth embodiment includes the drum or image carrier 1 caused to rotate in a direction indicated by an arrow. The charger 2 uniformly charges the surface of the drum 1 to preselected polarity. The exposing unit 3 scans the charged surface of the drum 1 in accordance with image data to thereby form a latent image. The developing device 4 develops the latent image with toner for thereby producing a corresponding toner image.

A sheet is fed from a sheet feeding device, not shown, to the drum 1. The image transferring device 5 transfers the toner image from the drum 1 to the sheet. The sheet, carrying the toner image thereon, is peeled off the drum 1 and then conveyed to the fixing device 6 along the path 10, so that the toner image is fixed on the sheet. Residual toner, remaining on the drum 1 after the image transfer, is removed from the drum 1 by the fur brush 31 under the action of an electric field. The toner thus removed by the fur brush 31 is transferred to the collection roller 34, scraped off the roller 34 by the scraper 73, and then collected by a coil 39. Subsequently, the surface of the drum 1 is discharged by the quenching device 9. The coating device, included in the cleaning device 7, coats the protection substance on the drum 1 in order to reduce the influence of discharge effected by the charger 2.

The drum 1 includes an organic photoconductor layer and a coating layer as in the third embodiment. The coating layer includes the inorganic grains and binder resin as in the third embodiment.

Figure 41:
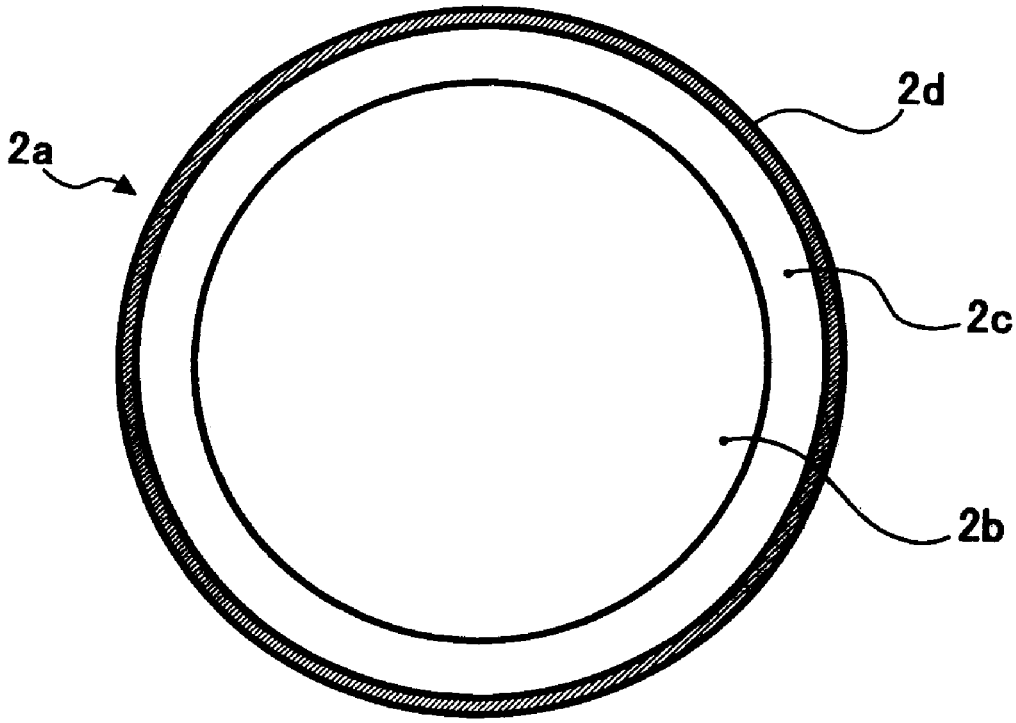
FIG. 41 is a section of a charge roller included in the eighth embodiment.

FIG. 41 shows the charge roller 2*a* of the illustrative embodiment in a section. As shown, the charge roller 2*a* is made up of a conductive core 2*b*, implemented as a hollow cylinder, and a medium-resistance layer 2*c* affixed to the outer periphery of the core 2*b* and also implemented as a hollow cylinder. Further, a surface layer 2*d* is affixed to the outer periphery of the medium-resistance layer 2*c*. The core 2*b* has a diameter of about 4 mm to 20 mm and is formed of stainless steel, aluminum or similar rigid metal or rigid conductive resin whose volume resistivity is $1\times10^3$ Ω·cm or below, preferably $1\times10^2$ Ω·cm or below.

The medium-resistance layer 2*c* has a thickness of about 1 mm 2 mm and volume resistivity of $10^4$ Ω·cm to $10^9$ Ω·cm. The-medium resistance layer 2*c* is composed of a base material and a conductive agent dispersed therein. General-purpose resins with good workability can be used, such as, olefinic resin like polyethylene (PE) or polypropylene (PP), styrene-based resin like polystyrene (PS) and its derivatives (AS, ABS), or acryl resin like polymethyl methacrylate (PMMA). For the conductive agent, an alkaline metal salt such as lithium peroxide, a perchlorate such as sodium perchlorate, a quartemary ammonium salt such as tetrabutyl ammonium salt, an ionic conductive agent such as a polymer type conductive agent, carbon black such as Ketchen black or acetylene black, can be used.

The surface layer 2*d* has thickness of about 10 μm and volume resistivity of $10^6$ Ω·cm to $10^{11}$ Ω·cm. The surface layer 2*d* is composed of, like the medium-resistance layer 2*c*, a base material and a conductive agent dispersed therein. For the base material of the surface 2*d*, fluorinated resin, silicone resin, acryl resin, polyamide resin, polyester resin, polyvinylbutyral resin, or polyurethane resin can be suitably used. In particular, a material on which the toner hardly sticks is preferably selected. As the surface layer 2*d* of the conductivity material, carbon black such as Ketjen black or acetylene black, an electron conductive agent composed of indium oxide or tin oxide, or other proper conductive agents, can be used. The material of the above-mentioned charged roller 2*a* is one of examples, and not limited to it.

Tape-like spacers 22 are mounted on the above-mentioned charged roller 2*a* at opposite axial ends. By mounting the spacers on the charged roller 2*a*, the fine gap 14 can be formed between the charged roller 2*a* and the drum 1. The tape material includes metals and their oxides such as aluminum, iron, or nickel, metallic alloys such as Fe—Ni alloy, stainless steel, Co—Al alloy, Ni steel, duralumin, monel, or inconel, olefinic resin such as polyethylene (PE), or polypropylene (PP), polyester resin such as polyethylene terephthalate (PET) or polybutylene terephthalate (PBT), fluorinated resin such as polytetrafluoroethylene resin (PTFE) and its copolymer, e.g., PFA or PEF, or polyimide resin. In particular, a material with high releasing property allowing little sticking of toner is preferably used. When a conductive material is used as a tape, the tape is insulated from the image carrier by coating the insulating layer or semi-resistor layer on its surface. Tapes used as the spacers 20 in the illustrative embodiment are only illustrative. Alternatively, the small gap may be formed from by rollers.

In the illustrative embodiment, the charge roller 2*a* is provided with higher hardness than a conventional charge roller. More specifically, the charge roller 2*a* sometimes expands due to moisture absorption, as indicated by the circle B in FIG. 19. Particularly, when the spacers 22 are not formed of a non-flexible material, the portions of the charge roller 2*a* where the spacers 22 are mounted cannot expand. As a result, the portion of the charge roller 2*a* around the spacer expands more than the other portion to such a degree that it contacts the drum 1, as indicated by the circle B in FIG. 19. While expansion around the spacer 22 may be improved if an air stream is caused to concentrate on the intermediate portion of the charge roller 2*a* by air stream design, such an air stream causes the intermediate portion to expand more than the other portions due to moisture absorption and contact the drum 1. However, by increasing the hardness of the charge roller 2*a*, it is possible to reduce moisture absorption and therefore expansion of the charge roller 2*a* for thereby maintaining the gap 14 accurate. This is proved by the following experimental results.

In offices in general, the upper limit of environment that aggravates moisture absorption most is considered to be about 30° C. and 80% RH when the working environment is taken into account, as stated earlier. Likewise, the lower limit of humidity in offices is considered to be 20% RH for about 30° C. The variation of the gap determined with a rubber roller having hardness of about 70° to 80° and a hard resin roller having hardness of higher than 80°, preferably 90° or above, has already been stated with reference to FIG. 20.

As FIG. 20 indicates, as for a rubber roller, the gap 14 is 40 μm when humidity is as low as 20%, but decreases to 10 μm when it is as high as 80% due to moisture absorption. By contrast, a roller formed of hard resin maintains the gap 14 50 μm even when humidity is as high as 80%. It follows that a hard roller can reduce the variation of the gap 14 ascribable to the varying environment for thereby insuring uniform charging.

Discharge effected between the drum 1 and the charge roller 2*a* generates various hazard substances including ozone, NOx, ammonia gas and ammonium nitrate, as stated earlier. If such hazard substances deposit on the surface of the drum 1, then the electric resistance of the drum 1 drops at portions where they deposited. This causes the charge of a latent image to flow toward low-resistance portions to thereby bring about various image defects including the blur of the latent image or the resulting toner image and an image flow stated earlier. In light of this, by intentionally varying the gap 14, we found a particular value that minimized image defect, as will be described hereinafter.

An experiment was conducted to determine a relation between the gap 14 and the frequency of a defective image in the same manner as Experiment 2 of the third embodiment. More specifically, copies were continuously output with the gap 14 being varied to 0 μm, 30 μm, 50 μm and 80 μm and estimated as to image quality. More specifically, 50,000 copies (A4 landscape) were continuously output so as to determine the frequency of defective images. As shown in FIG. 21, the frequency of defective images increases with an increase in gap 14. The above frequency is lowest when the gap 14 is 30 μm, but increases when the gap 14 is 0 μm. In this manner, the frequency of defective images is greatly dependent on the gap 14 and is minimum when the gap 14 has a particular value.

As shown in FIG. 40, in the cleaning device 7 of the illustrative embodiment, at least the conductive fur brush 31 subject to an electric field plays the role of toner removing means and may be combined with a conventional cleaning blade 40, if necessary. The cleaning blade 40 uniformly spreads the protection substance coated on the drum 1 by the fur brush 31, thereby regulating the thickness of the protection layer on the drum 1. In addition, the cleaning blade 40 can remove impurities deposited on the protection layer. Consequently, the protection substance can cover the entire surface of the drum 1 while the protection layer with such regulated thickness can obviate defective charging and defective images.

The toner removed from the drum 1 by the conductive fur brush 31 is electrostatically collected by the collection roller 34 and then scraped off the collection roller 34 by the scraper 73, which is held in contact with the collection roller 34. As shown in FIG. 40, a voltage is applied to the fur brush via the collection roller 34 to which a voltage is applied from a cleaner power supply. The collection roller 34 is usually formed of SUS or similar metal and should preferably be coated with fluorine-based resin or dispersion thereof or plated by eutectoid-plating of resin and metal in order to reduce the static coefficient of friction of the drum surface. The scraper 73 may be formed of, but not limited to, urethane rubber. Further, when spherical toner is used, the collection roller 34 may be formed of an elastic material, in which case the scraper 73 implemented as a metal blade will be caused to bite into the roller 34 by a preselected amount in order to insure collection.

For efficient collection, the tangential velocity Vf of the fur brush 31 at the outside diameter position and the tangential velocity Vk of the collection roller 34 at the outside diameter position should preferably be related as $Vk/Vf \geqq 0.8$. By so causing the collection roller 34 to collect toner from the fur brush 31, it is possible for the fur brush 31 to remove toner from the drum 1 with its fresh portion where toner is absent at all times. This prevents toner deposited on the fur brush 31 from being transferred to the drum 1 and obviates the wear of the drum 1 ascribable to toner constituting abrasive grains between the brush 31 and the drum 1.

The abnormal wear of a drum dependent on an image pattern and toner additives is another problem with the conventional blade type cleaning. The illustrative embodiment is free from this problem because the conductive fur brush 31 collects toner.

Conductive fibers implanted in the fur brush 31 are formed of, but not limited to, polyester, nylon, acryl or similar material with carbon or similar conductive material added thereto.

In the illustrative embodiment, a voltage is applied to the fur brush 31 via the collection roller 34. The atom specific resistance of the fur brush 31 should preferably be between $10^6$ Ω·cm and $10^9$ Ω·cm while the voltage should preferably be between 100 V and 300 V. If the voltage is, e.g., 500 V, it is likely that the polarity of toner on the fur brush 31 is inverted with the result that the toner again deposits on the drum 1 without being collected by the collection roller 34. Further, discharge is apt to occur between the fur brush 31 and the drum 1 in some atmospheric conditions and deteriorate the drum 1 while reversing the polarity of the toner. It is therefore preferable that the voltage be lower than the discharge start voltage in order to enhance at least the durability of the drum 1.

The cleaning device 7 includes means for coating the protection substance in order to protect the drum 1 from proximity discharge for thereby obviating a decrease in film thickness and therefore the separating and parting of inorganic fine grains. The coating means is made up of a protection substance 41 implemented as a bar-like molding, the conductive fur brush for shaving off the protection substance and coating on the drum 1, and a spring 42 supporting the protection substance 41.

The protection substance 41 comprises zinc stearate, silicone or wax by way of example. An experiment showing that the protection substance coated on the drum 1 protects the drum 1 from deterioration ascribable to proximity discharge has been previously described with reference to FIGS. 3A and 3B.

How the protection substance 41 is coated on the drum 1 will be described hereinafter. The fur brush or coating member 31 should preferably be held in contact with the protection substance 41 and feed it to the drum 1 either continuously or intermittently. Particularly, in the illustrative embodiment, the fur brush plays the role of toner removing means and coating means at the same time, i.e., removes toner from the drum 1 while coating the protection substance 41 on the drum 1 by scraping it off. The spring 42 allows the protection substance 41 to be stably fed to the fur brush 31 over a long period of time.

The fur brush 31 is rotated in the same direction as the drum 1, i.e., clockwise, so that the fur brush 31 moves in the opposite direction to the surface of the drum 1 at the position where the former faces the latter. In this condition, the protection substance 41 can be coated on the surface of the drum 1 from which toner has been removed. Further, the numerous tips of the fur brush 31 sequentially contact the surface of the drum 1 when the surface is passing through the contact zone, insuring the collection of toner from the drum 1 and the coating of the protection substance 41 on the drum 1.

Small-size or spherical toner is desirable from the image quality standpoint. Spherical toner with mean circularity of 0.96 or above, but below 1.00, is feasible for electrostatic control, e.g., promotes efficient image transfer and enhances electrostatic brush cleaning more efficiently than other toners. Therefore, when spherical toner is used, the illustrative embodiment does not need the cleaning blade 40 and therefore protects the drum 1 from wear ascribable to contact with the cleaning blade 40.

Mean circularity of toner should preferably be measured by passing a suspension liquid containing toner grains through the sensing band of an image pickup section, optically sensing the image of the grains with a CCD (Charge Coupled Device) camera and analyzing the image in the optical sensing band. In this case, mean circularity refers to a value produced by dividing the circumferential length of a corresponding circle having the same projection area by the circumferential length of the actual toner grain. In the illustrative embodiment, mean circularity was measured by a flow type particle image analyzer FPIA-2100 (trade name).

More specifically, 0.1 ml to 0.5 ml of surfactant, preferably alkylbenzene sulphonate, is added as a dispersant to 100 ml to 150 ml of water from which solid impurities have been removed beforehand, and then 0.1 g to 0.5 g of sample is added. The resulting suspension liquid with the sample dispersed therein is dispersed for about 1 minute to 3 minutes in an ultrasonic dispersing device, so that the dispersion density is controller to 3,000/μl to 10,000/μl. Finally FPIA-21 mentioned earlier is used to measure the shape and distribution of toner grains for thereby determining mean circularity.

Ninth Embodiment

Figure 42:
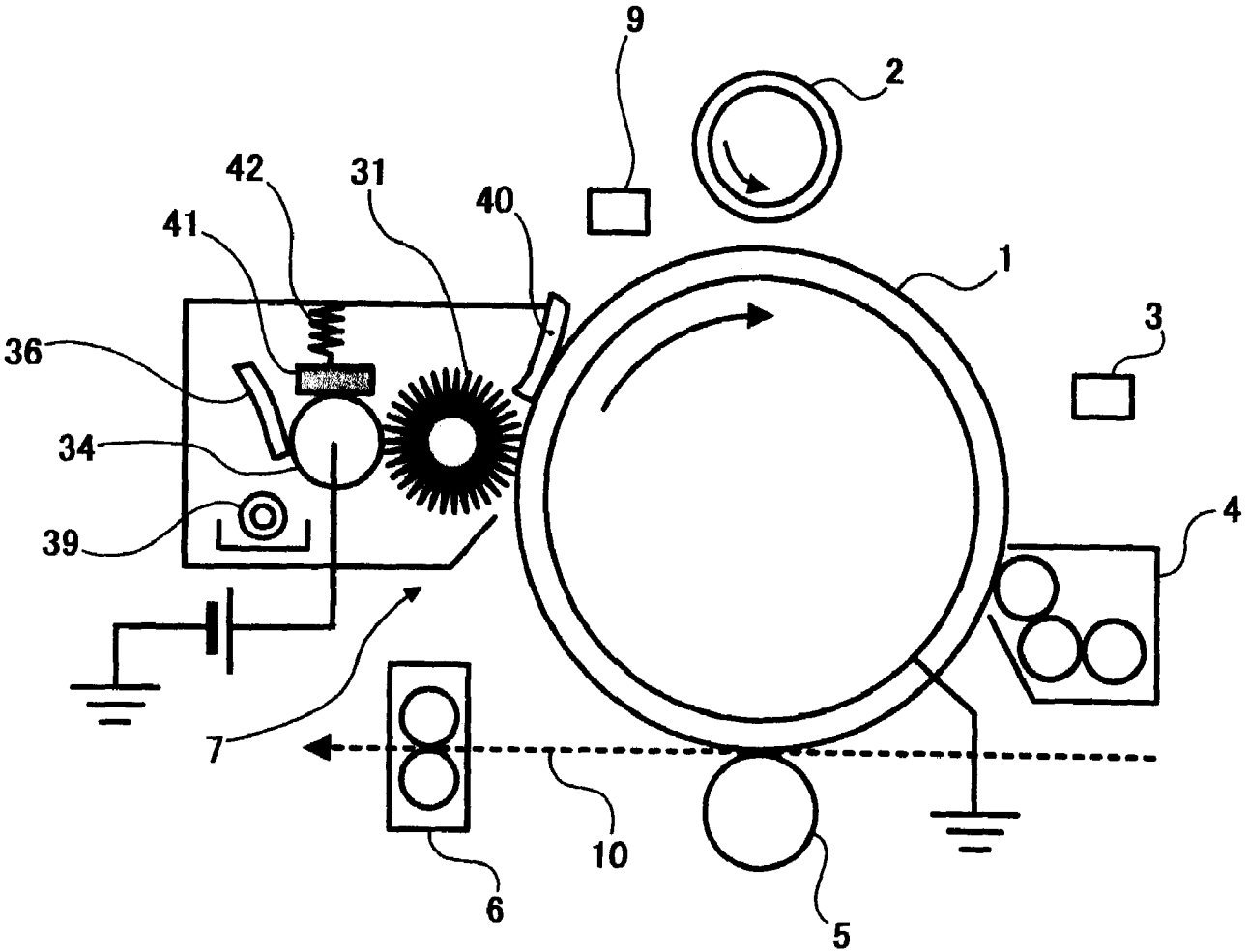
FIG. 42 shows an image forming apparatus representative of a ninth embodiment of the present invention.

FIG. 42 shows a ninth embodiment of the present invention different from the eighth embodiment as t the configuration of the coating means. As shown, in the illustrative embodiment, the protection substance 41 implemented as a bar is held in contact with the collection roller 34. In this configuration, the protection substance 41 is coated on the drum 1 by way of the collection roller 34 and conductive fur brush 31. This is also successful to achieve the same advantages as the eighth embodiment.

Tenth Embodiment

Figure 43:
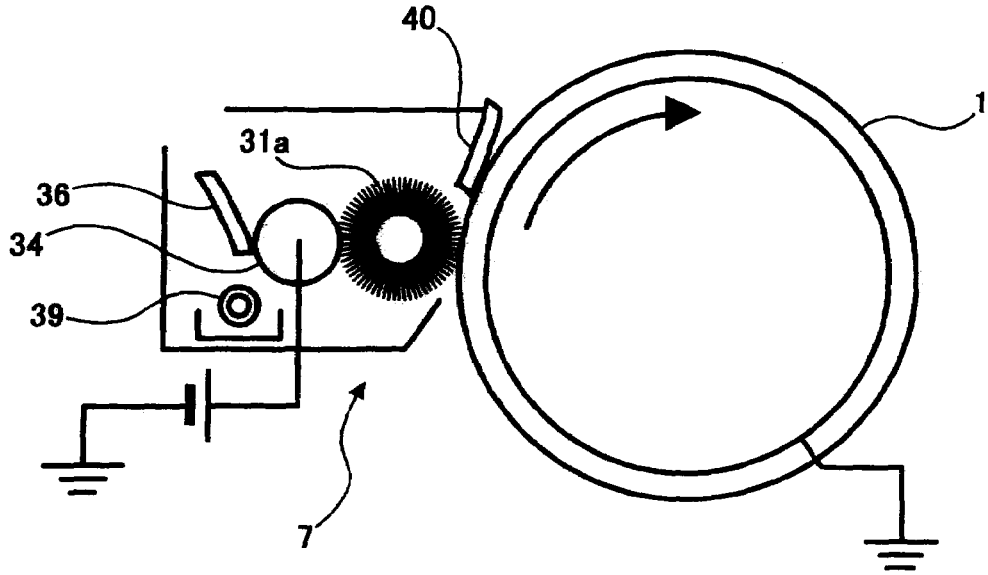
FIG. 43 shows an image forming apparatus representative of a tenth embodiment of the present invention.

FIG. 43 shows a tenth embodiment of the present invention similar to the eighth embodiment except for the following. As shown, a conductive fur brush 31*a*, containing the protection substance 41 therein, is substituted for the conductive fur brush 31 and coats the protection substance 41 on the drum 1. This embodiment not only achieves the same advantages as the eighth embodiment, but also saves the space otherwise assigned to the protection substance 41 for thereby reducing the size of the cleaning device 7 and insuring stable, uniform coating over a long period of time.

Eleventh Embodiment

Figure 44:
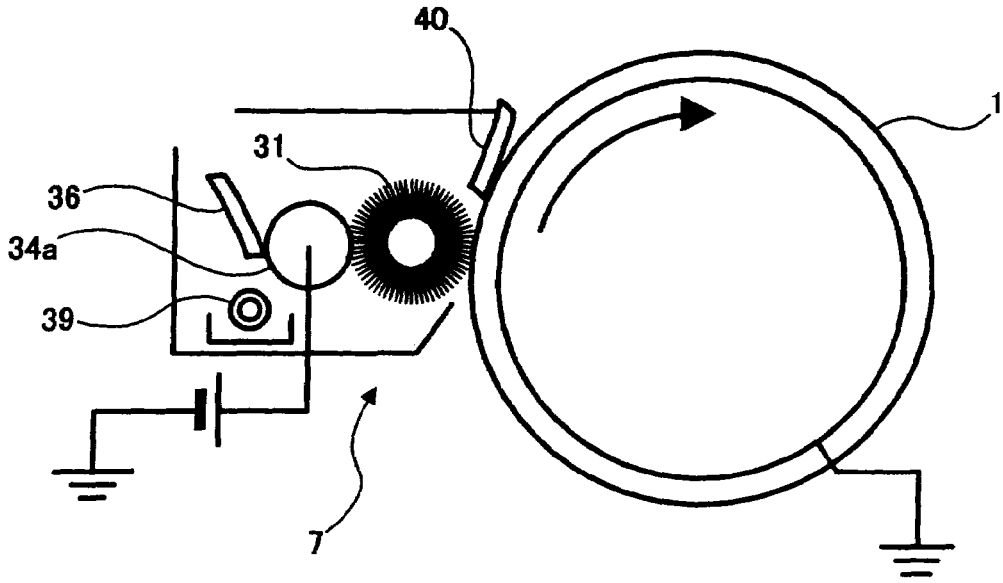
FIG. 44 shows an image forming apparatus representative of an eleventh embodiment of the present invention.

FIG. 44 shows an eleventh embodiment of the present invention also similar to the eighth embodiment except for the following. As shown, a collection roller 34*a*, containing the protection substance 41 is substituted for the collection roller 34, so that the protection substance 41 is coated on the drum 1 by way of the conductive fur brush 31. This embodiment not only achieves the same advantages as the eighth embodiment, but also saves the space otherwise assigned to the protection substance 41 for thereby reducing the size of the cleaning device 7 and insuring stable, uniform coating over a long period of time like the tenth embodiment.

Twelfth Embodiment

Figure 45:
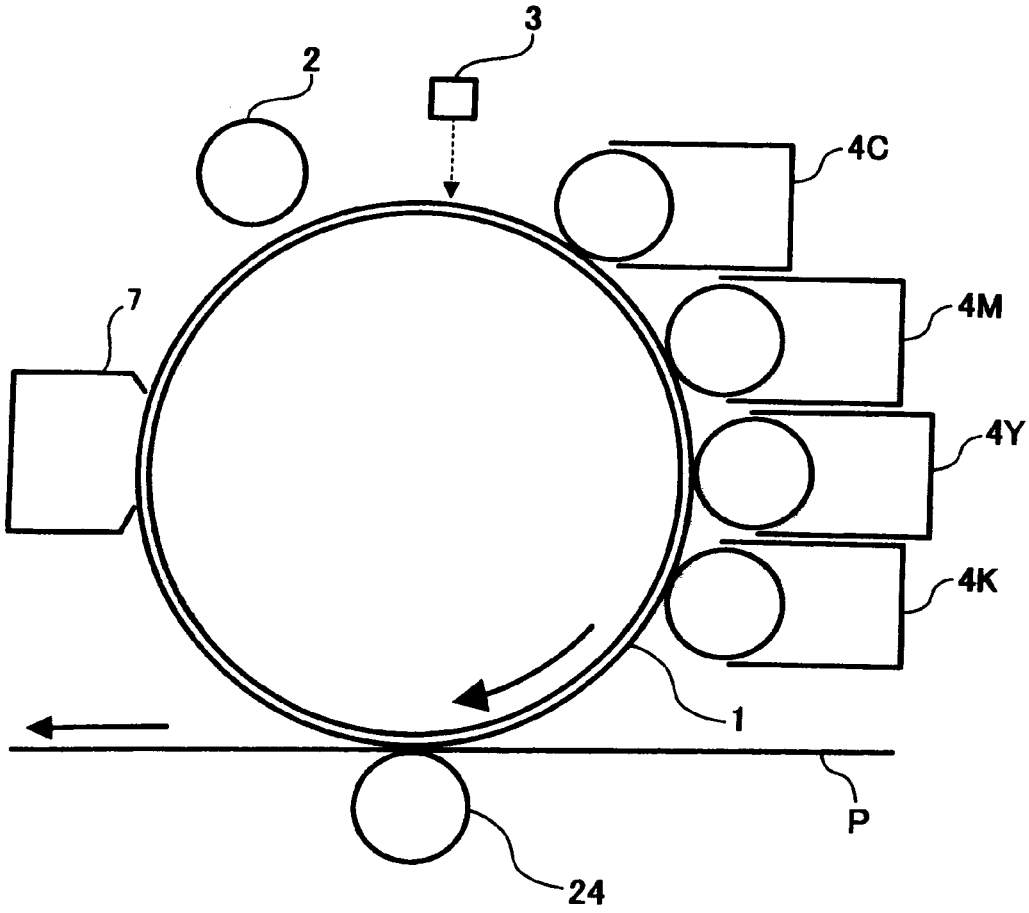
FIG. 45 shows an image forming apparatus representative of an twelfth embodiment of the present invention.

FIG. 45 shows a full-color image forming apparatus to which any one of the eighth to eleventh embodiments is applied. As shown, a C, an M, a Y and a K developing devices are implemented as a revolver arranged around the drum 1. The operation of such developing devices has already been described. The revolver type image forming apparatus may, of course, be replaced with a tandem image forming apparatus, although not shown specifically.

Thirteenth Embodiment

Figure 46:
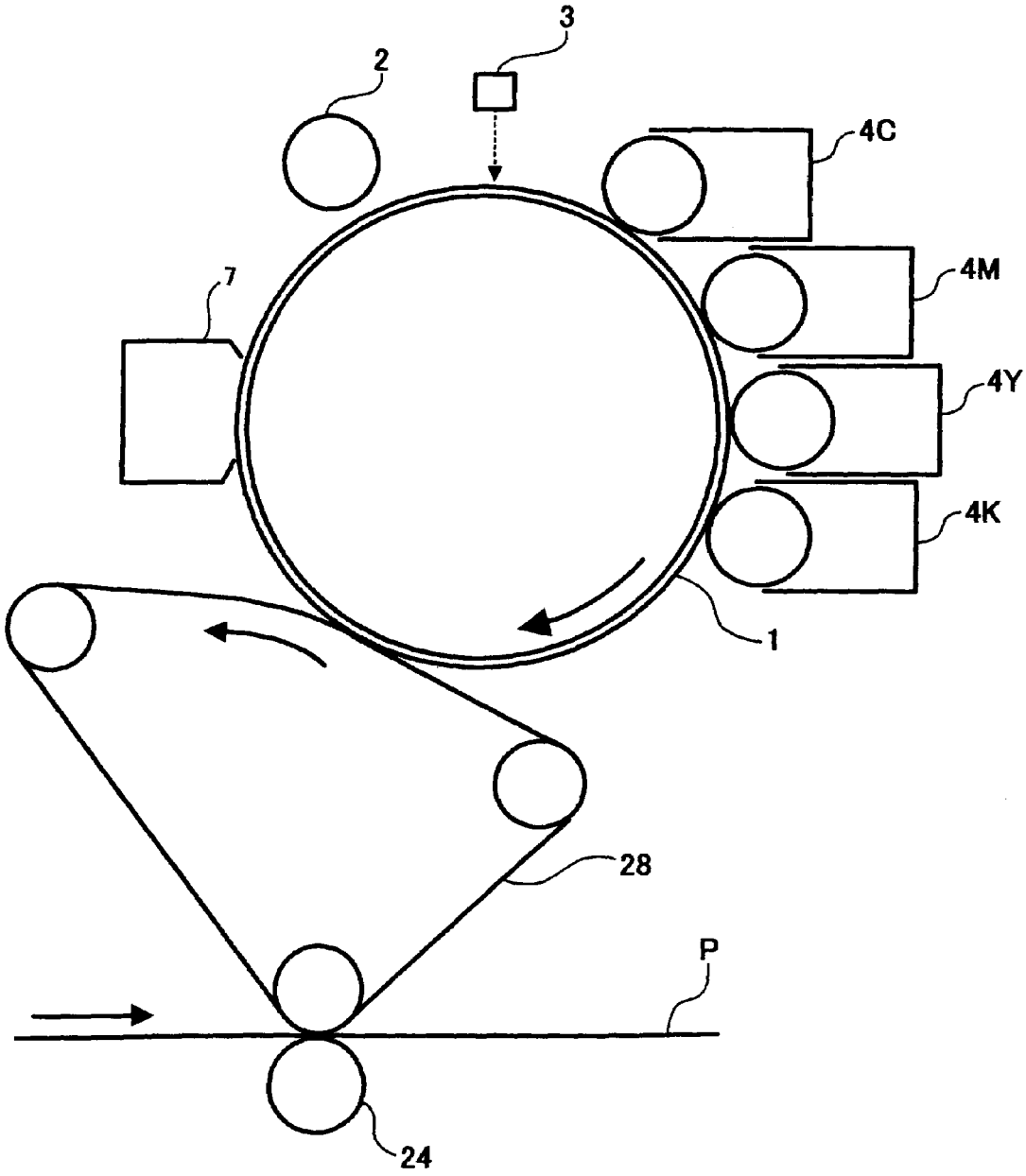
FIG. 46 shows an image forming apparatus representative of a thirteenth embodiment of the present invention.

FIG. 46 shows a full-color image forming apparatus of the type including an intermediate image transfer belt 28 in combination of a revolver type developing unit. The operation of the image forming apparatus is analogous to the operation of the apparatus of FIG. 38.

Fourteenth Embodiment

Figure 47:
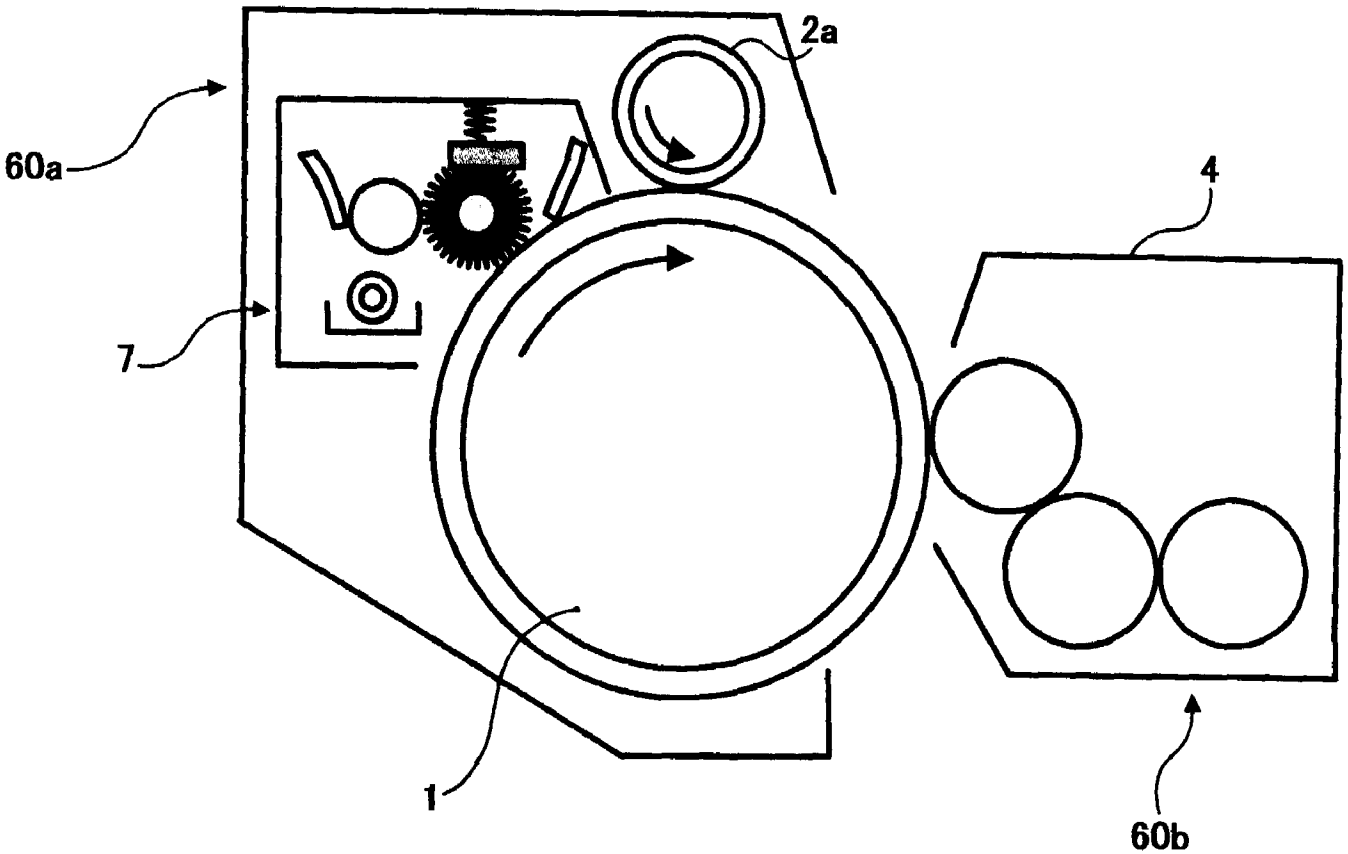
FIG. 47 shows an image forming apparatus representative of a fourteenth embodiment of the present invention.

FIG. 47 shows a fourteenth embodiment of the present invention. As shown, the apparatus, like the apparatus of FIG. 39, includes a process cartridge 60*a* loaded with the charge roller 2*a* and the cleaning device 7 and a process cartridge loaded with the developing device 4. The apparatus of FIG. 47 therefore has the same advantages as the apparatus of FIG. 39.

Fifteenth Embodiment

Figure 48:
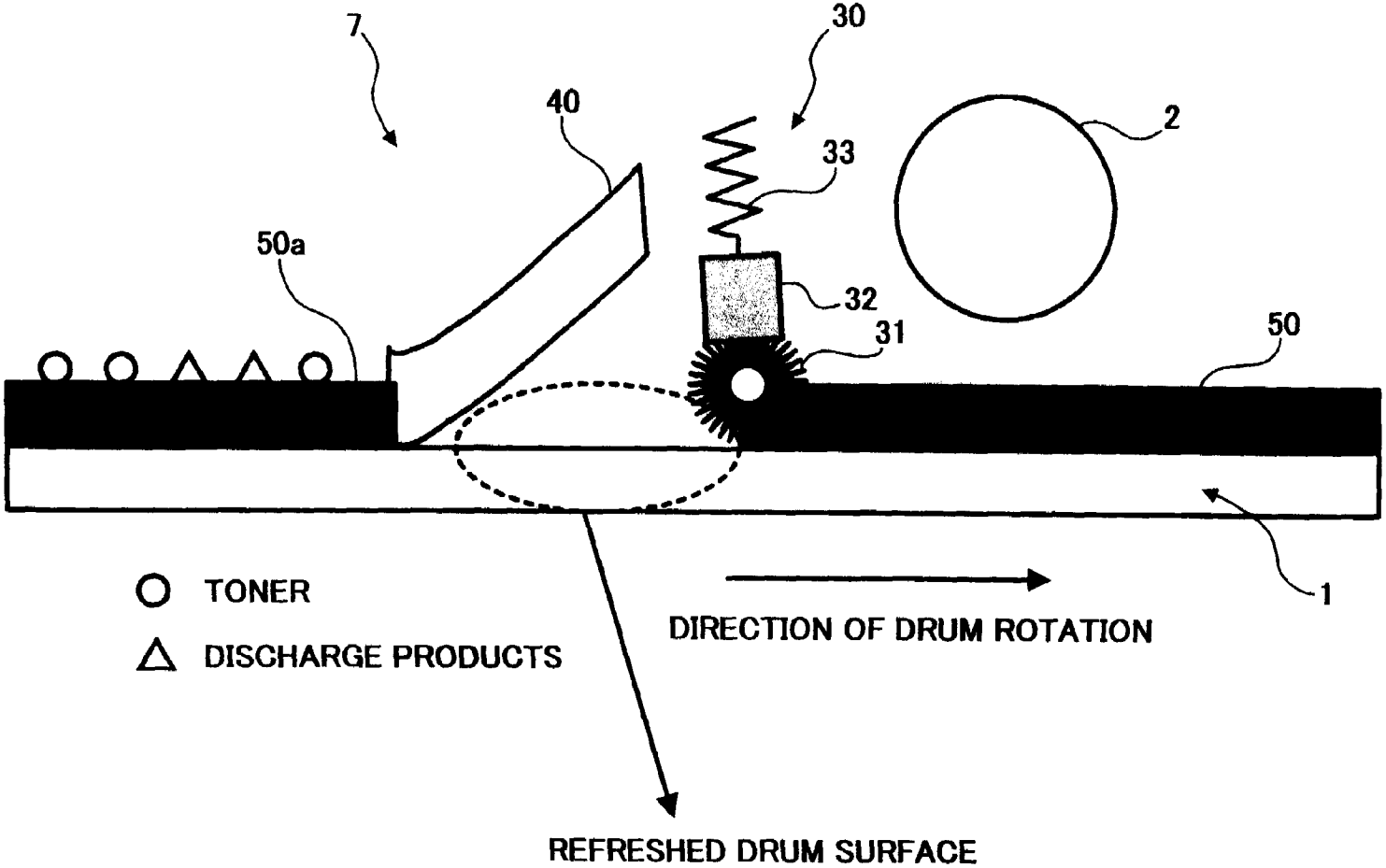
FIG. 48 shows a cleaning device included in the fourteenth embodiment.

FIG. 48 shows a fifteenth embodiment of the present invention. As shown, while the eighth to fourteenth embodiments each assign the toner removing function and coating function to a single means, the fifteenth embodiment uses exclusive coating means positioned between the cleaning device 7 and the charger 2. In this configuration, the portion of the drum surface coated with the protection substance does not contact any member until it moves away from the charger 2, so that the protection substance is prevented from being wastefully consumed. This reduces the required amount of protection substance and therefore saves space and cost.

The illustrative embodiment is also applicable to any one of the image forming apparatus described with reference to FIGS. 9, 30, 31, 33 and 35 through 39.

More specifically, as shown in FIG. 48, the cleaning device 7 includes the cleaning blade 40 contacting the drum 1 in order to remove the various hazard substances stated earlier as well as toner and deteriorated part of a protection substance 50*a*. The protection substance 50*a* can therefore be always coated on the refreshed surface of the drum 1.

Various modifications will become possible for those skilled in the art after receiving the teachings of the present disclosure without departing from the scope thereof.

What is claimed is:

1. An image forming apparatus for forming an image on an image carrier comprising:

a charging member contacting or adjoining a surface of the image carrier;

a protection layer formed on the surface of the image carrier for protecting said surface from chemical deterioration ascribable to proximity discharge effected by said charging member; and a cleaning device comprising a fur brush including conductive fibers and a collection roller contacting said fur brush, wherein a voltage between 100V and 300V is directly applied to said collection roller and is indirectly applied to said brush via said collection roller, to thereby collect toner from the image carrier by use of an electric field.

2. An image forming apparatus comprising:

an image carrier for carrying a latent image thereon;

a charger configured to charge a surface of said image carrier;

a developing device configured to develop the latent image with a developer to thereby produce a toner image by depositing said developer on a developer carrier and causing said developer carrier to convey said developer to a developing zone where said developer carrier faces said image carrier;

a cleaning device configured to remove residual toner left on said image carrier after transfer of the toner image to a recording medium, the cleaning device comprising a fur brush including conductive fibers and a collection roller contacting said fur brush, wherein a voltage between 100V and 300V is directly applied to said collection roller and is indirectly applied to said brush via said collection roller, to thereby collect toner from the image carrier by use of an electric field; and feeding means for feeding a protection substance to the surface of said image carrier to thereby form a protection layer;

wherein said feeding means is positioned directly downstream of said charger.

3. The apparatus as claimed in claim 2, wherein said feeding means comprises a brush-like coating member configured to coat the protection substance on the surface of said image carrier.

4. The apparatus as claimed in claim 2, wherein said feeding means comprises a coating member comprising an elastic roller configured to coat the protection substance on the surface of said image carrier.

5. The apparatus as claimed in claim 2, wherein said coating member contains the protection substance.

* * * * *